US007537875B2

(12) United States Patent
Mikuriya et al.

(10) Patent No.: US 7,537,875 B2
(45) Date of Patent: May 26, 2009

(54) TONER

(75) Inventors: Yushi Mikuriya, Numazu (JP); Satoshi Handa, Shizuoka-ken (JP); Yuji Moriki, Numazu (JP); Yasushi Katsuta, Shizuoka-ken (JP); Emi Tosaka, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 286 days.

(21) Appl. No.: 11/157,874

(22) Filed: Jun. 22, 2005

(65) Prior Publication Data

US 2006/0063082 A1 Mar. 23, 2006

(30) Foreign Application Priority Data

Sep. 22, 2004 (JP) ..... 2004-275553

(51) Int. Cl.
*G03G 9/00* (2006.01)

(52) U.S. Cl. ..... 430/108.3; 430/108.4; 430/109.4; 430/111.4; 430/137.14

(58) Field of Classification Search ..... 430/109.4, 430/108.3, 108.4, 111.4, 137.14
See application file for complete search history.

(56) References Cited

U.S. PATENT DOCUMENTS

| | | | | |
|---|---|---|---|---|
| 2,297,691 | A | 10/1942 | Carlson | 95/5 |
| 4,578,338 | A | 3/1986 | Gruber et al. | 430/120 |
| 4,810,612 | A | 3/1989 | Ueda et al. | 430/109 |
| 4,921,771 | A | 5/1990 | Tomono et al. | 430/110 |
| 4,988,598 | A | 1/1991 | Tomono et al. | 430/99 |
| 4,990,424 | A | 2/1991 | Van Dusen et al. | 430/106.6 |
| 4,997,739 | A | 3/1991 | Tomono et al. | 430/110 |
| 5,004,666 | A | 4/1991 | Tomono et al. | 430/110 |
| 5,023,158 | A | 6/1991 | Tomono et al. | 430/99 |
| 5,547,800 | A | 8/1996 | Nishimori et al. | 430/110 |
| 5,629,123 | A | 5/1997 | Tomono et al. | 430/110 |
| 5,686,218 | A * | 11/1997 | Liebermann et al. | 430/109.4 |
| 5,744,571 | A * | 4/1998 | Hilbert et al. | 528/272 |
| 6,080,519 | A * | 6/2000 | Ishiyama et al. | 430/110.3 |
| 6,346,070 | B1 | 2/2002 | Ohmatsuzawa et al. | 529/279 |
| 6,451,959 | B1 | 9/2002 | Ohmatsuzawa et al. | 528/279 |
| 7,029,813 | B2 | 4/2006 | Mikuriya et al. | 430/108.1 |
| 7,049,041 | B2 | 5/2006 | Kishiki et al. | 430/109.4 |
| 2002/0025184 | A1 * | 2/2002 | Ishikawa et al. | 399/111 |
| 2004/0241565 | A1 * | 12/2004 | Kishiki et al. | 430/109.4 |
| 2005/0026061 | A1 * | 2/2005 | Mikuriya et al. | 430/108.1 |
| 2005/0064310 | A1 * | 3/2005 | Masuda et al. | 430/107.1 |
| 2005/0064313 | A1 | 3/2005 | Kishiki et al. | 430/109.2 |
| 2005/0238984 | A1 | 10/2005 | Kaburagi et al. | 430/109.1 |

FOREIGN PATENT DOCUMENTS

| | | |
|---|---|---|
| EP | 0745906 | 12/1996 |

(Continued)

*Primary Examiner*—Mark A Chapman
(74) *Attorney, Agent, or Firm*—Fitzpatrick, Cella, Harper & Scinto

(57) ABSTRACT

In a toner having toner particles which comprise toner base particles containing at least a colorant, a release agent and a polar resin, and an inorganic fine powder, the polar resin is a resin having at least a polyester unit, synthesized in the presence of an aromatic carboxylic acid titanium compound used as a catalyst, and has an acid value of from 3 mgKOH/g to 35 mgKOH/g. The toner base particles are obtained by carrying out granulation in an aqueous medium, and the toner has a weight-average particle diameter of from 4.0 μm to 10.0 μm.

8 Claims, 5 Drawing Sheets

FOREIGN PATENT DOCUMENTS

| | | |
|---|---|---|
| EP | 0952493 | 10/1999 |
| EP | 1467257 | 10/2004 |
| EP | 1480089 | 11/2004 |
| EP | 1503250 | 2/2005 |
| JP | 42-23910 | 11/1942 |
| JP | 43-24748 | 10/1943 |
| JP | 52-3304 | 1/1977 |
| JP | 52-3305 | 1/1977 |
| JP | 57-52574 | 3/1982 |
| JP | 60-217366 | 10/1985 |
| JP | 60-252360 | 12/1985 |
| JP | 60-252361 | 12/1985 |
| JP | 61-94062 | 5/1986 |
| JP | 61-138259 | 6/1986 |
| JP | 61-273554 | 12/1986 |
| JP | 62-14166 | 1/1987 |
| JP | 1-109359 | 4/1989 |
| JP | 1-185660 | 7/1989 |
| JP | 1-185662 | 7/1989 |
| JP | 1-185663 | 7/1989 |
| JP | 1-238672 | 9/1989 |
| JP | 2-79860 | 3/1990 |
| JP | 3-50559 | 3/1991 |
| JP | 4-301853 | 10/1992 |
| JP | 5-61238 | 3/1993 |
| JP | 5-279465 | 10/1993 |
| JP | 6-59502 | 3/1994 |
| JP | 8-54750 | 2/1996 |
| JP | 1-185661 | 7/1998 |
| JP | 2000-148867 | 5/2000 |
| JP | 2001-64378 | 3/2001 |
| WO | WO 03/052521 | 6/2003 |
| WO | WO 03/073171 | 9/2003 |

* cited by examiner

TONER

BACKGROUND OF THE INVENTION

1. Field of the Invention

This invention relates to a toner used in electrophotography, electrostatic recording, electrostatic printing and toner jet recording (magnetic recording).

2. Related Background Art

A number of methods are known as methods for electrophotography (see, e.g., U.S. Pat. No. 2,297,691, and Japanese Patent Publications No. S42-23910 and No. S43-24748). In general, copies are obtained by first forming an electrostatic latent image on a photosensitive member by various means utilizing a photoconductive material, subsequently developing the latent image by the use of a toner to form a visible image, and transferring the toner (toner image) to a recording material such as paper as occasion calls, followed by fixing by the action of heat and/or pressure. The toner that has not transferred to and has remained on the photosensitive member is cleaned by various means, and then the above process is repeated.

In recent years, it has been put forward to improve such copying apparatus making use of electrophotography, toward higher image quality, smaller size, lighter weight, higher speed and higher reliability with a high demand from users, where the performance of products have severely been investigated. Also, the such image-forming apparatus not only have been used as copying machines for office working to take copies of originals, but also have long been used as digital printers for outputting data from computers or used for copying highly minute images such as graphic designs. In more recent years, with spread of digital cameras, there is an increasing demand for high-color printers for outputting photographs taken therewith. In the meantime, it has become more and more necessary to consider how to deal with environmental problems, how to deal with energy saving, and so forth.

The step of development may be given as the step of forming electrophotographic images that makes it difficult to achieve higher image quality, higher minuteness and higher stability as those demanded by users. In electrophotography, the step of developing an electrostatic latent image is the step of utilizing electrostatic mutual action between toner particles having been charged and the electrostatic latent image to form a visible image on the electrostatic latent image. Developers with which electrostatic latent image are developed by the use of toners include a magnetic one-component developer making use of a toner formed of a resin and a magnetic material dispersed therein, a non-magnetic one-component developer which performs development by charging a non-magnetic toner electrostatically by means of a charge-providing member such as an elastic blade, and a two-component developer formed of a blend of a non-magnetic toner with a magnetic carrier.

The technique to expose the photosensitive member to light using small-diameter laser beams or the like has advanced and electrostatic latent images have come minute, it has been put forward to make both toner particles and carrier particles have smaller diameters in any of the above developing systems so that faithful development can be performed on the electrostatic latent images and images can be reproduced in a higher image quality. In particular, it is often attempted to make toners have a smaller average particle diameter to improve image quality. Making toners have a smaller average particle diameter is an effective means for improving image characteristics, in particular, graininess and character reproducibility. However, it has problems to be solved, in respect of specific image quality items, in particular, fog at the time of extensive printing, melt adhesion to photosensitive member, toner scattering and so forth.

Such problems are considered to be firstly caused by the facts that i) the use of toners over a long period of time causes deterioration of external additives having been added to toner particles and ii) charge-providing members such as a developing sleeve and a carrier and a toner layer thickness control member for keeping the coating of toner on the sleeve to a stated level are contaminated by the toner and the external additives, i.e., toner-spent comes about. Consequently, a lowering of charge quantity of toners results from these two things, an hence brings about the above problems. These phenomena tend to occur as a result of making toners have smaller particle diameters. Stated in detail, triboelectric charging is performed by means of physical external force such as contact and collision between the toner and the sleeve in the case of one-component developers and between the toner and the carrier in the case of two-component developers, and hence the toner, the charge-providing members (sleeve and carrier) and the toner layer thickness control member may necessarily be damaged. For example, in the toner, the external additives added to its toner particle surfaces may come buried in toner particles or toner components may come off. In the charge-providing members and the toner layer thickness control member, they may be contaminated with toner components including the external additives, or coat components with which the charge-providing members have been coated in order to stabilize charge properly may wear or be broken. Because of such damage, the initial characteristics of the developers become not maintainable with an increase in the number of copying times to cause fog, in-machine contamination and variations of image density. This phenomenon becomes conspicuous especially as the image units of electrostatic latent images are made minuter.

Secondly, the above problems may arise because, where an original having a high image area percentage is used and where the toner is fed onto the charge-providing members in a large quantity, it takes a time until the toner having been fed is uniformly charged and the toner uncharged participates in development. This phenomenon occurs remarkably especially when the toner has small diameter and has a low fluidity. Any image defects thereby caused tend to come into question when multi-superimposed images are formed in full-color image formation, and are especially required to be remedied. As a countermeasure for this problem, studies have been made on triboelectric series and resistance of the charge-providing members. As the toner, it is also studied to improve various charge control agents so that the toner can quickly be charged.

As the magnetic carrier used in the two-component developer, an iron powder carrier, a ferrite carrier or a carrier coated with a resin obtained by dispersing fine magnetic-material particles in a binder resin is known in the art. In particular, a developer making use of a resin-coated carrier obtained by coating carrier core material surfaces with a resin is preferably used because it can have proper electrical resistance, has superior charge controllability and can relatively easily be improved in environmental stability and stability with time.

In order to overcome an insufficiency in charging to the small-particle-diameter toner as stated above, it is also a preferable means especially in the two-component developer to make the carrier have a small particle diameter. This, however, tends to make toner-spent resistance poor as the carrier has a larger specific surface area. To solve such problems, it is attempted to use the carrier in a large quantity. This, however, goes against the downsizing of copying machine or printer main bodies, and is not practical.

Meanwhile, steps which are most important for satisfying the demand of users and are technically difficult include the fixing step. With regard to the fixing step, various methods and assemblies have been provided. The most commonly available method at present is a pressure-and-heating system making use of a heated roller, film or belt.

The pressure-and-heating system is a system in which the toner image surface of a fixing-medium sheet (a sheet to which toner images are to be fixed) is made to pass the surface of a fixing member having a heating source in contact with a pressure member under application of its pressure against the fixing member to perform fixing. This system is very effective in high-speed electrophotographic copying machines because the toner image on the fixing-medium sheet comes into contact with the surface of the fixing member as a heating member under application of pressure and hence the thermal efficiency in fusing the toner image onto the fixing-medium sheet is so good that the toner image can rapidly be fixed. In this system, however, since the toner image comes into pressure contact with the heating member in a molten state, what is called "offset phenomenon" may occur in which part of the toner image may adhere, and be transferred, to the heating member surface to contaminate the next fixing-medium sheet. Accordingly, it is required to make the toner not adhere to the heating member.

For this reason, for the purpose of preventing the offset phenomenon, a method in which an oil such as silicone oil is fed to the fixing member to apply the oil uniformly on the fixing member is also used in color electrophotographic apparatus.

This method is very effective in preventing the offset of the toner. However, it requires a unit for feeding such an offset-preventive fluid, and has a problem that it makes the fixing assembly complicate, providing an inhibitory factor in the designing of compact and inexpensive systems. Further, in the case of a transparency film or sheet urilizing an overhead projector (OHP film or sheet) needed increasingly as its use for presentation, it has a low oil absorption capacity as being different from paper, and hence the stickiness of the OHP film surface has come into question. In the case where the fixing-medium sheet is paper as well, it has a problem that its surface is not inscribable with a pen using water-based ink or the like because of the oil absorbed therein. Under such background, it is strongly sought to provide a toner that is fixable in an oilless system or a system in which the oil is applied in a small quantity.

Under such circumstances, oilless fixing or small-quantity oil application fixing has been materialized in color toners as well, by incorporating a release agent into toner particles. It is known to incorporate the release agent into toner particles, and techniques relating thereto are also disclosed in a large number (see, e.g., Japanese Patent Publications No. S52-3304 and No. S52-3305. and Japanese Patent Applications Laid-open No. S57-52574, No. H3-50559, No. H2-79860, No. H1-109359, No. S62-14166, No. S61-273554, No. S61-94062, No. S61-138259, No. S60-252361, No. S60-252360 and No. S60-217366). The release agent is used in order to improve anti-offset properties at the time of low-temperature fixing or high-temperature fixing of toners, or to improve fixing performance at the time of low-temperature fixing. On the other hand, the use of the release agent may lower anti-blocking properties of toners, may lower developing performance of toners because of in-machine temperature rise, or may lower developing performance of toners because of exudation of the release agent to toner particle surfaces when the toners are left over a long period of time.

A technique is also disclosed in which specifying the modulus of elasticity in the vicinity of fixing setting temperature, of toner particles containing a release agent enables achievement of both OHP film transparency and high-temperature anti-offset properties in oilless fixing as well (see Japanese Patent Applications Laid-open No. H6-59502 and H8-54750). However, in the case of high-speed fixing, in which the temperature of the heating member drops violently at the time of continuous paper feed, this technique has some problems in respect of things relating to fixing, such as faulty fixing at the time of low-temperature fixing, what is called a low-temperature offset phenomenon and faulty paper delivery and placement, and in respect of how to ensure stable developing performance over a long period of time.

Further description is added in regard to the above faulty paper delivery and placement. As a problem in the case of the oilless fixing or small-quantity oil application fixing, the transfer sheet may be put out in such a form that it is pulled toward the fixing member after its leading end on the paper delivery side has passed the fixing nip. This is a phenomenon which occurs because of a shortage of releasability between the toner melt surface and the fixing member. In this case, the problem of faulty placement may arise on the paper delivered in a large number of sheets. Also, where the above phenomenon occurs at a serious level, the transfer sheet may wind around the fixing member to cause the faulty paper delivery. In order to prevent this faulty paper delivery, it is attempted to provide a member such as a separation claw in contact or in non-contact with the fixing member. However, in the case of providing the separation claw in contact with the fixing member, the offset toner having stagnated at the separation claw or the like may enlarge the contact pressure on the fixing member to scratch the fixing member surface, so that the fixing performance at that part may lower to cause a difference in gloss from the other part, making the quality level of fixed images different only at that part.

In addition, the toner having stagnated at the separation claw may come off at certain timing and transfer to the pressure member to cause what is called back staining where the back of the image-reproduced sheet stains. In order to lessen such a phenomenon, it is attempted to bring into touch therewith a web or the like impregnated with silicone oil or the like. This, however, goes against the downsizing of copying machine or printer main bodies as stated above. The phenomenon of wind-around may more occur as the affinity of the toner for the fixing member is higher, and tends to occur more seriously as the fixing speed is higher and the fixing temperature is lower as the makeup of fixing.

As a further demand in the fixing step, toners should be brought forth which are fixable at a low temperature correspondingly to the achievement of energy saving and high speed in copying machine or printer main bodies. In particular, in the formation of full-color images, colors are reproduced chiefly using three color toners of yellow, magenta and cyan colors, which are the three primary colors in color formation, or four color toners consisting of these color toners and a black toner added thereto. Accordingly, in fixing multicolor toner images onto paper and in fixing them onto the overhead projector transparency sheet (OHT), color reproducibility and transmission properties must be satisfied. Thus, their formation involves a high degree of technical difficulty.

In order to solve these problems, it is preferable to use a resin having sharp-melt properties. In particular, it is attempted to incorporate a polyester resin into toner particles.

The polyester resin affords superior low-temperature fixing performance, but, on the other hand, because of the acid value and hydroxyl value it has, makes it difficult to control charge quantity when made into a toner. Stated specifically, it is considered to be a matter that the resin may make the toner greatly dependent on environment, such that the toner may be charged in excess (what is called charge-up) in an environment of low humidity and charged insufficiently in an environment of high humidity, and it may make the toner have a low rise speed of charging.

As a polymerization catalyst used for producing such a polyester resin for toners, it has commonly been attempted to use a tin type catalyst such as dibutyltin oxide or an antimony type catalyst such as antimony trioxide. These techniques have some problem in respect of fixing performances such as low-temperature fixing performance and high-temperature anti-offset properties which are demanded in full-color copying machines in recent years, how to satisfy color reproducibility such as color mixing properties and transparency, rise characteristics of charging, and how to stably control charge quantity of toners.

Accordingly, it is invented to use a titanate of a diol as the polymerization catalyst (see Japanese Patent Application Laid-open No. 2002-148867). It is also invented to use a solid titanium compound as the polymerization catalyst (see Japanese Patent Application Laid-open No. 2001-64378). A technique is also proposed in which a titanium tetraalkoxide having been treated with an organomonocarboxylic acid is used as a condensation polymerization catalyst for a polyester resin (see Japanese Patent Application Laid-open No. H5-279465. Although the use of a titanium compound as the polymerization catalyst keeps the phenomenon of charge-up of toners from occurring, these proposals have not made the rise characteristics of charging well satisfactory. Moreover, the color reproducibility and so forth can not be said to be satisfactory.

The use of the resin having sharp-melt properties also usually tends to cause a problem on high-temperature anti-offset properties when the toner melts in the step of heat-and-pressure fixing, because the binder resin has a low self-cohesive force. Accordingly, a relatively highly crystalline wax as typified by polyethylene wax and polypropylene wax is used as the release agent in order to improve the high-temperature anti-offset properties at the time of fixing. However, in the toners for full-color images, when images are projected using an overhead projector (OHP), their transparency may be obstructed and the projected images may have a low chroma or brightness, because of a high crystallizability of the release agent itself or a difference in refractive index between the release agent and the OHP sheet.

Accordingly, to solve these problems, a method is proposed in which a wax having a low crystallinity is used (see Japanese Patent Applications Laid-open No. H4-301853 and No. H5-61238). As waxes having a relatively good transparency and a low melting point, montan type waxes are available. Use of such montan type waxes is proposed in a large number (see Japanese Patent Applications Laid-open No. H1-185660, No. H1-185661, No. H1-185662, No. H1-185663 and No. H1-238672). These waxes, however, have some problems in well satisfying all the transparency on OHP sheets and the low-temperature fixing performance and high-temperature anti-offset properties at the time of heat-and-pressure fixing.

In addition, in any of the above toners incorporated with the release agent, those which afford good developing performance, in particular, the rise characteristics of charging stably over a long period of time do not exist because of the presence of the release agent on toner particle surfaces.

Thus, it is sought to provide a toner which has achieved both the fixing performance that can realize low-cost, compact and high-speed machines and the developing performance that can satisfy image quality level over a long period of time.

SUMMARY OF THE INVENTION

The present invention has been made in order to solve the above problems. Accordingly, an object of the present invention is to provide a toner having superior low-temperature fixing performance and high-temperature anti-offset properties.

Another object of the present invention is to provide a toner which has superior color reproducibility such as color mixing properties and transparency in color toners.

Still another object of the present invention is to provide a toner which can form images with high image quality as having so quick rise of charging that stable charge quantity can be held in any environment.

As a result of repeated extensive studies, the present inventors have discovered that the above requirements can be satisfied by using a binder resin synthesized in the presence of a specific polymerization catalyst, and have accomplished the present invention. That is, the present invention is as described below.

(1) A toner comprising toner particles which comprise toner base particles containing at least a colorant, a release agent and a polar resin, and an inorganic fine powder, wherein;

the polar resin is a resin having at least a polyester unit, synthesized in the presence of an aromatic carboxylic acid titanium compound used as a catalyst, and has an acid value of from 3 mgKOH/g to 35 mgKOH/g;

the toner base particles are obtained by carrying out granulation in an aqueous medium; and the toner has a weight-average particle diameter of from 4.0 μm to 10.0 μm.

(2) The toner according to (1), wherein the aromatic carboxylic acid titanium compound is a compound obtained by a reaction of an aromatic carboxylic acid with a titanium alkoxide.

(3) The toner according to (2), wherein the aromatic carboxylic acid is at least one of a dibasic or higher aromatic carboxylic acid and an aromatic hydroxycarboxylic acid.

(4) The toner according to (2) or (3), wherein the titanium alkoxide is a compound represented by the following general formula (1):

General formula (1)

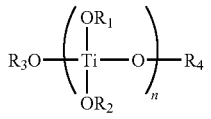

In the general formula (1), R1, R2, R3 and R4 each represent an alkyl group having 1 to 20 carbon atoms, which may be identical with or different from each other and may have a substituent; and n represents an integer of 1 to 10.

(5) The toner according to any one of (1) to (4), wherein, in a water/methanol wettability test of the toner base particles and the toner, the methanol concentration (% by weight) of each of them at the time the transmittance shows the value of 50% of the initial value satisfies the following expressions:

$$10 \leqq TA \leqq 70;$$

$$30 \leqq TB \leqq 90; \text{ and}$$

$$0 \leqq TB - TA \leqq 60$$

wherein TA is the methanol concentration (% by weight) at the time the transmittance of the toner base particles shows the value of 50%, and TB is the methanol concentration (% by weight) at the time the transmittance of the toner shows the value of 50%.

(6) The toner according to any one of (1) to (5), wherein the toner has a peak temperature of a maximum endothermic peak of 50° C. to 120° C. in a temperature range of 30° C. to 200° C. in an endothermic curve obtained by the differential scanning calorimetry (DSC) measurement.

(7) The toner according to any one of (1) to (6), which further comprises a salicylic-acid metal compound as a charge control agent.

(8) The toner according to (7), wherein the salicylic-acid metal compound is a salicylic-acid aluminum compound or a salicylic-acid zirconium compound.

(9) The toner according to any one of (1) to (8), wherein the polar resin has a hydroxyl value of from 5 mgKOH/g to 40 mgKOH/g.

(10) The toner according to any one of (1) to (9), wherein the toner base particles are toner base particles produced by dispersing and granulating in an aqueous medium a polymerizable monomer composition which contains at least a polymerizable monomer, the colorant, the polar resin, the release agent and a polymerization initiator, and polymerizing the polymerizable monomer.

In the present invention, in virtue of the use of the toner having a polyester unit and having an appropriate acid value, synthesized using the aromatic carboxylic acid titanium compound as a catalyst, the rise of charging can be so quick that images with stable image density, free of fog and with superior stability during running can be obtained even in continuous printing on a large number of sheets. Also, the polar resin and the release agent act mutually to make it possible to provide toners having a broad fixing temperature range, without causing deterioration of developing performance.

DESCRIPTION OF THE PREFERRED EMBODIMENTS

—Toner of the Invention—

Figure 1:
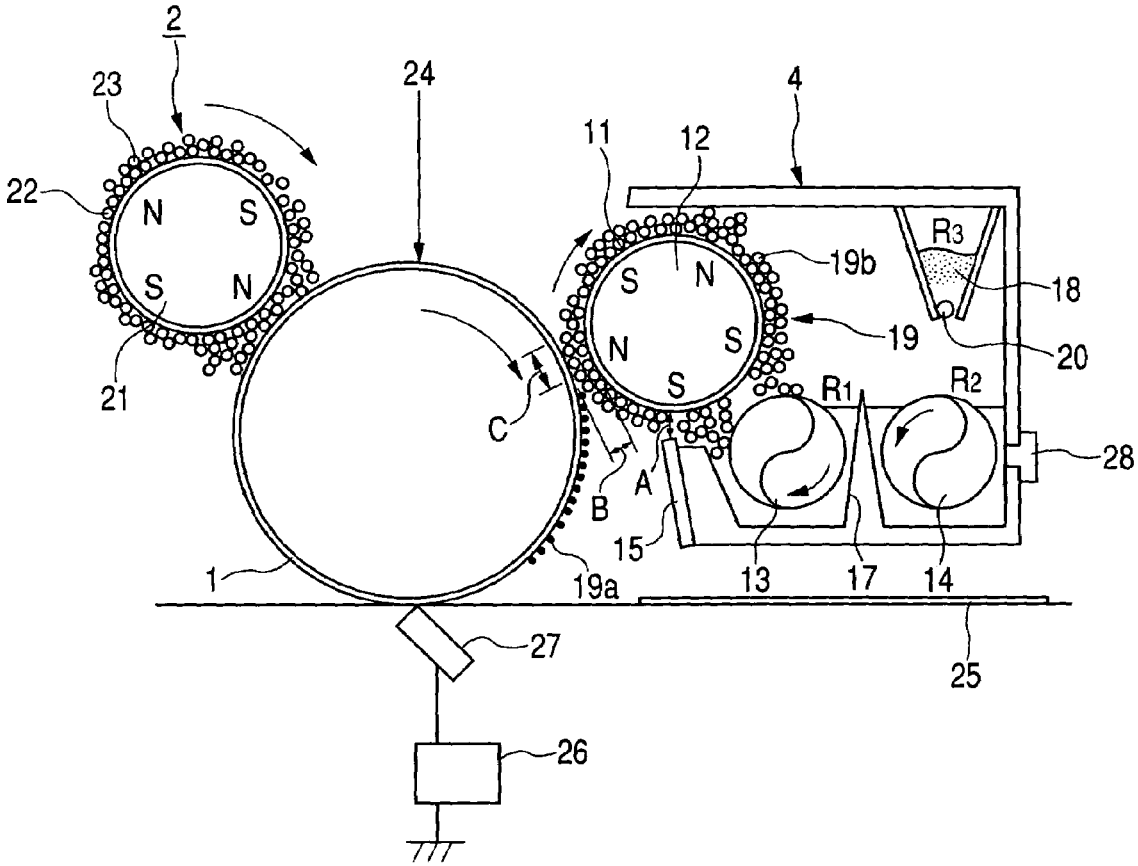
FIG. 1 is a partial diagrammatic view showing an example of an image-forming apparatus in which the toner of the present invention is preferably usable.

The toner of the present invention has toner base particles containing at least a colorant, a release agent and a polar resin, and an inorganic fine powder. The polar resin contained in the toner base particles in the present invention is characterized by being a resin having at least a polyester unit, synthesized using an aromatic carboxylic acid titanium compound as a catalyst, and having an acid value of from 3 mgKOH/g to 35 mgKOH/g. Further, the toner base particles are characterized by being those obtained by carrying out granulation in an aqueous medium, and having a weight-average particle diameter of from 4.0 μm to 10.0 μm.

As a result of extensive studies, the present inventors have discovered the following. The toner of the present invention is greatly characterized in that the polar resin containing at least a polyester unit, synthesized using an aromatic carboxylic acid titanium compound as a catalyst, is contained in the toner base particles. In the first place, the constitution and performance of the toner of the present invention have relations sketched out below.

The use of the polar resin having a polyester unit brings an improvement in low-temperature fixing performance of the toner, and, in color toners, promises superior color reproducibility such as color mixing performance and transparency. Further, the aromatic carboxylic acid titanium compound is used as a polymerization catalyst for the polyester unit and also the polar resin is made to have an appropriate acid value. These features interact to enable the toner have higher charging speed and saturation charge quantity and also to make it possible to keep charge-up from occurring. The polar resin having a polyester unit also has an appropriate affinity for the release agent, and hence this makes it possible to satisfy low-temperature fixing performance and even high-temperature anti-offset properties, and to ensure a broad fixing temperature region. That is, the release agent having been compatibilized with the polar resin acts plastically to contribute to improvement in the low-temperature fixing performance. Conversely, its part having not been compatibilized exhibits, at the time of fixing, the effect of release from a fixing member as the effect the release agent has originally. That is, the polar resin containing a polyester unit, synthesized using the aromatic carboxylic acid titanium compound as a catalyst, is made to be contained within toner base particles, more preferably to be present in the surface of toner base particles, and this makes it possible for the inorganic fine powder to be able to be held on the toner base particle surfaces stably over a long period of time; the inorganic fine powder being a power that controls the fluidity and charge stability of the toner. Further, such toner particles are used in the toner with small particle diameters, having a weight-average particle diameter of from 4.0 to 10.0 μm, and this makes it able to obtain a toner which has a broad fixing region and can contribute to the formation of images with high image quality.

The present invention is described below in detail.

In the present invention, the "polyester unit" is meant to be a moiety coming from a polyester. Also, the "resin having a polyester unit" is meant to be a resin having such a polyester unit, i.e., a resin containing a repeating unit having at least an ester linkage.

Carboxyl groups the polyester resin has are considered to have the function to improve charging speed and saturation charge quantity of the toner, and OH groups the polyester resin has, to lower saturation charge quantity of the toner. The carboxyl groups are functional groups having a very strong polarity, and hence the carboxyl groups associate with one another to make a state in which polymer chains spread from their associated moieties to surroundings. For example, where two carboxyl groups associate, they are considered to stand as shown in the following structural formula (2) and to have formed a stable associated state. Therefore, incorporating the toner with the polar resin containing a polyester unit, under control of its acid value, as shown in the present invention can make the toner have higher saturation charge quantity and moreover can keep the charge-up from occurring. This enables stable maintenance of high image density from the beginning in whatever environment the images are formed.

(2)

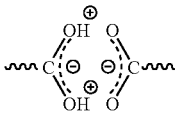

Then, considering the matter from the C—O bond angle of the carboxyl group, it is presumed that four or more carboxyl groups associate to form an aggregate. The aggregate formed by the association of carboxyl groups thus formed stands like holes, and hence it readily accepts free electrons. Therefore, it is presumed that the aggregate has the function to improve the charging speed of the toner. Where it keeps this stable state of association, it is resistant to any attack from the outside. In particular, if water molecules try to coordinate, they can not easily coordinate. Hence, the toner can also have good environmental stability.

The OH groups, contrary to the carboxyl groups, where, e.g., two OH groups associate, stand as shown in the following structural formula (3), and come to have a stronger polarity than in the case where the OH group is one. Thus, electrons can not be present in a stable state like the case when the carboxyl groups associate, and hence they may easily be attacked from the outside. As the result, it is presumed that they tend to be affected by water molecules.

(3)

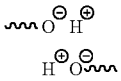

The polyester resin having such charge characteristics is polymerized in the presence of the aromatic carboxylic acid titanium compound used as a catalyst. This enables electric charges to be stably present, in virtue of the mutual action between the titanium compound remaining in the polyester resin and the OH groups of the polyester. Hence, the polyester resin comes not to be easily affected by water content, and the saturation charge quantity can be kept from lowering.

Moreover, in virtue of the above mutual action between the carboxyl group of the aromatic carboxylic acid coming from the aromatic carboxylic acid titanium compound and the carboxyl group coming from the polyester unit, both remaining in the polar resin having a polyester unit, the charging speed and saturation charge quantity can be made higher, and besides the effect of keeping charge-up from occurring can be made higher. Also, fog and toner scattering can be kept from occurring, and further a high transfer efficiency can be achieved in the step of transferring the toner image formed by development on the photosensitive member, to a transfer material or member such as paper or a transfer drum, or the step of transferring the toner image from a transfer belt to paper.

The aromatic carboxylic acid titanium compound used in the present invention may specifically be a compound obtained by the reaction of an aromatic carboxylic acid with a titanium alkoxide, which may preferably be used. As the aromatic carboxylic acid, an aromatic monocarboxylic acid may be used. However, from the viewpoint of well balancing the effect of improving charging speed and saturation charge quantity and the effect of keeping charge-up from occurring as stated above, it may preferably be a dibasic or higher aromatic carboxylic acid and/or an aromatic hydroxycarboxylic acid.

The dibasic or higher aromatic carboxylic acid may include dicarboxylic acids such as phthalic acid, isophthalic acid and terephthalic acid, and anhydrides thereof; and polybasic carboxylic acids such as trimellitic acid, benzophenonedicarboxylic acid, benzophenonetetracarboxylic acid, naphthalenedicarboxylic acid and naphthalenetetracarboxylic acid, and anhydrides or ester compounds thereof. The aromatic hydroxycarboxylic acid may also include salicylic acid, m-hydroxybenzoic acid, p-hydroxycarboxylic acid, gallic acid, mandelic acid and tropic acid.

Of these, as the aromatic carboxylic acid, it is more preferable to use the dibasic or higher aromatic carboxylic acid. Of these, isophthalic acid, terephthalic acid, trimellitic acid and naphthalenedicarboxylic acid are particularly preferred.

As the above titanium alkoxide, a compound represented by the following general formula (1) may preferably be used.

General formula (1)

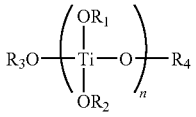

In the general formula (1), R1, R2, R3 and R4 each represent an alkyl group having 1 to 20 carbon atoms, which may be identical with or different from each other and may have a substituent; and n represents an integer of 1 to 10.

The above R1, R2, R3 and R4 may each more preferably be an alkyl group having 1 to 20 carbon atoms. A compound wherein n is 1 in the titanium alkoxide represented by the general formula (1) may specifically preferably be exemplified by titanium tetramethoxide, titanium tetraethoxide, titanium tetra-iso-propoxide, titanium tetra-n-propoxide, titanium tetra-iso-butoxide, titanium tetra-n-butoxide, titanium tetra-tert-butoxide, titanium tetrapentyl oxide, titanium tetrahexyl oxide, titanium tetraheptyl oxide, titanium tetraoctyl oxide, titanium tetranonyl oxide and titanium tetradecyl oxide.

A polytitanate which is a compound wherein n is 2 to 10 in the the general formula (1) may also preferably be used. Such a compound may specifically preferably be exemplified by tetra-n-butyl polytitanate, tetra-n-hexyl polytitanate and tetra-n-octyl polytitanate. Incidentally, as one of methods by which the aromatic carboxylic acid titanium compound used in the present invention is obtained from the aromatic carboxylic acid and the titanium alkoxide, a method is available in which the titanium alkoxide is hydrolyzed in an alcohol solvent such as ethylene glycol to allow to react with the aromatic carboxylic acid to form the aromatic carboxylic acid titanium compound.

The use of the polar resin having a polyester unit, synthesized using the aromatic carboxylic acid titanium compound as a catalyst, brings an improvement in dispersibility of the colorant in the toner base particles, and a toner can be obtained which has superior color reproducibility such as color mixing performance and transparency in fixed images and also has a large covering power on the transfer material. The present inventors have discovered this fact. Its use is effective especially where the colorant is melted and dispersed by masterbatching in a binder resin containing the polar resin used in the present invention, or when the colorant and the binder resin containing the polar resin used in the present invention are dissolved or dispersed in a wet medium to produce the toner base particles. The reason therefore is unclear, and is presumed to be due to the fact that titanium moieties of the aromatic carboxylic acid titanium compound come adsorbed around the colorant to inhibit re-agglomeration of the colorant at aromatic carboxylic acid moieties.

The aromatic carboxylic acid titanium compound may be added in an amount of from 0.001% by weight or more to 2% by weight or less, and preferably from 0.005% by weight or more to 1% by weight or less, based on the total polyester unit component. If the aromatic carboxylic acid titanium compound is added in an amount of less than 0.001% by weight, the toner having superior color reproducibility as aimed in the present invention may be not obtainable, and the rise of charging may be so slow as to make it difficult to keep charge quantity stable in various environments. In addition, it takes a long reaction time when the polar resin having a polyester unit is produced by polymerization, and also the resultant resin may have a broad molecular weight distribution to make it difficult to provide good fixing performance when made into the toner. If on the other hand the aromatic carboxylic acid titanium compound is added in an amount of greatly more than 2% by weight, it may affect charging performance of the toner to tend to cause great variations of charge quantity depending on changes in environments.

In the present invention, in addition to the aromatic carboxylic acid titanium compound, those shown below may also optionally be added as a promoter in producing the polar resin having at least a polyester unit.

Preferably usable are titanium compounds of different types, and compounds of elements such as beryllium, magnesium, calcium, strontium, barium, titanium, zirconium, manganese, cobalt, zinc, boron, aluminum, gallium, phosphorus and tin. As examples of compounds of these elements, preferably usable are fatty acid salts (such as acetates), carbonates, sulfates, nitrates, alkoxides, halides (such as chloride), acetylacetonato salts, and oxides, of the above elements. Also preferably usable are chelate compounds chelated with dicarboxylic acids, dialcohols, hydroxycarboxylic acids or the like, those formed by the reaction of diols with alkoxides, and those formed by the reaction of organomonocarboxylic acids with alkoxides.

Of these, those more preferably usable are acetates, carbonates, alkoxides, halides and acetylacetonato salts, of the above elements. In particular, preferably preferred are titanium alkoxides, titanium tetrachloride, zirconium alkoxides, magnesium carbonate, dicarboxylic acid titanium chelate compounds and magnesium acetate.

These promoters may be made present together with the aromatic carboxylic acid titanium compound in a reaction system, whereby the condensation reaction for the polyester resin can be made to proceed speedily. Thus, any of these may preferably be used. Also, the promoter may be used in an amount ranging from 0.01 to 200% by weight based on the weight of the aromatic carboxylic acid titanium compound.

Examples of preferable combination of the aromatic carboxylic acid with the titanium alkoxide which constitute the aromatic carboxylic acid titanium compound used in the present invention are enumerated in the following Table 1.

TABLE 1

| Exemplary Comp. No. | Aromatic carboxylic acid | Titanium compound |
|---|---|---|
| 1 | Isophthalic acid | Titanium tetramethoxide |
| 2 | Isophthalic acid | Titanium tetraethoxide |
| 3 | Isophthalic acid | Titanium tetra-iso-propoxide |
| 4 | Isophthalic acid | Titanium tetra-n-propoxide |
| 5 | Isophthalic acid | Titanium tetra-iso-butoxide |
| 6 | Isophthalic acid | Titanium tetra-n-butoxide |
| 7 | Isophthalic acid | Titanium tetra-tert-butoxide |
| 8 | Isophthalic acid | Tetra-n-butyl polytitanate (n = 3) |
| 9 | Terephthalic acid | Titanium tetramethoxide |
| 10 | Terephthalic acid | Titanium tetraethoxide |
| 11 | Terephthalic acid | Titanium tetra-iso-propoxide |
| 12 | Terephthalic acid | Titanium tetra-n-propoxide |
| 13 | Terephthalic acid | Titanium tetra-iso-butoxide |
| 14 | Terephthalic acid | Titanium tetra-n-butoxide |
| 15 | Terephthalic acid | Titanium tetra-tert-butoxide |
| 16 | Terephthalic acid | Tetra-n-butyl polytitanate (n = 3) |
| 17 | Trimellitic acid | Titanium tetramethoxide |
| 18 | Trimellitic acid | Titanium tetra-n-propoxide |
| 19 | Trimellitic acid | Titanium tetra-n-butoxide |
| 20 | m-Hydroxybenzoic acid | Titanium tetramethoxide |
| 21 | m-Hydroxybenzoic acid | Titanium tetra-n-propoxide |
| 22 | m-Hydroxybenzoic acid | Titanium tetra-n-butoxide |
| 23 | p-Hydroxybenzoic acid | Titanium tetramethoxide |
| 24 | p-Hydroxybenzoic acid | Titanium tetra-n-propoxide |
| 25 | p-Hydroxybenzoic acid | Titanium tetra-n-butoxide |

The polar resin to be contained in the toner of the present invention may be the resin having at least a polyester unit. The polyester unit contained in the whole resin may be in an amount of 3% by weight or more. This is preferable in order to bring out the effect of the present invention. If it is in an amount of less than 3% by weight, it is difficult to achieve especially good charging performance, in the effect to be brought by the present invention.

The polyester unit used in the present invention is, stated specifically, is a unit constituted of a dihydric or higher alcohol monomer component and an acid monomer component such as a dibasic or higher carboxylic acid, a dibasic or higher carboxylic anhydride or a dibasic or higher carboxylic ester. The toner of the present invention is characterized by containing as the polar resin a resin having a moiety formed by condensation polymerization of the alcohol monomer component and acid monomer component constituting the polyester unit as a part of raw materials.

The dihydric or higher alcohol monomer component constituting the polyester unit may specifically include the following.

As the dihydric alcohol monomer component constituting the polyester unit, it may specifically include bisphenol-A alkylene oxide addition products such as polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene(2.0)-2,2-bis(4 -hydroxyphenyl) propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As the trihydric or higher alcohol monomer component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

Of the acid monomer component constituting the polyester unit in the present invention, the dibasic or higher carboxylic acid monomer component may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group or alkenyl group having 6 to 18 carbon atoms, or anhydrides thereof; unsaturated dicarboxylic acids such as fumaric acid, maleic acid and citraconic acid, or anhydrides thereof. In particular, isophthalic acid may preferably be used in view of its highness of reactivity.

As other monomers, they may also include polyhydric alcohols such as glycerol, sorbitol, sorbitan and also oxyalkylene ethers of, e.g., novolak type phenol resin; and polybasic carboxylic acids such as trimellitic acid, pyromellitic acid and benzophenonetetracarboxylic acid, or anhydrides thereof.

Of the above monomer components, in particular, a resin having a polyester unit obtained by condensation polymerization using as a dihydric alcohol monomer component a bisphenol derivative represented by the following Formula (4) and as an acid monomer component a carboxylic acid component composed of a dibasic or higher carboxylic acid or an acid anhydride thereof or a lower alkyl ester thereof (e.g., fumaric acid, maleic acid, maleic anhydride, phthalic acid, terephthalic acid, trimellitic acid or pyromellitic acid) is preferred as affording a good charging performance.

(1)

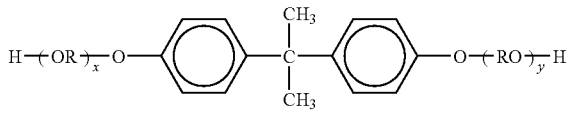

wherein R represents an ethylene group or a propylene group, x and y are each an integer of 1 or more, and an average value of x+y is 2 to 10.

The polar resin used in the present invention may contain a resin component other than the above polyester unit. Such a resin component may include resins used as binder resins for toners, described later. More preferably usable are styrene copolymers which are copolymers of styrene with other vinyl monomers. The incorporation of such a copolymer in the polar resin enables enhancement of compatibility of the polar resin with the binder resin and improvement in mechanical strength of the toner itself, especially when the binder resin is a styrene-acrylic resin and the toner base particles are produced by suspension polymerization.

The polar resin in the present invention may be obtained by polymerizing the monomers constituting the polyester unit and optionally a monomer(s) constituting other resin component(s) (in the case when incorporated with the styrene copolymer component, styrene and other vinyl monomer), in the presence of the aromatic carboxylic acid titanium compound.

In the present invention, the aromatic carboxylic acid titanium compound is used as a catalyst in producing the resin having a polyester unit, and hence it follows that this aromatic carboxylic acid titanium compound is always present in the resin having been produced. Its content is considered substantially equal to the amount in which the aromatic carboxylic acid titanium compound is used based on the weight of the polyester unit. Incidentally, the presence of the aromatic carboxylic acid titanium compound in the resin may be proved by ascertaining the presence of titanium atoms coming from the aromatic carboxylic acid titanium compound, by a known method such as fluorescent X-ray analysis.

The polar resin used in the present invention has an acid value of from 3 to 35 mgKOH/g, where the effect of the present invention can be brought out. The polar resin may preferably have an acid value of from 5 to 30 mgKOH/g, and more preferably from 7 to 20 mgKOH/g. If it has an acid value of less than 3 mgKOH/g, the charging of the toner may rise slowly and also the saturation charge quantity may lower, to cause image defects such as fog and spots around line images. If on the other hand it has an acid value of more than 35 mgKOH/g, the charge-up may seriously occur especially in an environment of low humidity to cause difficulties such as a decrease in image density and spots around characters. Incidentally, the acid value of the polar resin may be adjusted by appropriately selecting temperature and time in carrying out the polymerization. The acid value of the polar resin comes high when the reaction is carried out at a high temperature for a short time, and comes low when the reaction is carried out at a low temperature for a long time.

The polar resin used in the present invention may also have a hydroxyl value (mgKOH/g), which may depend on the balance to the acid value, of from 5 or more to 40 or less, where the effect of the present invention can be brought out. It may preferably have a hydroxyl value of from 10 or more to 35 or less, and more preferably from 15 or more to 30 or less.

If the polar resin used in the present invention has a hydroxyl value of less than 5, the charging of the toner may continue to rise slowly, and may cause image defects such as fog and spots around line images and variations in tinges of images. If on the other hand it has a hydroxyl value of more than 40, the charge quantity may seriously lower especially in an environment of high humidity to cause image defects such as fog and spots around line images.

The toner of the present invention has, in its endothermic curve obtained by measurement by differential thermal analysis (DSC, differential scanning calorimetry), may have a peak temperature of a maximum endothermic peak of from 50 to 120° C., more preferably from 55 to 100° C., and still more preferably from 60 to 75° C., in a temperature range of from 30 to 200° C.

This maximum endothermic peak depends on the type of the release agent in the toner base particles. Inasmuch as the peak value is within the above range, both the fixing performance and the developing performance can be achieved. The use of two or more kinds of release agents is also a method preferably used to achieve the present invention. It, however, is important to use a release agent in which the temperature showing the maximum peak is within the above range.

If the toner has the maximum endothermic peak in a temperature range of less than 50° C., the toner may have poor storage stability and may have poor developing performance to cause fog and spots around line images. On the other hand, if the toner has the maximum endothermic peak in a temperature range of more than 120° C., the plastic effect the release agent makes on the toner is so small that the toner may have a somewhat inferior low-temperature fixing performance. Also, if the temperature of a fixing assembly has lowered during continuous paper feed (image reproduction), the release agent can not well lie between its fixing member and the toner to tend to cause the phenomenon that the transfer sheet winds around the fixing member (what is called fixing wind-around).

The maximum endothermic peak may also preferably have a half width of 15° C. or less, and more preferably 7° C. or less. In a case in which it has a half width of more than 15° C., the release agent does not have a high crystallizability. Hence, the release agent has a low hardness, and may accelerate contamination of the photosensitive member and the fixing members due to the release agent.

The release agent to be contained in the toner base particles may preferably be contained in an amount of from 2.5 to 25 parts by weight, more preferably from 4 to 20 parts by weight, and still more preferably from 6 to 18 parts by weight, in total, based on 100 parts by weight of the toner base particles. If the release agent is contained in an amount of less than 2.5 parts by weight in total, its release effect can not well be brought out at the time of fixing, so that not only it may be difficult to satisfy paper delivery and placement performance of transfer sheets when the fixing member comes to have a low temperature, but also the wind-around of transfer sheets tends to occur. On the other hand, if it is in an amount of more than 25 parts by weight, the release agent may seriously contaminate the charge-providing members and photosensitive member to cause difficulties such as fog and melt adhesion.

In the present invention, as the release agent to be contained in the toner base particles, commonly available agents used conventionally in toners may be used, and there are no particular limitations. It may include polymethylene waxes such as paraffin wax, polyolefin wax, microcrystalline wax and Fischer-Tropsch wax, amide waxes, higher fatty acids, long-chain alcohols, ketone waxes, ester waxes, and derivatives thereof such as graft compounds or block compounds of these, which may optionally be subjected to distillation. Of these, preferably usable are waxes having a maximum endothermic peak in the above temperature range.

Of the above waxes, the toner base particles may particularly preferably contain any of ester waxes represented by the following general formulas.

Ester Wax A

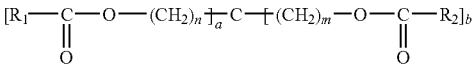

wherein a and b each represent an integer of 0 to 4, provided that a+b is 4; R1 and R2 each represent an organic group having 1 to 40 carbon atoms, provided that a difference in the number of carbon atoms between R1 and R2 is 3 or more; and n and m each represent an integer of 0 to 40, provided that n and m are not 0 at the same time.

Ester Wax B

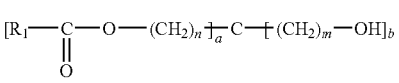

wherein a and b each represent an integer of 0 to 4, provided that a+b is 4; R1 represents an organic group having 1 to 40 carbon atoms; and n and m each represent an integer of 0 to 40, provided that n and m are not 0 at the same time.

Ester Wax C

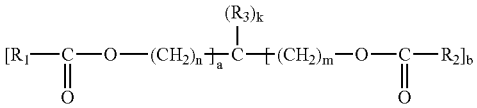

wherein a and b each represent an integer of 0 to 3, provided that a+b is 3 or less; R1 and R2 each represent an organic group having 1 to 40 carbon atoms, provided that a difference in the number of carbon atoms between R1 and R2 is 3 or more; R3 represents an organic group having 1 or more carbon atoms; k represents an integer of 1 to 3, and satisfies a+b+k=4; and n and m each represent an integer of 0 to 40, provided that n and m are not 0 at the same time.

As molecular weight of the release agent, one having commonly available molecular weight is available. It may preferably have a weight-average molecular weight (Mw) of from 300 to 1,500, and more preferably from 400 to 1,250. If the release agent has a weight-average molecular weight of less than 300, it tends to come bare to the toner particle surfaces to tend to contaminate the photosensitive member, charging roller and charge-providing members and tend to cause image defects such as fog and melt adhesion. On the other hand, if it has a weight-average molecular weight of more than 1,500, it may cause difficulties such as serious fixing wind-around, poor low-temperature fixing performance, poor OHT transparency and so forth.

The release agent may also have a ratio of weight-average molecular weight to number-average molecular weight, Mw/Mn, of 1.5 or less. This is preferable because the release agent can have a sharper maximum endothermic peak in the DSC endothermic curve, so that the mechanical strength of the toner particles at room temperature is improved, showing sharp melt characteristics at the time of fixing.

The release agent may preferably have a needle penetration of 15 degrees or less. If it has a needle penetration of more than 15 degrees, like the case in which the half width of the endothermic peak of the release agent is more than 15 degrees, it tends to contaminate the photosensitive member, charging roller and charge-providing members and tends to cause image defects such as fog and melt adhesion.

As the release agent in the present invention, a release agent having a low crystallizability may further preferably be used when used in color toners. In particular, the incorporation of at least the ester wax in the toner base particles gives a good form because of its appropriate compatibility with the polyester resin. This not only enables improvement in color mixing properties and transparency in color toners, but also enables resolution of the above faulty paper delivery and placement because the release agent can be made present in the vicinity of toner base particle surfaces at a level that does not inhibit developing performance.

As the colorant to be used in the toner of the present invention, any of yellow colorants, magenta colorants and cyan colorants shown below may be used. As a black colorant, carbon black or a magnetic material may be used as a chief colorant. It is one of favorable forms that the following coloring matters are mixed to control tinges and toner resistance.

As yellow colorants, compounds typified by condensation azo compounds, isoindolinone compounds, anthraquinone compounds, azo metal complex methine compounds and allylamide compounds are used, which are of pigment types. Stated specifically, C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199 are preferably used. As dye types, the yellow colorant may include, e.g., C.I. Solvent Yellow 33, 56, 79, 82, 93, 112, 162 and 163; and C.I. Disperse Yellow 42, 64, 201 and 211. A yellow toner is obtainable by incorporating any of these yellow colorants into the toner.

As magenta colorants, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254 and 269, and C.I. Pigment Violet 19 are particularly preferred. A magenta toner is obtainable by incorporating any of these magenta colorants into the toner.

As cyan colorants, phthalocyanine compounds and derivatives thereof, anthraquinone compounds and basic dye lake compounds may be used. Stated specifically, C.I. Pigment Blue 1, 7, 15:1, 15:2, 15:3, 15:4, 60, 62 and 66 may particularly preferably be used. A cyan toner is obtainable by incorporating any of these cyan colorants into the toner.

Full-color toners for forming full-color images are obtainable by using the above black toner, yellow toner, magenta toner and cyan toner in combination.

Any of these colorants may be used alone, in the form of a mixture, or in the state of a solid solution. In the present invention, the colorants are selected taking account of hue angle, chroma, brightness, light resistance, OHT transparency and dispersibility in toner base particles. The colorant may preferably be added in an amount of from 1 to 20 parts by weight based on 100 parts by weight of the binder resin, which is shown below.

In the toner of the present invention, in addition to the above polar resin, a binder resin may be contained in the toner base particles. The binder resin used in the present invention may include polystyrene; homopolymers of styrene derivatives such as poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; acrylic resins, methacrylic resins, polyvinyl acetate, silicone resins, polyester resins, polyamide resins, furan resins, epoxy resins, and xylene resins. The polyester resin constituted of the alcohol monomer component and the acid monomer component as described previously may also be used as the binder resin of the toner in addition to the polar resin. Any of these resins may be used alone or in the form of a mixture.

As the main component of the binder resin, a styrene copolymer which is a copolymer of polyester resin and/or styrene and other vinyl monomer is preferred in view of developing performance and fixing performance of the toner.

Comonomers copolymerizable with styrene monomers in the styrene copolymers may include monocarboxylic acids having a double bond and derivatives thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof, such as maleic acid, butyl maleate, methyl maleate and dimethyl maleate; vinyl esters such as vinyl chloride, vinyl acetate and vinyl benzoate; olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more types.

The above styrene copolymer may be one having been cross-linked with a cross-linking agent such as divinylbenzene. This is preferable in order to broaden the fixing temperature region and improve anti-offset properties.

In the toner of the present invention, a charge control agent may be contained in the toner base particles. This is a form preferable for keeping the charging performance of the toner stably. As charge control agents capable of controlling the toner to be negatively chargeable, they include the following substances.

For example, organic metal complexes or chelate compounds are effective, which include monoazo metal compounds, acetylacetone metal compounds, aromatic hydroxycarboxylic acid metal compounds, aromatic dicarboxylic acid metal compounds, hydroxycarboxylic acid metal compounds, and dicarboxylic acid metal compounds. Besides, they include aromatic hydrooxycarboxylic acids, aromatic mono- and polycarboxylic acids, and metal salts, anhydrides or esters thereof, and phenol derivatives such as bisphenol. They may further include urea derivatives, metal-containing salicylic acid compounds, metal-containing naphthoic acid compounds, boron compounds, quaternary ammonium salts, carixarene, and resin type charge control agents.

Charge control agents capable of controlling the toner to be positively chargeable include the following substances.

They may include Nigrosine and Nigrosine-modified products, modified with a fatty acid metal salt; guanidine compounds; imidazole compounds; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; and resin type charge control agents. Any of these may be used alone or in combination of two or more kinds.

Of these, in order to sufficiently bring out the effect of the present invention, salicylic acid metal compounds are preferred. In particular, as their metal, aluminum or zirconium is preferred. As the most preferred control agent, a salicylic acid aluminum compound is preferred.

Any of the charge control agents may be used in an amount of from 0.01 to 20 parts by weight, and preferably from 0.5 to 10 parts by weight, based on 100 parts by weight of the binder resin.

In the toner of the present invention, it is also a preferable form that a lubricant is further incorporated into toner base particles in order to lessen contamination of members. As the lubricant, it may include fluorine resin powders such as polyvinylidene fluoride and polytetrafluoroethylene, and fatty acid metal salts such as zinc stearate and calcium stearate. Of these, polyvinylidene fluoride is preferably used.

The toner base particles of the present invention may be those granulated in an aqueous system by a process such as suspension polymerization, emulsion polymerization or suspension granulation. By the use of such toner base particles, the effect of the present invention can be brought out. In the case of a toner produced by commonly available pulverization, the addition of the release agent to toner base particles in a large quantity involves a very high degree of technical difficulty in view of developing performance. Producing toner base particles by granulation in an aqueous system makes it able to obtain toner base particles in which the release agent can be made not present on particle surfaces even when it is used in a large quantity. In particular, producing them by the suspension polymerization is one of the most preferred forms in view of enclosure or encapsulation of the release agent in the toner base particles and in view of production cost, e.g., use of no solvent.

A process for producing the toner base particles by polymerization is described taking the case of suspension polymerization, which is most preferably used among production processes for the toner base particles produced in an aqueous system in the present invention. The binder resin constituents polymerizable monomer(s) and polar resin, the colorant and the release agent and further optionally other additives and so forth are subjected to uniform dissolution or dispersion by means of a dispersion machine such as a homogenizer, a ball mill, a colloid mill or an ultrasonic dispersion machine to obtain a polymerizable monomer composition. Next, this polymerizable monomer composition is suspended in an aqueous medium containing a dispersion stabilizer to effect granulation. A polymerization initiator may be added at the same time when other additives are added to the polymerizable monomer, or may be mixed immediately before the polymerizable monomer composition is suspended in the aqueous medium. A polymerization initiator having been dissolved in the polymerizable monomer or in a solvent may also be added immediately after the granulation or before the polymerization reaction is started. The polymerization reaction of the polymerizable monomer composition having been granulated is carried out, and the polymer particles obtained are separated from the aqueous medium by a known method to obtain the toner base particles.

As the polymerizable monomer used in producing the toner base particles in the present invention, a radical-polymerizable, vinyl type polymerizable monomer is used. As the vinyl type polymerizable monomer, a monofunctional polymerizable monomer or a polyfunctional polymerizable monomer may be used. The monofunctional polymerizable monomer may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomer may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy-diethoxy)phenyl]propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy-diethoxy)phenyl]propane, 2,2'-bis[4-(methacryloxy-polyethoxy)phenyl]propane, trimethyrolpropane trimethacrylate, tetramethyrolmethane tetramethacrylate, divinyl benzene, divinyl naphthalene, and divinyl ether.

In the present invention, the above monofunctional polymerizable monomer may be used alone or in combination of two or more types, or the above monofunctional polymerizable monomer and polyfunctional polymerizable monomer may be used in combination. The polyfunctional polymerizable monomer may also be used as a cross-linking agent.

As the polymerization initiator used in polymerizing the polymerizable monomer, an oil-soluble initiator and/or a water-soluble initiator may be used. For example, the oil-soluble initiator may include azo compounds such as 2,2'-azobisisobutyronitrile), 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide type initiators such as acetylcyclohexylsulfonyl peroxide, diisopropyl peroxycarbonate, decanonyl peroxide, lauroyl peroxide, stearoyl peroxide, propionyl peroxide, acetyl peroxide, t-butylperoxy-2-ethylhexanoate, benzoyl peroxide, t-butylperoxyisobutyrate, cyclohexanone peroxide, methyl ethyl ketone peroxide, dicumyl peroxide, t-butyl hydroperoxide, di-t-butyl peroxide, and cumene hydroperoxide.

The water-soluble initiator may include ammonium persulfate, potassium persulfate, 2,2'-azobis(N,N'-diemthyleneisobutyloamidine) hydrochloride, 2,2'-azobis(2-aminodipropane) hydrochloride, azobis(isobutyloamidine) hydrochloride, sodium 2,2'-azobisisobutylonitrile sulfonate, and ferrous sulfate or hydrogen peroxide.

In the present invention, a chain transfer agent, a polymerization inhibitor and the like may further be added in order to control the degree of polymerizing the polymerizable monomer.

As the cross-linking agent used in the present invention, a compound having at least two polymerizable double bonds may be used besides the above polyfunctional polymerizable monomer. For example, it may include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture of two or more types.

The toner of the present invention has a weight-average particle diameter of from 4.0 μm to 10.0 μm, where the effect of the present invention can be brought out. It may preferably have a weight-average particle diameter of from 5.0 μm to 9.0 μm, and more preferably from 6.0 μm to 7.5 μm. If the toner has a weight-average particle diameter of less than 4.0 μm, such a toner tends to cause charge-up, which tends to cause difficulties such as fog, spots around line images and a decrease in image density. It also tends to contaminate charge-providing members during long-term image reproduction to make it difficult to provide stable images with high image quality. It may further not only make it difficult to perform cleaning for removing the transfer residual toner which remains on the photosensitive member, but also tends to cause its melt adhesion and so forth. If on the other hand it has a weight-average particle diameter of more than 10.0 μm, such a toner may make fine-line reproducibility of fine characters or the like poor, or may cause spots around line images seriously, and can not provide images with high image quality which are desired nowadays.

The toner particles may also preferably have a shape that is close to a spherical shape. Stated specifically, the toner particles may preferably have a shape factor SF-1 in the range of from 100 to 150, more preferably from 100 to 140, and still more preferably from 100 to 130. They may also preferably have a shape factor SF-2 in the range of from 100 to 140, more preferably from 100 to 130, and still more preferably from 100 to 120. Toner particles having a shape factor SF-1 of more than 150 or SF-2 of more than 140 are undesirable because they tend to cause a lowering of transfer efficiency of the toner, an increase in re-transfer of the toner and an increase in wear depth of the latent image bearing member surface.

In addition to the above toner base particles, the toner of the present invention contains an inorganic fine powder in order to improve charging stability, developing performance, fluidity, keeping from adhesion to members, and running performance. In particular, a fine powder of silica, alumina, titania or the like may preferably be used as the inorganic fine powder in view of the impartment of fluidity to the toner and the stability of charging. The present inventors have discovered an unexpected effect in the toner obtained using the catalyst, the aromatic carboxylic acid titanium compound. The reason therefor is uncertain, but a result has been obtained such that high image quality can be provided stably over a long period of time presumably because, in the toner obtained by adding the above inorganic fine powder to the toner base particles containing the polar resin obtained using the aromatic carboxylic acid titanium compound catalyst, the inorganic fine powder stands adsorbed on the toner base particles in so high a state of adsorption that, it may come liberated from the toner particles only in a small proportion even in continuous printing. The highness of the state of adsorption is presumed to be due to the highness of the charging speed and saturation charge quantity the polar resin can provide, or the mutual action between the surface hydroxyl groups the inorganic fine powder has and any catalyst residue of the aromatic carboxylic acid titanium compound in the polar resin.

It is also a good form that any of these inorganic fine powders are used in combination of two or more types. In particular, it is most preferable for the toner to contain titanium oxide in view of an affinity for the aromatic carboxylic acid titanium compound.

The inorganic fine powder to be added to the toner of the present invention may preferably be added in an amount of from 0.5 to 4.5 parts by weight, and more preferably from 0.8 to 3.5 parts by weight, in total, based on 100 parts by weight of the toner base particles. If the inorganic fine powder is added in an amount of less than 0.5 part by weight in total, the toner may have insufficient fluidity to cause fog seriously with a lowering of charging performance and cause toner scattering, making it impossible to bring out the effect of the present invention sufficiently. On the other hand, if it is added in an amount of more than 4.5 part by weight in total, it may cause difficulties such as toner scattering, a lowering of charging performance, melt adhesion to photosensitive member, and a decrease in toner charge quantity due to contamination of charge-providing members.

The silica, alumina and/or titania preferably added as the inorganic fine powder may have a specific surface area in the range of from 20 to 400 m2/g, preferably from 35 to 300 m2/g, and more preferably from 50 to 230 m2/g, as measured by the BET nitrogen adsorption method. If the inorganic fine powder has a specific surface area of less than 20 m2/g, it is difficult to secure sufficient fluidity of the toner particles. On the other hand, if it has a specific surface area of more than 400 m2/g, the state of presence of the inorganic fine powder adhering to the toner base particles tends to change during continuous paper feed (image reproduction) to cause an increase in the degree of agglomeration of the toner particles. Also, the value of TB−TA specified in the present invention tends to come larger than 60, tending to cause difficulties such as fog, spots around line images, and tinge variations in color images. Incidentally, what concerns the value of TB−TA is described later.

For the purpose of improving hydrophobicity, charging performance and also transfer performance, the inorganic fine powder as the fluidity-providing agent may preferably be one having been treated with one, two or more of treating agents selected from a silicone varnish, a modified silicone varnish of various types, a silicone oil, a modified silicone oil of various types, a silane coupling agent and other organosilicon compounds.

In the present invention, in addition to the inorganic fine powder, an abrasive may also preferably be used in the state it has externally been added to the toner base particles. Such an external additive may include metal oxides such as cerium oxide, aluminum oxide, magnesium oxide and chromium oxide; nitrides such as silicon nitride; carbides such as silicon carbide; and metal salts such as strontium titanate, calcium sulfate, barium sulfate and calcium carbonate. Of these, strontium titanate is preferably used as the lubricant.

In the present invention, other inorganic fine particles that may be added to the toner base particles as an external additive may include a caking-preventive agent, a conductivity-providing agent such as zinc oxide, antimony oxide or tin oxide, and a development performance improver. Any of these additives may preferably be added in an amount of from 0.01 to 2 parts by weight, and more preferably from 0.1 to 1 part by weight, based on 100 parts by weight of the toner.

The above inorganic fine powder, abrasive and other external additives may be mixed with the toner base particles by any known method. Thus, the toner of the present invention can be obtained.

The toner base particles used in the present invention may have, in their water/methanol wettability test, a methanol concentration TA (% by weight) of from 10 or more to 70 or less, preferably from 15 or more to 60 or less, and more preferably from 20 or more to 50 or less, at the time the transmittance shows the value of 50% of the initial value.

Also, the toner of the present invention may have, in its water/methanol wettability test, a methanol concentration TB (% by weight) of from 30 or more to 90 or less, preferably from 35 or more to 80 or less, and more preferably from 40 or more to 70 or less, at the time the transmittance shows the value of 50% of the initial value.

A case in which the TA is less than 10 or the TB is less than 30 shows that the toner base particles or toner have or has a high affinity for water to cause a lowering of charging performance in an environment of high humidity. This phenomenon tends to occur especially at the latter part of extensive image printing where external additives have deteriorated.

On the other hand, in a case in which the TA is larger than 70 because of exposure of the release agent to toner base particle surfaces or modification of the release agent or a case in which the TB is larger than 90 because of high hydrophobicity of the inorganic fine powder and/or its addition in a large quantity, the toner base particles or toner have or has so excessively high water repellency as to bring about difficulties such that the toner coat layer on the developing sleeve becomes non-uniform because of the phenomenon of charge-up, that the image density decreases and that the toner adheres to the charge-providing members and photosensitive member. The addition of the inorganic fine powder in a large quantity is also not preferable because it may make fixing performance poor and may contaminate the photosensitive member, the photosensitive member charging member, the charge-providing members in the developing step, and so forth.

The difference in the the water/methanol wettability test value of the toner and toner base particles, i.e., the value of TB−TA (TB minus TA) may preferably be from 0 or more to 60 or less. The value of TB−TA may more preferably be from 5 or more to 45 or less, and still more preferably from 10 or more to 30 or less. Incidentally, the value of TB−TA may be controlled within the above range by appropriately selecting the types, degrees of hydrophobic treatment and amounts of the inorganic fine powder to be externally added to the toner base particles and those of other additives to be optionally used.

Where the toner base particles are easily wettable by water, it is necessary to control the wettability-by-water of the toner by adjusting the type and amount of the additives such as the inorganic fine powder. If, however, the wettability of the toner is controlled so much in excess, i.e., if the value of TB−TA is larger than 60, the toner may become lacking in running stability even though images without any problem are obtained at the initial stage. Stated specifically, such a toner causes difficulties such as fog and spots around line images at the latter part of running. Its developing performance also varies greatly, so that it becomes difficult to control the toner laid-on level on paper. Especially in color image formation, a problem tends to arise such that, when like images are reproduced, tinges of the images differ too much between images at the initial stage and images after continuous paper feed (image reproduction). On the other hand, where an inorganic fine powder having a high hydrophilicity is added, there may be a case in which the value of TB−TA is smaller than 0. This causes a lowering of charging performance in an environment of high humidity to bring about image defects such as fog and spots around line images.

As the toner of the present invention, one having molecular weight distribution commonly used is available. In view of how to well bring out the effect of the present invention and in view of fixing performance, it may preferably have a number-average molecular weight (Mn) of from 2,000 to 50,000, more preferably from 5,000 to 40,000, and still more preferably from 10,000 to 25,000. If it has a number-average molecular weight (Mn) of less than 2,000, the toner particles themselves may have so low elasticity as to tend to cause high-temperature offset. On the other hand, if it has a number-average molecular weight (Mn) of more than 50,000, the toner particles themselves tend to have high elasticity to make it unable for the release agent to exude favorably to the fixing surface at the time of fixing, tending to cause the wind-around of transfer sheets at the time of low-temperature fixing.

The toner of the present invention may also preferably have a weight-average molecular weight (Mw) of from 10,000 to 1,500,000, more preferably from 50,000 to 1,000,000, and still more preferably from 100,000 to 750,000. If it has a weight-average molecular weight (Mw) of less than 10,000, the toner particles themselves may have so low elasticity as to tend to cause high-temperature offset. On the other hand, if it has a weight-average molecular weight (Mw) of more than 1,5000,000, the toner particles themselves tend to have high elasticity to make it unable for the release agent to exude favorably to the fixing surface at the time of fixing, tending to cause the wind-around of transfer sheets at the time of low-temperature fixing. An extremely low fixing gloss may also result.

The molecular weight distribution of the toner may be controlled within the above ranges by appropriately selecting the reaction temperature in producing the resin or polymerization toner and the types and amounts of the polymerization initiator, cross-linking agent, chain transfer agent and release agent.

As the toner of the present invention, one having commonly available melt viscosity is available. In order to make the toner of the present invention achieve an appropriate medium gloss, the toner may preferably have a melt index (MI) value at 125° C. of from 1 to 50, and more preferably from 3 to 40. If it has an MI value of less than 1, fixed images have too low gloss. If it has an MI value of more than 50, glaring fixed images with a high gloss are formed.

As the toner of the present invention, one having commonly available glass transition temperature (Tg) is available. In order to achieve both storage stability and fixing performance, it may preferably have Tg of from 50 to 75° C., more preferably from 52 to 70° C., and still more preferably from 54 to 65° C. If it has a Tg of less than 50° C., the toner may have a poor storage stability. On the other hand, if it has a Tg of more than 75° C., the toner may have a poor low-temperature fixing performance.

It is also a preferable form of the present invention that the toner of the present invention is blended with a carrier so as to be used as a two-component developer. The carrier used in the present invention may preferably be a carrier formed of core material particles which are composed of a magnetic material or a mixture of a magnetic material and a non-magnetic material and have been coated with a resin and/or a silane compound. Here, a carrier making use of magnetic-material dispersion type resin particles as the core material particles is preferred in view of image characteristics and long-term durability. In particular, where the carrier is used in blend with a negatively chargeable toner, it is preferable for the core material particles to be covered with coat layers containing an aminosilane compound. Incidentally, the fine-particle toner of 10.0 μm or less in weight-average particle diameter as in the present invention tends to contaminate carrier particle surfaces, and hence it is preferable to use the carrier formed of core material particles surface-coated with a resin, also in order to prevent this. The carrier surface-coated with a resin has an advantage also in respect of durability when used in high-speed machines, and is superior also in respect of the controlling of electric charges of the toner.

As the resin for forming the coat layers with which the core material particle surfaces are covered, preferably usable are, e.g., a fluorine resin, a silicone resin and a silicone compound.

As the fluorine resin that forms the coat layers of the carrier, preferably usable are, e.g., halofluoropolymers such as polyvinyl fluoride, polyvinylidene fluoride, polytrifluoroethylene and polytrifluorochloroethylene; polytetrafluoroethylene, polyperfluoropropylene, a copolymer of vinylidene fluoride and an acrylic monomer, a copolymer of vinylidene fluoride and trifluorochloroethylene, a copolymer of tetrafluoroethylene and hexafluoropropylene, a copolymer of vinyl fluoride and vinylidene fluoride, a copolymer of vinylidene fluoride and tetrafluoroethylene, a copolymer of vinylidene fluoride and hexafluoroethylene, and fluoroterpolymers such as a terpolymer of tetrafluoroethylene, vinylidene fluoride and a non-fluorinated monomer. The above fluorine resin may preferably have a weight-average molecular weight of from 50,000 to 400,000, and more preferably from 100,000 to 250,000.

As the resin that forms the coat layers of the carrier, the above fluorine resins may each be used alone, or may be used in the form of a blend of any of these. A blend of any of the above fluorine resins with a non-fluorine polymer may still also be used. As the non-fluorine polymer, any of homopolymers or copolymers of monomers as shown below may be used.

They may include vinyl monomers having one vinyl group in the molecule, as exemplified by styrene, styrene derivatives such as α-methylstyrene, p-methylstyrene, p-t-butyl-styrene and p-chlorostyrene, methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, undecyl methacrylate, dodecyl methacrylate, glycidyl methacrylate, methoxyethyl methacrylate, propoxyethyl methacrylate, butoxyethyl methacrylate, methoxydiethylene glycol methacrylate, ethoxydiethylene glycol methacrylate, methoxyethylene glycol methacrylate, butoxytriethylene glycol methacrylate, methoxydipropylene glycol methacrylate, phenoxyethyl methacrylate, phenoxydiethylene glycol methacrylate, phenoxytetraethylene glycol methacrylate, benzyl methacrylate, cyclohexyl methacrylate, tetrahydrofurfuryl methacrylate, dicyclopentenyl methacrylate, dicyclopentenyloxyethyl methacrylate, N-vinyl-2-pyrrolidone methacrylate, methacrylonitrile, methacrylamide, N-methylolmethacrylamide, ethylmorpholine methacrylate, diacetoneacrylamide, methyl acrylate, ethyl acrylate, propyl acrylate, butyl acrylate, pentyl acrylate, hexyl acrylate, heptyl acrylate, octyl acrylate, nonyl acrylate, decyl acrylate, undecyl acrylate, dodecyl acrylate, glycidyl acrylate, methoxyethyl acrylate, propoxyethyl acrylate, butoxyethyl acrylate, methoxydiethylene glycol acrylate, ethoxydiethylene glycol acrylate, methoxyethylene glycol acrylate, butoxytriethylene glycol acrylate, methoxydipropylene glycol acrylate, phenoxyethyl acrylate, phenoxydiethylene glycol acrylate, phenoxytetraethylene glycol acrylate, benzyl acrylate, cyclohexyl acrylate, tetrahydrofurfuryl acrylate, dicyclopentenyl acrylate, dicyclopentenyloxyethyl acrylate, N-vinyl-2-pyrrolidone acrylate, glydidyl acrylate, acrylonitrile, acrylamide, N-methylolacrylamide, deacetoneacrylamide, ethylmorpholine acrylate and vinylpyridine; vinyl monomers having two or more vinyl groups in the molecule as exemplified by divinylbenzene, reaction products of glycol with methacrylic acid or acrylic acid, as exemplified by ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentyl glycol dimethacrylate, diethylene glycol dimethacrylate, triethylene glycol dimethacrylate, polyethylene glycol dimethacrylate, tripropylene glycol dimethacrylate, hydroxypivalic acid neopentyl glycol ester dimethacrylate, trimethylolethane trimethacrylate, trimethylolpropane trimethacrylate, pentaerythritol tetramethacrylate, trismethacryloxyethyl phosphate, tris(methacryloylxyethyl) isocyanurate, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, polyethylene glycol diacrylate, tripropylene diacrylate, hydroxypivalic acid neopentyl glycol diacrylate, trimethylolethane triacrylate, trimethylolpropane triacrylate, pentaerythritol tetraacrylate, trisacryloxyethyl phosphate, tris(methacryloylxyethyl) isocyanurate, a half-esterification product of glycidyl methacrylate with methacrylic acid or acrylic acid, a half-esterification product of bisphenol type epoxy resin with methacrylic acid or acrylic acid, and a half-esterification product of glycidyl acrylate with methacrylic acid or acrylic acid; and vinyl monomers having a hydroxyl group as exemplified by 2-hydroxyethyl acrylate, 2-hydroxypropyl acrylate, hydroxybutyl acrylate, 2-hydroxy-3-phenyloxypropyl acrylate, 2-hydroxyethyl methacrylate, 2-hydroxypropyl methacrylate, hydroxybutyl methacrylate, and 2-hydroxy-3-phenyloxypropyl methacrylate.

These monomers are copolymerized by known processes such as suspension polymerization, emulsion polymerization and solution polymerization. The resulting copolymers may preferably be those having a weight-average molecular weight of from 10,000 to 70,000. The copolymers may also be subjected to melamine aldehyde cross-linking or isocyanate cross-linking. Also, the fluorine resin and other polymer may preferably be blended in a ratio of 20 to 80:80 to 20, and particularly 40 to 60:60 to 40, in weight ratio.

As the silicone resin or silicone compound used to form the coat layers of the carrier, polysiloxanes such as dimethyl polysiloxane and phenylmethyl polysiloxane are used. It is also possible to use modified silicone resins such as alkyd-modified silicone, epoxy-modified silicone, polyester-modified silicone, urethane-modified silicone and acryl-modified silicone. As the form of modification, it may include block copolymers, graft copolymers, and comb-type graft copolymers.

When any of these are applied to the surfaces of core material particles to form the coat layers, employed is a method in which the fluorine resin, silicone resin or silicone compound is previously converted into a varnish such as a solid methyl silicone varnish, a solid phenyl silicone varnish, a solid methylphenyl silicone varnish, a solid ethyl silicone varnish and various types of modified silicone varnishes and magnetic particles are dispersed therein, or a method in which the varnish is sprayed on the magnetic particles. The treatment (coating) with the above resin for coat layers may preferably be in an amount of from 0.1 to 30% by weight, and preferably from 0.5 to 20% by weight, based on the weight of the core material particles, in view of film-forming properties or durability of the coating material.

The carrier used in the present invention may have a volume-average particle diameter of from 25 to 55 μm, and preferably from 30 to 50 μm. This is preferable in the matching with the small-particle-diameter toner. If the carrier has a volume-average particle diameter of less than 25 μm, the carrier tends to participate in development together with the toner on the latent image bearing member, tending to scratch the latent image bearing member or a cleaning blade. If on the other hand the carrier has a volume-average particle diameter of more than 55 μm, the toner-holding ability of the carrier may lower, tending to cause non-uniform solid images, toner scattering, fog and so forth.

In the present invention, the carrier and the toner may be so blended as to be in a toner concentration of from 3 to 12% by weight, and more preferably from 5 to 10% by weight. This is preferable in order to well satisfy image density and image characteristics.

In the present invention, the carrier may preferably have a resistivity of from 1×108 to 1×1016 Ωcm, and more preferably from 1×109 to 1×1015 Ωcm. If the carrier has a resistivity of less than 1×108 Ωcm, the carrier tends to adhere to the latent image bearing member surface, or may scratch the latent image bearing member or be directly transferred onto paper, to tend to cause image defects. Also, the development bias may leak through the carrier to disorder the electrostatic latent images formed on the latent image bearing member.

If on the other hand the carrier has a resistivity of more than 1×1016 Ωcm, strongly edge-emphasized images tend to be formed. Also, the electric charges on the carrier particle surfaces may leak with difficulty, and hence such a carrier may cause a lowering of image density due to the phenomenon of charge-up, or may become unable to provide charge to toners supplied anew, to cause fog and spots around line images. Still also, such a carrier may charge substances such as inner walls of the developing assembly, so that the charge quantity of toners that is to be originally given may become non-uniform. Besides, any external additives may electrostatically adhere to the carrier to tend to cause image defects.

As magnetic properties, the carriers may have a low magnetic force such that the intensity of magnetization at 1,000/4π (kA/m) is from 30 to 60 Am2/kg, and more preferably from 35 to 55 Am2/kg. If the carrier has an intensity of magnetization of more than 60 Am2/kg, the developer may strongly be compressed at the part of the developer layer thickness control blade on the developer carrying member to cause carrier-spent due to the release agent even when the toner of the present invention is used. This may cause faulty toner coating because of the carrier transport performance on sleeve that has become poor, and may cause fog, toner scattering and so forth at the latter part of running because of a lowering of charge-providing performance to toner. Also, as being concerned in the carrier particle diameter, the magnetic brush formed on the developing sleeve at the development pole may decrease in density to come to have a large ear length and become rigid, tending to cause uneven sweep marks on copied images. If the carrier has an intensity of magnetization of less than 30 Am2/kg, the carrier may have a low magnetic force even if fine carrier powder is removed, to tend to cause carrier adhesion, tending to cause a lowering of toner transport performance.

The carrier may preferably have an apparent density of 2.3 g/cm3 or less, and more preferably 2.1 g/cm3 or less. If it has an apparent density of more than 2.3 g/cm3 or more, it may cause carrier-spent due to the release agent, inside the developing assembly, may cause faulty toner coating because of the carrier transport performance on developing sleeve that has become poor, and may cause fog, tone scatter and so forth at the latter part of running because of a lowering of charge-providing performance to toner.

The carrier may preferably have a shape factor SF-1 of from 100 to 130, and more preferably from 100 to 120. If it has a shape factor SF-1 of more than 130, the carrier may seriously be contaminated by the toner particles or inorganic fine powder, so that its charge-providing performance to toner may lower during extensive service over a long period of time to cause difficulties such as toner scattering and fog.

The carrier may preferably be a magnetic-material dispersion type resin carrier in view of an advantage that the above various physical properties can all be satisfied.

Methods for measuring various physical properties concerning the toner of the present invention are described below.

(1) Measurement of Molecular-weight Distribution of Resin Component of Toner:

Molecular weight distribution of the resin component of the toner is measured by GPC (gel permeation chromatography). As a specific method for the measurement by GPC, the toner is beforehand extracted with a toluene solvent for 20 hours by means of a Soxhlet extractor, and thereafter the toluene is evaporated off by means of a rotary evaporator, optionally followed by addition of an organic solvent capable of dissolving the wax contained in the toner base particles but dissolving no resin component, e.g., chloroform, to thoroughly carry out washing. Thereafter, the toner components having been subjected to this washing are dissolved in THF (tetrahydrofuran), and then the solution obtained is filtered with a solvent-resistant membrane filter of 0.3 μm in pore diameter to obtain a measuring sample. Using a detector 150C, manufactured by Waters Co., and with column constitution in which A-801, A-802, A-803, A-804, A-805, A-806 and A-807, available from Showa Denko K.K., are connected, the molecular-weight distribution of the sample is measured using a calibration curve of a standard polystyrene resin. Weight-average molecular weight (Mw) and number-average molecular weight (Mn) are calculated from the molecular-weight distribution thus measured.

(2) Measurement of Temperature of Endothermic Peak (Often Called Endothermic Peak Temperature), Half Width of Endothermic Peak (Often Called Endothermic Peak Half Width) and Glass Transition Temperature in DSC Endothermic Curve of Toner:

These are measured according to ASTM D3418-82. In the present invention, a differential scanning calorimeter DSC-7 (manufactured by Perkin Elmer Co.) is used. The temperature at the detecting portion of the device is corrected on the basis of melting points of indium and zinc, and the calorie is corrected on the basis of heat of fusion of indium. A measuring sample is accurately weighed within the range of 10 mg. The measuring sample is put in a pan made of aluminum and only a pan (empty pan) made of aluminum is set as a control. From a DSC curve obtained when these are heated at a heating rate of 10° C./min in the measurement region of from 30 to 200° C., the chief endothermic peak value is determined as the endothermic peak value of the release agent used in the present invention. The half width of the endothermic peak refers to the temperature width of an endothermic chart at the part corresponding to ½ of the peak height from the base line at the endothermic peak. Incidentally, when measurement is made on the wax component alone, the temperature is raised-and-dropped once under the same conditions as those at the time of measurement, and measurement is started after the pre-history the wax component has is removed. When the measurement is made on the wax component kept contained in toner base particles, the measurement is made as it is, without the operation of removing the pre-history.

(3) Measurement of Molecular Weight of Release Agent:

| Measured by GPC (gel permeation chromatography) under conditions shown below. | |
|---|---|
| Apparatus: | GPC-150C (Waters Co.). |
| Columns: | GMH-MT 30 cm, combination of two columns (available from Toso Corporation). |
| Temperature: | 135° C. |
| Solvent: | o-Dichlorobenzene (0.1% ionol-added). |
| Flow rate: | 1.0 ml/min. |
| Sample: | 0.4 ml of a 0.15% sample is injected. |

Molecular weight is measured under conditions shown above. The molecular weight of the sample is calculated using a molecular weight calibration curve prepared from a monodisperse polystyrene reference sample. It is further calculated by converting the value in terms of polyethylene according to a conversion expression derived from the Mark-Houwink viscosity equation.

(4) Water/Methanol Wettability Test Method:

A methanol dropping transmittance curve is utilized which is prepared by measurement made under the following conditions and procedure by means of a powder wettability tester WET-100P, manufactured by Rhesca Company, Limited.

First, 50 ml of a methanol/water mixed solvent (methanol concentration: 0%) is put into a flask, and its transmittance is measured. The transmittance measured here is expressed by 100%, and a condition in which no light is transmitted at all by 0%, where the transmittance is measured. That is, the methanol concentration (% by weight) of each of a sample fluid of the toner base particles and that of the toner at the time the intensity of transmitted light at the time of measurement has come to be a half of the intensity of transmitted light when the light is transmitted through the methanol/water mixed solvent (methanol concentration: 0%) is represented by TA and TB, respectively, in the present invention.

The transmittance is measure in the following way. A magnetic stirrer is put into a beaker holding 50 ml of the methanol/water mixed solvent (methanol concentration: 0%). Then, 0.1 g of the toner or toner base particles having been sieved with a mesh of 150 μm in mesh size is precisely weighed, and this is put into the flask. Next, stirring with the magnetic stirrer is started at a stirring speed of 300 rpm (5 revolutions/second). To this measuring sample fluid, methanol is continuously added through a glass tube at an addition rate of 1.3 ml/min, during which the transmittance of light of 780 nm in wavelength is measured to prepare the methanol dropping transmittance curve. Here, the methanol is used as a titration solvent for the reason that the elution of the dye or pigment, charge control agent and so forth contained in the toner has less influence and the particle surface state of the toner can more accurately be observed.

Incidentally, in this measurement, used as the beaker is a beaker made of glass and having a diameter of 5 cm, and as the magnetic stirrer a stirrer having the shape of a spindle of 25 mm in length and 8 mm in maximum diameter and having been coated with TEFLON (registered trademark of Du Pont).

(5) Measurement of Needle Penetration of Release Agent:

The needle penetration of the release agent is measured according to JIS K2235. Measurement temperature is set to 25° C.

(6) Measurement of Melt Index (MI) of Toner:

Measured by the manual cut-out method, using the apparatus prescribed in JIS K7210. Measurement conditions are measurement temperature: 135° C.; load: 1.75 kg; and sample fill quantity: 5 to 10 g. Here, measured values are converted to 10-minute values.

(7) Measurement of Weight-average Particle Diameter (D4) of Toner and Particle Size Distribution of Toner:

The average particle diameter and particle size distribution of the toner may be measured with Coulter Counter TA-II or Coulter Multisizer II (manufactured by Coulter Electronics, Inc.). In the present invention, they are measured with Coulter Multisizer II (manufactured by Coulter Electronics, Inc.). An interface (manufactured by Nikkaki Bios Co., Ltd.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used as such an electrolytic solution. To make measurement, as a dispersant from 0.1 to 5 ml of a surface active agent, preferably an alkylbenzene sulfonate, is added to from 100 to 150 ml of the above aqueous electrolytic solution, and from 2 to 20 mg of a sample to be measured is further added. The electrolytic solution in which the sample has been suspended is subjected to dispersion for about 1 minute to about 3 minutes in an ultrasonic dispersion machine. The volume distribution and number distribution are calculated by measuring the volume and number of particles with particle diameters of 2 μm or more by means of the above Coulter Multisizer, using an aperture of 100 μm as its aperture. Using these values, the weight-based (the middle value of each channel is used as the representative value for each channel), weight-average particle diameter (D4), the percent by number of toner with particle diameters of 4.0 μm or less and the percent by volume of toner with particle diameters of 12.7 μm or more are determined.

(8) Measurement of Acid Value and Hydroxyl Value of Toner and Binder Resin:

—Acid Value—

The acid value is determined in the following way. Basic operation is made according to JIS K0070.

(A) Reagent (a) Solvent: An ethyl ether/ethyl alcohol mixture solution (1+1 or 2+1) or a benzene/ethyl alcohol mixture solution (1+1 or 2+1) is used. These solutions are each kept neutralized with a 0.1 mol/liter potassium hydroxide ethyl alcohol solution using phenolphthalein as an indicator immediately before use.

(b) Phenolphthalein solution: 1 g of phenolphthalein is dissolved in 100 ml of ethyl alcohol (95 vol. %).

(c) 0.1 mol/liter potassium hydroxide-ethyl alcohol solution: 7.0 g of potassium hydroxide is dissolved in water used in a quantity as small as possible, and ethyl alcohol (95 vol. %) is added thereto to make up a 1 liter solution, which is then left for 2 or 3 days, followed by filtration. Standardization is made according to JIS K8006 (basic items relatating to titration during a reagent content test).

(B) Operation: From 1 to 20 g of the sample (toner or binder resin) is precisely weighed, and 100 ml of the solvent and few drops of the phenolphthalein solution as an indicator are added thereto, which are then thoroughly shaked until the sample dissolves completely. In the case of a solid sample, it is dissolved by heating on a water bath. After cooling, the resultant solution is titrated with the 0.1 mol/liter potassium hydroxide ethyl alcohol solution, and the time by which the indicator has stood sparingly red for 30 seconds is regarded as the end point of neutralization.

(C) Calculation: The acid value is calculated from the following equation.

$$A=(B\times f\times 5.611)/S$$

Incidentally, the symbols in the above formula represent the following parameters.

A: the acid value (mgKOH/g);

B: the amount (ml) of the 0.1 mol/liter potassium hydroxide ethyl alcohol solution used;

f: the factor of the 0.1 mol/liter potassium hydroxide ethyl alcohol solution; and S: the sample (g).

—Hydroxyl Value—

The hydroxyl value is determined in the following way. Basic operation is made according to JIS K0070.

(A) Reagent (a) Acetylating reagent: 25 g of acetic anhydride is put into 100 ml of a measuring flask, and pyridine is added to make up a 100 ml solution in total weight, followed by thorough shaking and mixing. The acetylating reagent is so stored in a brown bottle that it does not come into contact with any moisture or any vapor of carbon dioxide or acid.

(b) Phenolphthalein solution: 1 g of phenolphthalein is dissolved in 100 ml of ethyl alcohol (95 vol. %).

(c) N/2 potassium hydroxide ethyl alcohol solution: 35 g of potassium hydroxide is dissolved in water used in a quantity as small as possible, and ethyl alcohol (95 vol. %) is added thereto to make up a 1 liter solution, which is then left for 2 or 3 days, followed by filtration. Standardization is made according to JIS K-8006.

(B) Operation: From 0.5 to 2.0 g of the sample is precisely weighed in a round flask, and just 5 ml of the acetylating reagent is added thereto. A small funnel is hooked on the mouth of the flask, and its bottom is immersed by about 1 cm in a 95 to 100° C. glycerol bath and heated. Here, in order to prevent the neck of the flask from being heated by the heat of the bath, the base of the neck of the flask is covered with a cardboard disk with a round hole made in the middle. One hour later, the flask is taken out of the bath. After it was left to cool, 1 ml of water is added through the funnel, followed by shaking to decompose acetic anhydride. In order to effect the decomposition further completely, the flask is again heated in the glycerol bath for 10 minutes. After it was left to cool, the walls of the funnel and flask are washed with 5 ml of ethyl alcohol, followed by titration with the N/2 potassium hydroxide ethyl alcohol solution using the phenolphthalein solution as a reagent. Here, an empty test is made in parallel to the main test.

(C) Calculation: The hydroxyl value is calculated from the following equation.

$$A=[(B-C)\times f\times 28.05]/S+D$$

Incidentally, the symbols in the above formula represent the following parameters.

A: the hydroxyl value (mgKOH/g);

B: the amount (ml) of the N/2 potassium hydroxide ethyl alcohol solution used in the empty test;

C: the amount (ml) of the N/2 potassium hydroxide ethyl alcohol solution used in the main test;

f: the factor of the N/2 potassium hydroxide ethyl alcohol solution;

S: the sample (g); and

D: the acid value (mgKOH/g).

(9) Measurement of Shape Factors (SF-1, SF-2) of Toner and Carrier:

The SF-1 and SF-2 are defined to be values obtained by sampling at random 100 particles in a toner image by the use of FE-SEM (S-800), a scanning electron microscope manufactured by Hitachi Ltd. in 3,000 enlargement magnifications, introducing their image information in an image analyzer (LUZEX-3) manufactured by Nireko Co. through an interface to make analysis, and calculating the data according to the following expressions.

$$SF\text{-}1=\{(MXLNG)2/AREA\}\times(\pi/4)\times 100$$

$$SF\text{-}2=\{(PERI)2/AREA\}\times(\pi/4)\times 100$$

(In the above expressions, MXLNG: absolute maximum length; AREA: projected area of toner particle; PERI: peripheral length.)

The shape factor SF-1 of toner indicates the degree of sphericity. The greater than 100 the value is, the more gradually amorphous the toner particles become. SF-2 indicates the degree of irregularity; the greater than 100 the value is, the more remarkably irregular the toner particle surfaces become.

(10) Measurement of Particle Diameter of Carrier:

The particle diameter of the carrier is measured using a laser diffraction particle size distribution measuring instrument HELOS (manufactured by JOEL Ltd.) and under conditions of a feed air pressure of 3 bar and a suction pressure of 0.1 bar. Incidentally, the average particle diameter of the carrier shows volume-based 50% particle diameter of carrier particles.

(11) Measurement of Magnetic Properties of Carrier:

The magnetic properties of the carriers is measured with a vibration magnetic-field type magnetic-property autographic recorder BHV-35, manufactured by Riken Denshi Co., Ltd. In measuring the same, an external magnetic field of 1,000/4π (kA/m) is formed, and the intensity of magnetization when it is formed is determined in the following way: A cylindrical plastic container is filled with the carrier in the state it has well densely been packed so that carrier particles do not move. In this state, the magnetic moment is measured, and the actual weight when the sample is put in is measured to determine the intensity of magnetization (Am2/kg).

Where physical properties of the carrier are measured from a developer, the developer is washed with an ion-exchanged water containing CONTAMINON N (a surface-active agent available from Wako Pure Chemical Industries, Ltd), to separate the toner and the carrier, and thereafter the above measurement is made.

(12) Measurement of Resistivity of Carrier:

The resistivity of the carriers is measured with a powder insulation resistance measuring instrument manufactured by Shinku-Riko Inc. As measuring conditions, a carrier having been left for 24 hours or more under conditions of 23° C. and 60% RH (relative humidity) is put in a measuring cell of 20 mm in diameter (0.283 cm2), which is then sandwiched between 120 g/cm2 loading electrodes, setting the thickness of the cell to 2 mm, to make measurement at an applied voltage of 500 V.

(13) Measurement of Apparent Density of Carrier:

The apparent density of the carrier is measured according to JIS Z02504.

—Image Forming Method—

An image forming method which can preferably use the toner of the present invention is described below in detail. As an example of the image forming method which can preferably use the toner of the present invention, an image forming method is available which has a charging step of charging the surface of an photosensitive member electrostatically; a latent-image formation step of forming an electrostatic latent image on the photosensitive member surface thus charged; a developing step of feeding the toner of the present invention to the electrostatic latent image by the action of an electric field formed between i) a developer carrying member which is provided in a developing unit and holds thereon a developer containing the toner and ii) the photosensitive member holding thereon the electrostatic latent image, to render the electrostatic latent image visible to form a toner image; a transfer step of transferring the toner image onto a transfer material via, or not via, an intermediate transfer member; and a fixing step of making the transfer material pass a nip formed by a fixing member and a pressure member pressed against the fixing member, to fix the toner image to the transfer material with heating and in pressure contact.

The toner of the present invention may preferably be used in white-and-black copying machines such as iR6000 and iR3000, laser beam printers such as LBP720 and LBP950, two-component altered machines of these; and full-color copying machines such as LBP2040, LBP2810, LBP2710, LBP2410, CLC500, CLC700, CLC1000, CP2150, CP660 and iRC3200, all manufactured by CANON INC.

A preferred example of the image forming method making use of the toner of the present invention is described below with reference to the accompanying drawings. FIG. 1 is a partial diagrammatic view showing an example of an image forming apparatus employing the image forming method making use of the toner of the present invention. Its details are described later. This image forming apparatus has a photosensitive drum 1 as a photosensitive member on which electrostatic latent images are to be held, a charging means 2 which charges the surface of the photosensitive drum 1 electrostatically, a latent image forming means (not shown) which exposes to laser light 24 the photosensitive drum 1 surface thus charged, to form thereon the electrostatic latent images, a developing assembly 4 by means of which the electrostatic latent images formed on the surface of the photosensitive drum 1 are developed and rendered visible by the use of the toner to form toner images, and a transfer blade 27 as a transfer means which transfers to a transfer material 25 the toner images formed by means of the developing assembly 4.

As a development method making use of the toner of the present invention, the development may be performed using, e.g., a two-component developing means as shown in FIG. 1. In the present invention, the step of development may preferably be the step of applying to the developer carrying member a voltage formed by superimposing an AC component on a DC component, to form a vibrating electric field between the developer carrying member and the photosensitive member surface to perform development. Stated specifically, as shown in FIG. 1, the development may preferably be performed by applying an alternating electric field to the developer carrying member and in such a state that a magnetic brush formed on the developer carrying member by the carrier is kept in touch with the latent image bearing member photosensitive drum 1.

A distance B between the developer carrying member (developing sleeve) 11 and the photosensitive drum 1 (S-D distance) may preferably be from 100 to 800 μm. This is favorable for preventing carrier adhesion to the photosensitive member and improving dot reproducibility. If the S-D distance is smaller (the gap is narrower) than 100 μm, the developer tends to be insufficiently fed to the photosensitive member, resulting in a low image density. If on the other hand it is larger than 800 μm, the magnetic line of force from a magnet pole S1 may broaden to make the magnetic brush have a low density, resulting in a poor dot reproducibility, or to weaken the force of binding the magnetic coat carrier, tending to cause carrier adhesion.

The alternating electric field may preferably be applied at a peak-to-peak voltage of from 300 to 3,000 V and a frequency of from 500 to 10,000 Hz, and preferably from 1,000 to 7,000 Hz, which may each be applied under appropriate selection in accordance with processes. In this instance, the waveform used may be selected in variety from a triangular waveform, a rectangular waveform, a sinusoidal waveform, a waveform with varied duty ratio, and an intermittent alternating superimposed electric field. If the applied voltage is lower than 300 V, a sufficient image density can be attained with difficulty, and fog toner having adhered to non-image areas is not well collected in some cases. If it is higher than 3,000 V, the latent image may be disordered through the magnetic brush to cause a lowering of image quality.

If the frequency of the alternating electric field is lower than 500 Hz, being concerned with process speed, the toner having come into contact with the photosensitive member can not be well vibrated when returned to the developing sleeve, so that fog tends to occur. If it is higher than 10,000 Hz, the toner can not follow up the electric field to tend to cause a lowering of image quality.

The use of a two-component developer having a toner well charged enables application of a low fog take-off voltage (Vback), and enables the photosensitive member to be low charged in its primary charging, thus the photosensitive member can be made to have a longer lifetime. The Vback, which may depend on the developing system, may preferably be 350 V or less, and more preferably 300 V or below. Also, as contrast potential, a potential of from 100 V to 500 V may preferably be used so that a sufficient image density can be achieved.

What is important in the development method used in the present invention is as follows: In order to perform development promising a sufficient image density, achieving a superior dot reproducibility and free of carrier adhesion, the magnetic brush on the developing sleeve 11 may preferably be made to come into touch with the photosensitive drum 1 at a width (developing nip C) of from 3 to 8 mm. If the developing nip C is narrower than 3 mm, it may be difficult to well satisfy sufficient image density and dot reproducibility. If it is broader than 8 mm, the developer may pack into the nip to cause the machine to stop from operating, or it may be difficult to well prevent the carrier adhesion. The developing nip width may be adjusted by appropriately selecting the distance A between a control blade 15 as a developer layer thickness control member and the developing sleeve 11, or the distance B between the developing sleeve 11 and the photosensitive drum 1.

The image forming method making use of the toner of the present invention enables development that is faithful to dot latent images because it is not affected by the injection of electric charges through the toner and does not disorder latent images when, in the reproduction of images attaching importance especially to halftones, the developer containing the toner of the present invention and the above developing method are used especially in combination with a developing system where digital latent images are formed. In the step of transfer as well, the use of the toner having been fine-powder cut-off and having a sharp particle size distribution enables achievement of a high transfer efficiency and hence enables achievement of a high image quality at both halftone areas and solid areas.

Concurrently with the achievement of a high image quality at the initial stage, the use of the above two-component type developer makes the toner have less change in charge quantity inside the developing assembly, and can well bring out the effect of the present invention that no decrease in image density may occur even when copied on a large number of sheets. More preferably, the image forming apparatus may have developing assemblies for magenta, cyan, yellow and black, and development for black may finally be performed, whereby images can more assume a tightness (tighter images).

The image forming method preferably used in the toner of the present invention is further described in detail with reference to FIG. 1. In the image forming appratus shown in FIG. 1, a magnetic brush composed of magnetic particles 23 is formed on the surface of a transport sleeve 22 by the action of a magnetic force a magnet roller 21 has. This magnetic brush is brought into touch with the surface of a photosensitive drum 1 to charge the photosensitive drum 1 electrostatically. A charging bias is kept applied to the transport sleeve 22 by a bias applying means (not shown).

The photosensitive drum 1 thus charged is exposed to laser light 24 by means of an exposure unit as a latent-image formation means (not shown) to form a digital electrostatic latent image. The electrostatic latent image thus formed on the photosensitive drum 1 is developed with a toner 19*a* (the toner of the present invention) contained in a developer 19 carried on a developing sleeve 11 internally provided with a magnet roller 12 and to which a development bias is kept applied by a bias-applying means (not shown).

The inside of a developing assembly 4 is partitioned into a developer chamber R1 and an agitator chamber R2 by a partition wall 17, and is provided with developer transport screws 13 and 14, respectively. At the upper part of the agitator chamber R2, a toner storage chamber R3 holding a replenishing toner 18 therein is installed. At the lower part of the toner storage chamber R3, a supply opening 20 is provided.

As a developer transport screw 13 is rotatingly driven, the developer held in the developer chamber R1 is transported in one direction in the longitudinal direction of the developing sleeve 11 while being agitated. The partition wall 17 is provided with openings (not shown) on this side and the inner side as viewed in the drawing. The developer transported to one side of the developer chamber R1 by the screw 13 is sent into the agitator chamber R2 through the opening on the same side of the partition wall 17, and is delivered to the developer transport screw 14. The screw 14 is rotated in the direction opposite to the screw 13. Thus, while the developer in the agitator chamber R2, the developer delivered from the developer chamber R1 and the toner replenished from the toner storage chamber R3 are agitated and blended, the developer is transported inside the agitator chamber R2 in the direction opposite to the screw 13 and is sent into the developer chamber R1 through the opening on the other side of the partition wall 17.

To develop the electrostatic latent image formed on the photosensitive drum 1, the developer 19 held in the developer chamber R1 is drawn up by the magnetic force of the magnet roller 12, and is carried on the surface of the developing sleeve 11. The developer carried on the developing sleeve 11 is transported to the developer control blade 15 as the developing sleeve 11 is rotated, where the developer is controlled into a developer thin layer with a proper layer thickness. Thereafter, it reaches a developing zone where the developing sleeve 11 faces the photosensitive drum 1. In the magnet roller 12 at its part corresponding to the developing zone, a magnetic pole (development pole) N1 is positioned, and the development pole N1 forms a magnetic field at the developing zone. This magnetic field causes the developer to rise in ears, thus the magnetic brush of the developer is formed in the developing zone. Then, the magnetic brush comes into touch with the photosensitive drum 1. The toner attracted to the magnetic brush and the toner attracted to the surface of the developing sleeve 11 are moved to and become attracted to the region of the electrostatic latent image on the photosensitive drum 1, where the electrostatic latent image is developed, and a toner image is formed.

The developer having passed through the developing zone is returned into the developing assembly 4 as the developing sleeve 11 is rotated, then stripped off the developing sleeve 11 by a repulsive magnetic field formed between magnetic poles, and dropped into the developer chamber R1 and agitator chamber R2 so as to be collected there.

Once a T/C ratio (blend ratio of toner and carrier, i.e., toner concentration in the developer) of the developer 19 in the developing assembly 4 has lowered as a result of the above development, the replenishing toner 18 is replenished from the toner storage chamber R3 to the agitator chamber R2 in the quantity corresponding to the quantity of the toner consumed by the development, thus the T/C ratio of the developer 19 is maintained to a stated quantity. To detect the T/C ratio of the developer 19 in the developing assembly 4, a toner concentration detecting sensor 28 is used which measures changes in permeability of the developer by utilizing the inductance of a coil. The toner concentration detecting sensor 28 has a coil (not shown) on its inside.

The developer control blade 15, which is provided beneath the developing sleeve 11 to control the layer thickness of the developer 19 on the developing sleeve 11, is a non-magnetic blade made of a non-magnetic material such as aluminum or SUS316 stainless steel. The distance between its end and the surface of the developing sleeve 11 is 150 to 1,000 μm, and preferably 250 to 900 μm. If this distance is smaller than 150 μm, the magnetic carrier 19*b* may be caught between them to tend to make the developing layer uneven, and also the developer necessary for performing good development may be coated on the sleeve with difficulty, so that developed images with a low density and much unevenness tend to be formed. In order to prevent non-uniform coating (what is called blade clog) due to unauthorized particles included in the developer, the distance may preferably be 250 μm or more. If this distance is more than 1,000 μm, the quantity of the developer coated on the developing sleeve 11 increases to make it difficult to make desired control of the developer layer thickness, so that the magnetic carrier particles adhere to the photosensitive drum 1 in a large quantity and also the circulation of the developer and the control of the developer by the developer control blade 15 may become less effective to tend to cause fog because of a decrease in triboelectricity of the toner.

The toner image formed by development is transferred onto a transfer material (recording material) 25 transported to a transfer zone, by means of a transfer blade 27 which is a transfer means to which a transfer bias is kept applied by a bias-applying means 26. The toner image thus transferred onto the transfer material is fixed to the transfer material by means of a fixing assembly (not shown). Transfer residual toner remaining on the photosensitive drum 1 without being transferred to the transfer material in the transfer step is charge-controlled in the charging step and collected in the developing assembly 4 at the time of development.

Figure 6:
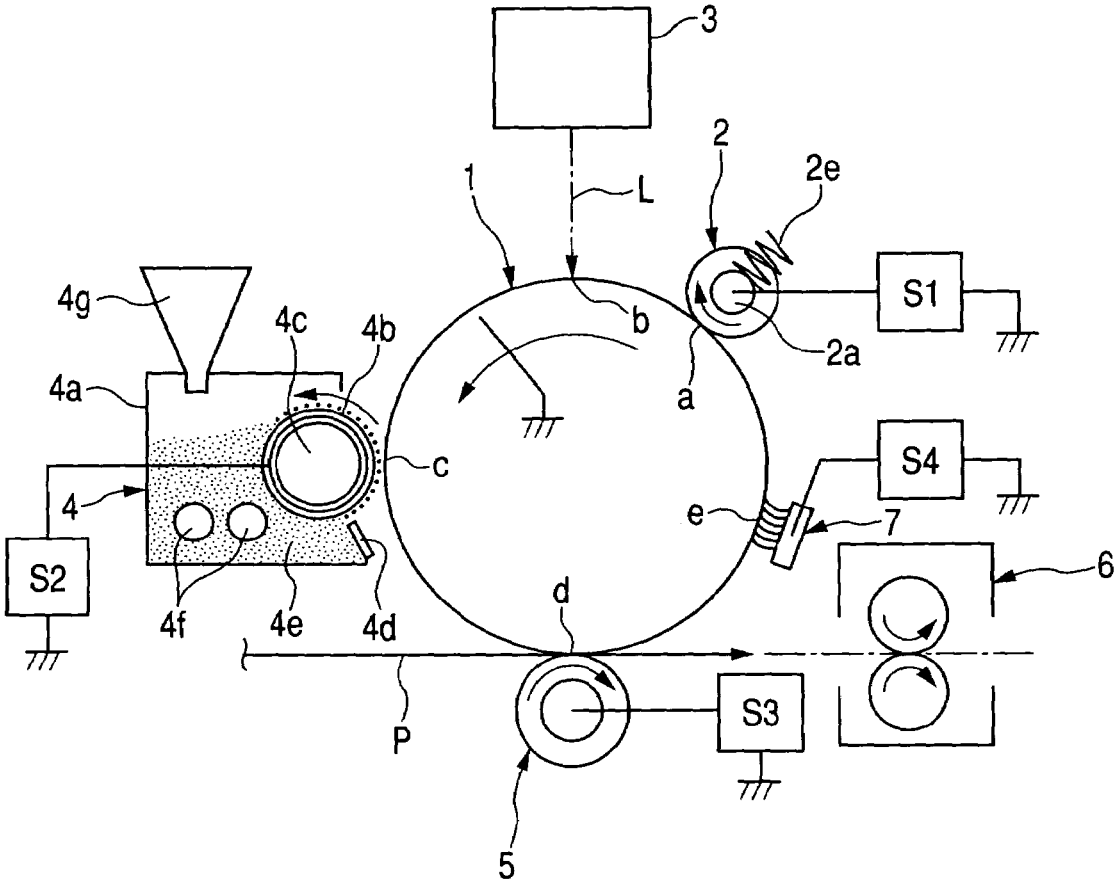
FIG. 6 is a schematic illustration showing another example of an image-forming apparatus in which the toner of the present invention is preferably usable.

The toner of the present invention may also preferably be used having a charge quantity control step, making use of such an apparatus as shown in FIG. 6.

As shown in FIG. 6, a stated charging bias is applied to a charging roller 2 from a power source S1 to charge a photosensitive drum 1 electrostatically. Here, the charging bias applied to the charging roller 2 may be a vibrating voltage formed by superimposing an AC voltage (Vac) on a DC voltage (Vdc). Thereafter, imagewise exposure is effected by a laser system 3 to form an electrostatic latent image.

In respect to this electrostatic latent image, a developing sleeve 4*b* is provided in proximity and face to face to the photosensitive drum 1. The part where the photosensitive drum 1 and the developing sleeve 4*b* face to each other is a developing zone c. The developing sleeve 4*b* may preferably be rotatingly driven in the direction opposite to the direction of movement of the photosensitive drum 1 at the developing zone c. On the periphery of this developing sleeve 4*b*, part of a two-component developer 4*e* held in a developer container 4*a* is attracted and held as a magnetic-brush layer by the action of a magnetic force of a magnet roller 4*c* in the developing sleeve 4*b*. It is rotatingly transported as the developing sleeve 4*b* is rotated, and is layer-controlled to a stated thin layer by a developer coating blade 4*d*, where its thin layer comes into touch with the surface of the photosensitive drum 1 at the developing zone c to rub the photosensitive drum surface appropriately.

To the developing sleeve 4*b*, a stated development bias is applied from a power source S2. In this example, the development bias voltage applied to the developing sleeve 4*b* is the vibrating voltage formed by superimposing an AC voltage (Vac) on a DC voltage (Vdc). Thus, the electrostatic latent image formed on the photosensitive drum 1 is developed with the toner contained in the two-component developer 4*e*. The toner image formed by development is transferred to a transfer material or an intermediate transfer member or the like (FIG. 6 shows an example in which the toner image is transferred to a transfer material) at a transfer zone d by the aid of a transfer roller 5. The toner having remained on the photosensitive drum 1 undergoes the next step of charge quantity control. That is, the toner having remained on the photosensitive drum 1 (transfer residual toner) comes into contact with a brush contact zone e on a charge quantity control member 7 to which a stated voltage is kept applied from a power source S4, so that this toner is controlled to a regular polarity. In the case of a negatively chargeable toner, a negative voltage is applied to the photosensitive drum 1. In the case of a positively chargeable toner, a positive voltage is applied to the photosensitive drum 1. Undergoing such a step, in the case of a cleanerless system, the transfer residual toner can well be collected at the time of development. Not shown in FIG. 6, it is also an effective means that, in order to remove residual electric charges of the photosensitive drum 1 and remedy drum ghost, the same member as that in the charge quantity control step is used between the transfer step and the charge quantity control step to provide the photosensitive drum 1 with a potential difference having a polarity reverse to the one applied in the charging step.

Figure 3:
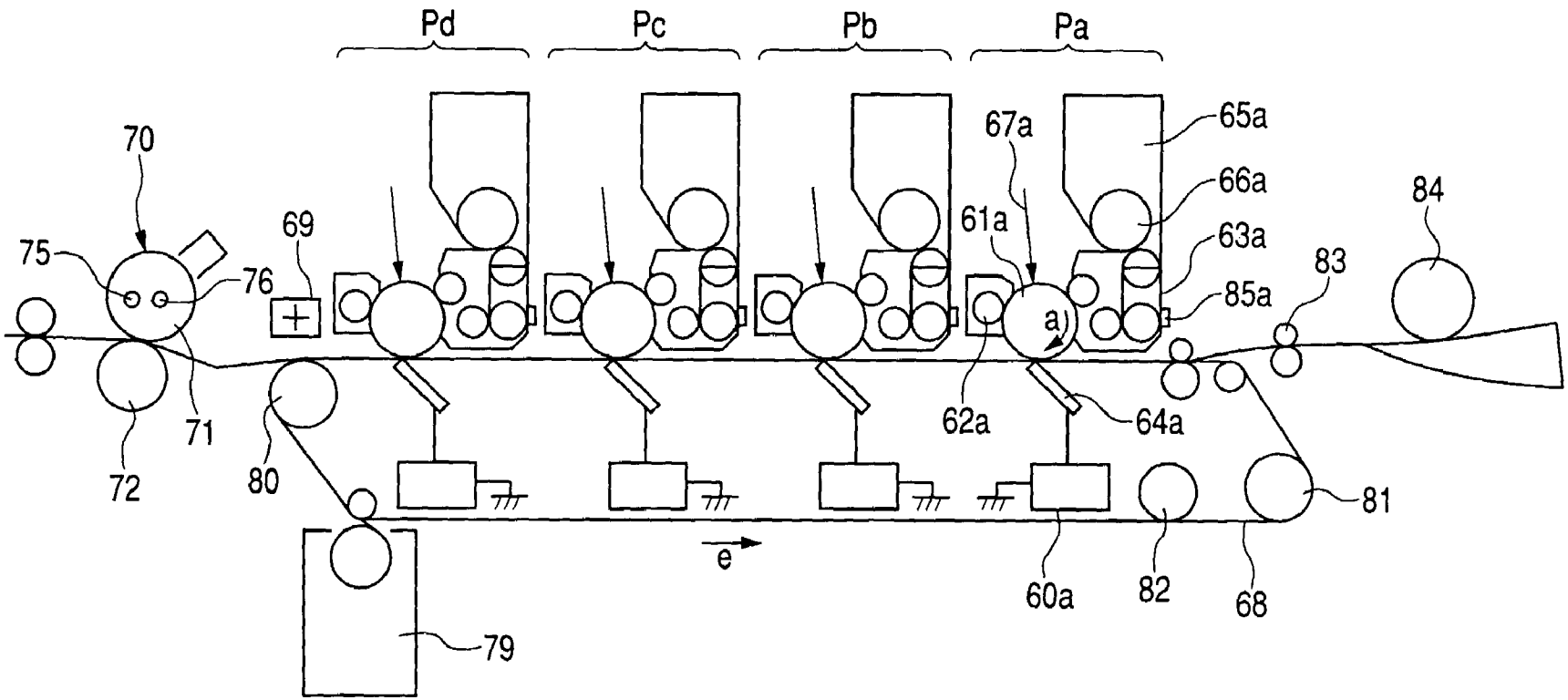
FIG. 3 is a schematic view showing an example of a full-color image-forming apparatus in which the toner of the present invention is preferably used.

FIG. 3 is a schematic structural view of a full-color image forming apparatus in which the toner of the present invention may preferably be used. The main body of the full-color image forming apparatus is provided side by side with a first image forming unit Pa, a second image forming unit Pb, a third image forming unit Pc and a fourth image forming unit Pd, and images with respectively different colors are formed on a transfer material through the process of latent image formation, development and transfer.

The respective image forming units provided side by side in the image forming apparatus are each constituted as described below taking the case of the first image forming unit Pa.

The first image forming unit Pa has a photosensitive drum 61*a* of 30 mm in diameter as a photosensitive member which is an electrophotographic latent image bearing member. This photosensitive drum 61*a* is rotatingly moved in the direction of an arrow a. Reference numeral 62*a* denotes a primary charging assembly as a charging means, and a magnetic brush formed on a 16 mm diameter sleeve is so provided as to be in contact with the photosensitive drum 61*a*. Reference numeral 67*a* denotes laser light for forming an electrostatic latent image on the photosensitive drum 61*a* whose surface has uniformly been charged by means of the primary charging assembly 62*a*, to which light the photosensitive drum 61*a* surface is exposed by an exposure unit (not shown). Reference numeral 63*a* denotes a developing assembly as a developing means for developing an electrostatic electrostatic latent image held on the photosensitive drum 61*a*, to form a color toner image, which holds the toner of the present invention as a color toner. Reference numeral 64*a* denotes a transfer blade as a transfer means for transferring the color toner image formed on the surface of the photosensitive drum 61*a*, to the surface of a transfer material (recording material) transported by a beltlike transfer material carrying member 68. This transfer blade 64*a* comes into touch with the back of the transfer material carrying member 68 and can apply a transfer bias.

In this first image forming unit Pa, the photosensitive drum 61*a* is uniformly primarily charged by the primary charging assembly 62*a*, and thereafter the electrostatic latent image is formed on the photosensitive member by the exposure laser light 67*a* emitted from the exposure unit. The electrostatic latent image is developed by the developing assembly 63*a* using the color toner. The toner image thus formed by development is transferred to the surface of the transfer material by applying transfer bias from the transfer blade 64*a* coming into touch with the back of the beltlike transfer material carrying member 68 carrying and transporting the transfer material, at a first transfer zone (the position where the photosensitive drum 61*a* and the transfer material come into contact).

The toner is consumed as a result of the development and the T/C ratio lowers, whereupon this lowering is detected by a toner concentration detecting sensor 85 which measures changes in permeability of the developer by utilizing the inductance of a coil, and a replenishing toner 65*a* is replenished in accordance with the quantity of the toner consumed. The toner concentration detecting sensor 85 has a coil (not shown) in its interior.

In this image forming apparatus, the second image forming unit Pb, third image forming unit Pc and fourth image forming unit Pd, constituted in the same way as the first image forming unit Pa but having different color toners held in the developing assemblies are so provided that four image forming units are arranged side by side. For example, a yellow toner is used in the first image forming unit Pa, a magenta toner in the second image forming unit Pb, a cyan toner in the third image forming unit Pc and a black toner in the fourth image forming unit Pd, where toner images are formed on the photosensitive members provided correspondingly to the respective toner colors and the respective-color toners are sequentially transferred to the transfer material at the transfer zones of the respective image forming units. In this course, the respective-color toners are superimposed while making registration, on the same transfer material during one-time movement of the transfer material. After the transfer is completed, the transfer material is separated from the surface of the transfer material carrying member 68 by a separation charging assembly 69, and then sent to a fixing assembly 70 by a transport means such as a transport belt, where a final full-color image is formed by only-one-time fixing.

The fixing assembly 70 has a 40 mm diameter fixing roller 71 and a 30 mm diameter pressure roller 72 in pair. The fixing roller 71 has heating means 75 and 76 in its interior. Unfixed color toner images having been transferred onto the transfer material are passed through the pressure contact area between the fixing roller 71 and the pressure roller 72 of this fixing assembly 70, whereupon they are fixed onto the transfer material by the action of heat and pressure.

In the apparatus shown in FIG. 3, the transfer material carrying member 68 is an endless beltlike member. This beltlike member is moved in the direction of an arrow e by a drive roller 80. Reference numeral 79 denotes a transfer belt cleaning device; 81, a belt follower roller; and 82, a belt charge eliminator. Reference numeral 83 denotes a pair of registration rollers for transporting to the transfer material carrying member 68 the transfer material kept in a transfer material holder.

As the transfer means, in place of the transfer blade coming into touch with the back of the transfer material carrying member, a contact transfer means may be provided which can apply a transfer bias directly. The above contact transfer means may also be changed for a non-contact transfer means that performs transfer by applying a transfer bias from a corona charging assembly provided in non-contact with the transfer material carrying member on the back thereof, as commonly used. However, in view of the advantage that the quantity of ozone generated when the transfer bias is applied can be controlled, it is more preferable to use the contact transfer means.

Figure 4:
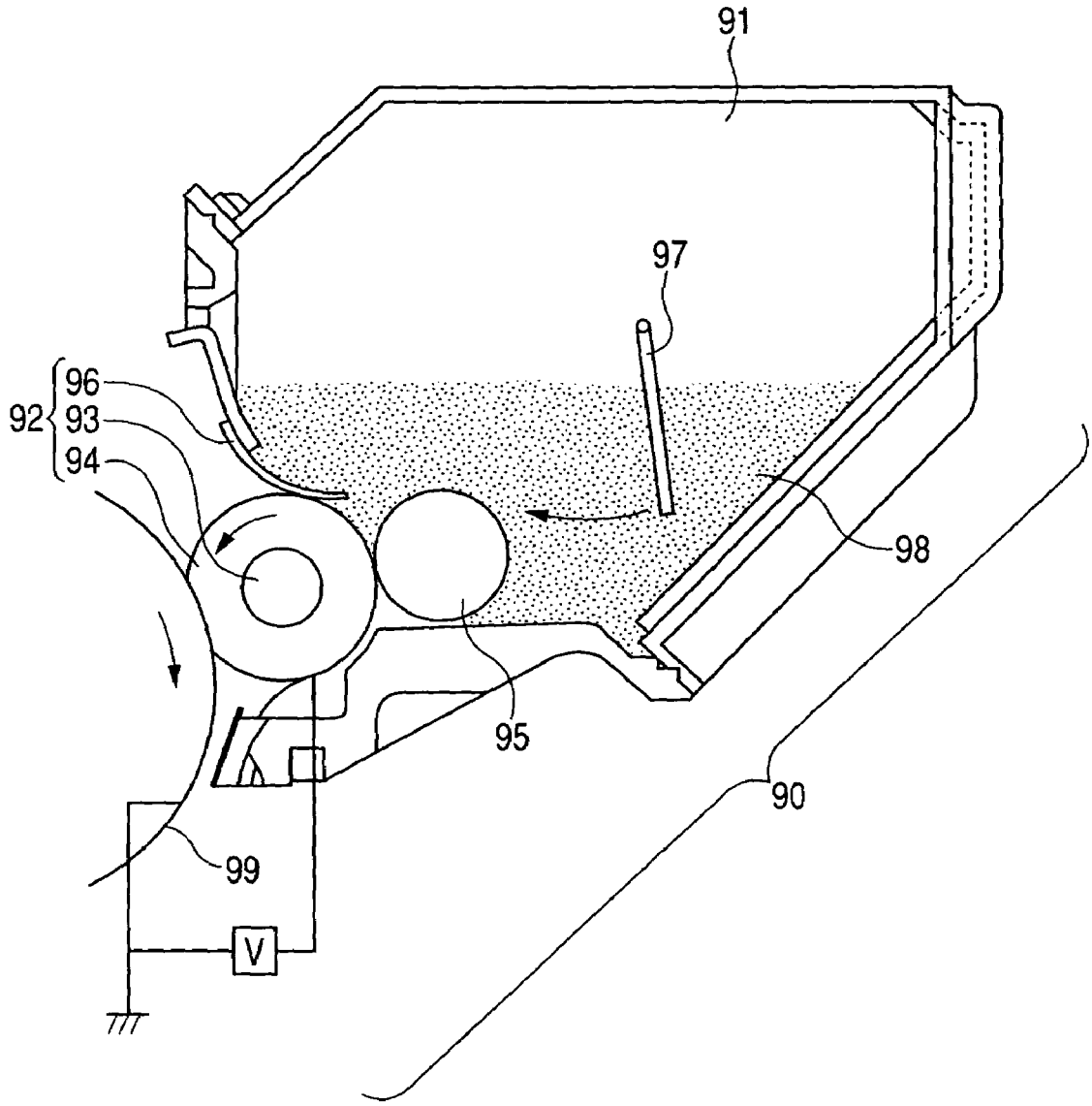
FIG. 4 is a schematic illustration showing an example of an image-forming apparatus employing a contact one-component developing system in which apparatus the toner of the present invention is preferably usable.

The toner of the present invention may also be used as a magnetic or non-magnetic toner in an image forming method making use of a contact one-component developing system. FIG. 4 is a partial sectional view of an image forming apparatus having a developing assembly 90 making use of the contact one-component developing system. The developing assembly 90 has a developer container 91 for holding therein a one-component developer 98 (hereinafter simply also "developer") having the magnetic or non-magnetic toner, a developer carrying member 92 for carrying thereon the one-component developer 98 held in the developer container 91 and for transporting it to the developing zone, a feed roller 95 for feeding the developer onto the developer carrying member, an elastic blade 96 as a developer layer thickness control member for controlling the layer thickness of a developer layer formed on the developer carrying member, and an agitating member 97 for agitating the developer 98 held in the developer container 91.

As the developer carrying member 92, an elastic roller may preferably be used which has on a roller substrate 93 an elastic layer 94 formed of a rubber having an elasticity, such as silicone rubber, or formed of an elastic member such as resin. This elastic roller 92 comes into pressure contact with the surface of a photosensitive drum 99 as a latent image bearing member photosensitive member and participates in the development of an electrostatic latent image formed on the photosensitive drum 99 by the use of the one-component developer 98 coated on the surface of the elastic roller and also collects unnecessary one-component developer 98 present on the photosensitive member after transfer.

In the present invention, the developer carrying member 92 substantially is kept in contact with the photosensitive member 99 surface. This means that the developer carrying member is kept in contact with the photosensitive member when the one-component developer is removed from the developer carrying member. Here, images free of any edge effect can be formed by the aid of an electric field acting across the photosensitive member and the developer carrying member through the developer and simultaneously the photosensitive member surface is cleaned. The surface, or the vicinity of the surface, of the elastic roller serving as the developer carrying member must have a potential to have the electric field across the photosensitive member surface and the elastic roller surface. Thus, a method may also be used in which the elastic rubber of the elastic roller is controlled to have a resistance in a medium-resistance region so as to keep the electric field while preventing its conduction with the photosensitive member surface, or a thin-layer dielectric layer is provided on the surface layer of a conductive roller. It is further possible to use as the developer carrying member a conductive resin sleeve comprising a conductive roller coated with an insulating material on its surface side coming into contact with the photosensitive member surface, or to use an insulating sleeve so made up that a conductive layer is provided on its surface side not coming into contact with the photosensitive member surface.

This elastic roller carrying the one-component developer may be rotated in the same direction as the photosensitive drum, or may be rotated in the direction opposite thereto. When the former is rotated in the same direction as the latter, it may preferably be rotated at a peripheral speed greater by more than 100% with respect to the peripheral speed of the photosensitive drum. If it is rotated at a peripheral speed greater by 100% or less, a problem may arise on image quality such that line images have a poor sharpness. The higher the peripheral speed is, the larger the quantity of the developer fed to the development zone is and the more frequently the developer is attached on and detached from electrostatic latent images. Thus, the developer at the unnecessary areas is scraped off and the developer is imparted to the necessary areas, and this is repeated, whereupon images faithful to the electrostatic latent images are formed. The peripheral speed ratio of the photosensitive drum may preferably from 110% to 180%, and more preferably from 125% to 165%, from the viewpoint of image density and running performance.

The developer layer thickness control member 96 is not limited to the elastic blade so long as it can elastically come into pressure contact with the surface of the developer carrying member 92, and an elastic roller may also be used. The elastic blade or elastic roller may be formed of a rubber elastic material such as silicone rubber, urethane rubber and NBR, a synthetic resin elastic material such as polyethylene terephthalate, or a metal elastic member such as stainless steel or steel, any of which may be used. A composite of some of these may also be used.

In the case of the elastic blade, the elastic blade is, at its upper-edge side base portion, fixedly held on the side of the developer container and is so provided that its blade inner-face side (or its outer-face side in the case of the backward direction) is, at its lower-edge side, brought into touch with the sleeve surface under an appropriate elastic pressure in such a state that it is deflected against the elasticity of the blade in the forward direction or backward direction of the rotation of the developing sleeve.

A feed roller 95 in the developing assembly is formed of a foamed material such as polyurethane foam, and is rotated at a relative speed that is not zero in the forward direction or backward direction with respect to the developer carrying member so that the one-component developer can be fed onto the developer carrying member and also the developer remaining on the developer carrying member after development (the developer having not participated in development) can be taken off.

In the developing zone, when the electrostatic latent image on the photosensitive member is developed by the use of the one-component developer carried on the developer carrying member, a DC and/or AC development bias may preferably be applied across the developer carrying member and the photosensitive drum to perform development.

Figure 5:
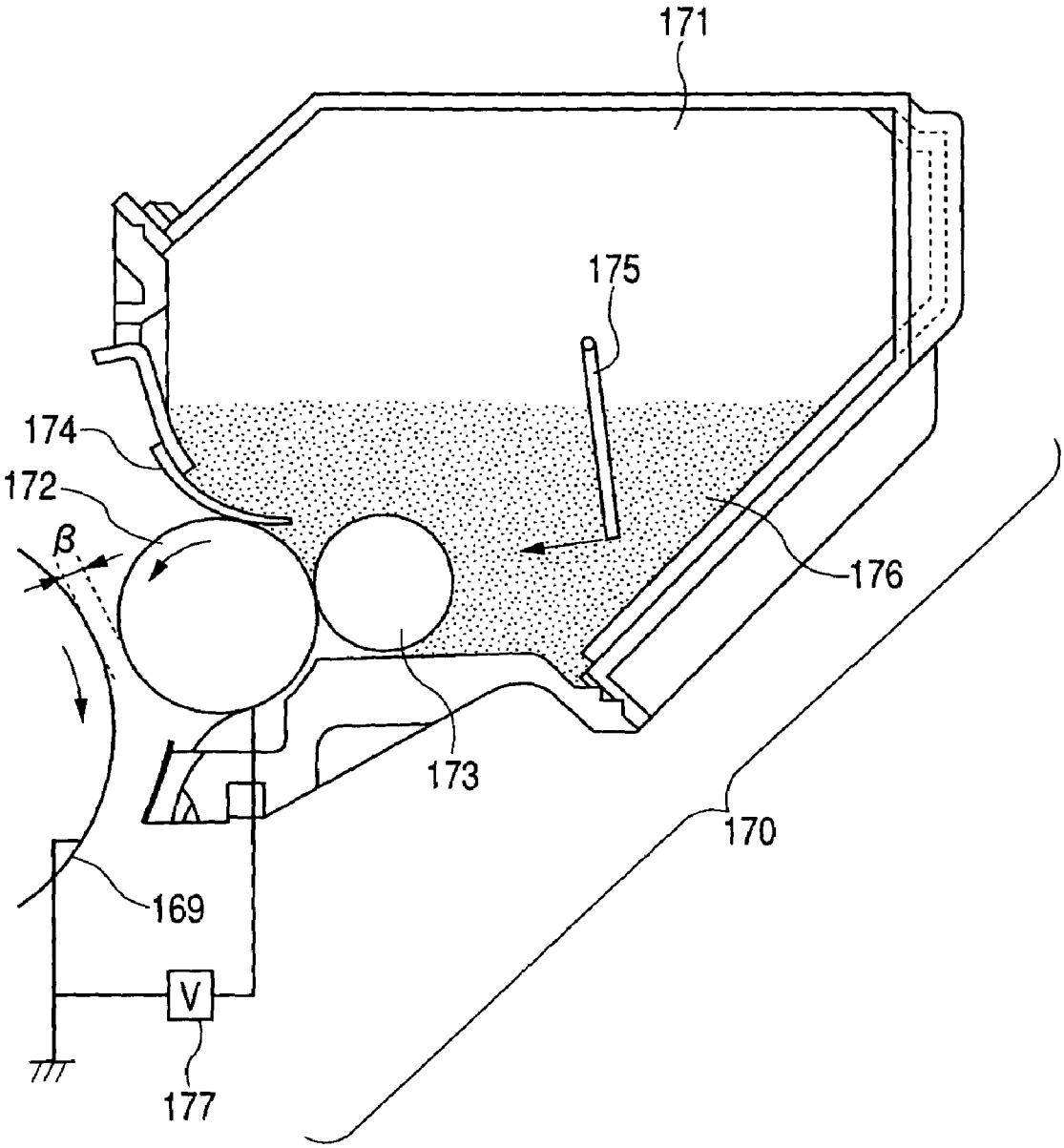
FIG. 5 is a schematic illustration showing an example of an image-forming apparatus employing a non-contact one-component developing system in which apparatus the toner of the present invention is preferably usable.

The non-contact jumping developing system is described below. The non-contact jumping developing system may include a developing method making use of a one-component magnetic or non-magnetic developer having a magnetic toner or non-magnetic toner. Herein, a developing method making use of a one-component non-magnetic developer having the toner of the present invention as the non-magnetic toner is described with reference to a schematic view of its constitution as shown in FIG. 5.

A developing assembly 170 has a developer container 171 for holding the one-component non-magnetic developer 176 (hereinafter also simply "developer") having the toner of the present invention as a non-magnetic toner, a developer carrying member 172 for carrying thereon the one-component non-magnetic developer 176 held in the developer container 171 and for transporting it to the developing zone, a feed roller 173 for feeding the one-component non-magnetic developer onto the developer carrying member 172, an elastic blade 174 as a developer layer thickness control member for controlling the thickness of a developer layer formed on the developer carrying member 172, and an agitating member 175 for agitating the one-component non-magnetic developer 176 held in the developer container 171.

Reference numeral 169 denotes a photosensitive member as an electrostatic latent image bearing member, on which latent images are to be formed by an electrophotographic processing means or electrostatic recording means (not shown). Reference numeral 172 denotes a developing sleeve serving as the developer carrying member, and is formed of a non-magnetic sleeve made of aluminum or stainless steel. The developing sleeve may be prepared using a crude pipe of aluminum or stainless as it is, and may preferably be prepared by spraying glass beads on it to uniformly rough the surface, by mirror-finishing its surface or by coating its surface with a resin.

The one-component non-magnetic developer 176 is reserved in the developer container 171, and is fed onto the developer carrying member 172 by the feed roller 173. The feed roller 173 is formed of a foamed material such as polyurethane foam, and is rotated at a relative speed that is not zero in the forward direction or backward direction with respect to the developer carrying member 172 so that the developer can be fed onto the developer carrying member and also the developer remaining on the developer carrying member after transfer (the developer having not participated in development) can be taken off. The one-component non-magnetic developer 176 fed onto the developer carrying member 172 is coated thereon uniformly and in thin layer by the elastic blade 174 serving as the developer layer thickness control member.

It is effective for the elastic, developer coating member to be brought into touch with the developer carrying member at a pressure of from 0.3 to 25 kg/m, and preferably from 0.5 to 12 kg/cm, as a linear pressure in the generatrix direction of the developer carrying member (developing sleeve). If the touch pressure is less than 0.3 kg/m, it is difficult to uniformly coat the one-component non-magnetic developer on the developer carrying member, resulting in a broad charge quantity distribution of the one-component non-magnetic developer to cause fog or spots around line images. If the touch pressure is more than 25 kg/m, a great pressure is applied to the one-component non-magnetic developer to cause deterioration of the one-component non-magnetic developer and occurrence of agglomeration of the one-component non-magnetic developer, thus such a pressure is not preferable, and also not preferable because a great torque is required in order to drive the developer carrying member. That is, the adjustment of the touch pressure to 0.3 to 25 kg/m makes it possible to effectively loosen the agglomeration of one-component non-magnetic developer and further makes it possible to effect instantaneous rise of the charge of the one-component non-magnetic developer.

As the developer layer thickness control member, an elastic blade or an elastic roller may be used, and it is preferable to use those made of a material of triboelectric series, suited for charging the developer electrostatically to the desired polarity.

In the present invention, silicone rubber, urethane rubber or styrene-butadiene rubber is preferred as a material for the developer layer thickness control member. An organic resin layer may also be provided which is formed of polyamide, polyimide, nylon, melamine, melamine cross-linked nylon, phenol resin, fluorine resin, silicone resin, polyester resin, urethane resin, styrene resin or the like. A conductive rubber or conductive resin may be used, and a filler such as metal oxide, carbon black, inorganic whisker or inorganic fiber and a charge control agent may further be dispersed in the rubber or resin of the elastic blade. This is also preferable because more appropriate conductivity and charge-providing properties can be imparted to the developer layer thickness control member and the one-component non-magnetic developer can appropriately be charged.

In this non-magnetic one-component developing method, in a system in which the one-component non-magnetic developer is coated in thin layer on the developing sleeve 172 by the elastic blade 174, it is preferable in order to achieve a sufficient image density that the thickness of the one-component non-magnetic developer on the developing sleeve 172 is set smaller than a gap length β where the developing sleeve faces the photosensitive member 169 and an alternating electric field is applied to this gap. More specifically, an alternating electric field or a development bias formed by superimposing a direct current electric field on an alternating electric field is applied across the developing sleeve 172 and the photosensitive member 169 by a bias power source 177 shown in FIG. 5. This facilitates the movement of the one-component non-magnetic developer from the surface of the developing sleeve 172 to the photosensitive member 169 to enable formation of images with a much better quality.

As process conditions in the present invention, where a usual transfer sheet (105 g/m2 or less in basis weight) is fed through, fixing speed may preferably be 100 to 700 mm/s in the case of black-and-white machines, and 100 to 400 mm/s in the case of full-color machines.

EXAMPLES

The present invention is described below by giving Examples. The present invention is by no means limited to these Examples. In the following, "part(s)" refers to "part(s) by weight".

Production Example 1 of Aromatic Carboxylic Acid Titanium Compound

Exemplary Compound 1 shown in Table 1 was produced in the following way. In a four-liter four-necked flask made of glass, to which a thermometer, a stirring rod, a condenser and a nitrogen feed pipe were attached and which was placed in a mantle heater, 65.3 parts of isophthalic acid and 18 parts of ethylene glycol were mixed, and these were dissolved at a temperature of 100° C., followed by dehydration under reduced pressure. Thereafter, after cooling to 50° C., 18.9 parts of titanium tetramethoxide was added in an atmosphere of nitrogen. Thereafter, the inside of the flask was evacuated and a reaction product methanol was evaporated off to obtain an aromatic carboxylic acid titanium compound, Exemplary Compound 1.

Production Example 2 of Aromatic Carboxylic Acid Titanium Compound

The procedure of Production Example 1 of Aromatic Carboxylic Acid Titanium Compound was repeated except that, in the above Production Example 1, 18.9 parts of the titanium tetramethoxide was changed for 35.8 parts of titanium tetra-n-butoxide. The butanol formed was evaporated off to obtain an aromatic carboxylic acid titanium compound, Exemplary Compound 6.

Production Example 3 of Aromatic Carboxylic Acid Titanium Compound

The procedure of Production Example 1 of Aromatic Carboxylic Acid Titanium Compound was repeated except that, in the above Production Example 1, the isophthalic acid was changed for terephthalic acid. The methanol formed was evaporated off to obtain an aromatic carboxylic acid titanium compound, Exemplary Compound 9.

Production Example 4 of Aromatic Carboxylic Acid Titanium Compound

The procedure of Production Example 1 of Aromatic Carboxylic Acid Titanium Compound was repeated except that, in the above Production Example 1, 65.3 parts of the isophthalic acid was changed for 62.1 parts of terephthalic acid, 18 parts of the ethylene glycol was changed for 10 parts of the same and 18.9 parts of the titanium tetramethoxide was changed for 21.6 parts of titanium tetraethoxide. The ethanol formed was evaporated off to obtain an aromatic carboxylic acid titanium compound, Exemplary Compound 10.

Production Example 5 of Aromatic Carboxylic Acid Titanium Compound

The procedure of Production Example 1 of Aromatic Carboxylic Acid Titanium Compound was repeated except that, in the above Production Example 3, 18.9 parts of the titanium tetramethoxide was changed for 29.3 parts of titanium tetra-n-propoxide. The propanol formed was evaporated off to obtain an aromatic carboxylic acid titanium compound, Exemplary Compound 12.

Production Example 6 of Aromatic Carboxylic Acid Titanium Compound

The procedure of Production Example 1 of Aromatic Carboxylic Acid Titanium Compound was repeated except that, in the above Production Example 3, 18.9 parts of the titanium tetramethoxide was changed for 35.8 parts of titanium tetra-n-butoxide. The butanol formed was evaporated off to obtain an aromatic carboxylic acid titanium compound, Exemplary Compound 14.

Production Example 7 of Aromatic Carboxylic Acid Titanium Compound

The procedure of Production Example 1 of Aromatic Carboxylic Acid Titanium Compound was repeated except that, in the above Production Example 3, 18 parts of the ethylene glycol was changed for 36 parts of the same and 18.9 parts of the titanium tetramethoxide was changed for 76.8 parts of tetra-n-butyl polytitanate. The butanol formed was evaporated off to obtain an aromatic carboxylic acid titanium compound, Exemplary Compound 16.

Production Example 8 of Aromatic Carboxylic Acid Titanium Compound

The procedure of Production Example 1 of Aromatic Carboxylic Acid Titanium Compound was repeated except that, in the above Production Example 1, 65.3 parts of the isophthalic acid was changed for 104.0 parts of trimellitic acid, 18 parts of the ethylene glycol was changed for 23 parts of the same and 18.9 parts of the titanium tetramethoxide was changed for 29.8 parts of titanium tetra-n-propoxide. The propanol formed was evaporated off to obtain an aromatic carboxylic acid titanium compound, Exemplary Compound 18.

Production Example 9 of Aromatic Carboxylic Acid Titanium Compound

The procedure of Production Example 1 of Aromatic Carboxylic Acid Titanium Compound was repeated except that, in the above Production Example 1, 65.3 parts of the isophthalic acid was changed for 108.4 parts of m-hydroxybenzoic acid, 18 parts of the ethylene glycol was changed for 36 parts of the same and 18.9 parts of the titanium tetramethoxide was changed for 35.1 parts of titanium tetra-n-butoxide. The butanol formed was evaporated off to obtain an aromatic carboxylic acid titanium compound, Exemplary Compound 22.

Production Example 10 of Aromatic Carboxylic Acid Titanium Compound

The procedure of Production Example 1 of Aromatic Carboxylic Acid Titanium Compound was repeated except that, in the above Production Example 1, 65.3 parts of the isophthalic acid was changed for 68.0 parts of p-hydroxybenzoic acid, 18 parts of the ethylene glycol was changed for 28 parts of the same and 18.9 parts of the titanium tetramethoxide was changed for 29.3 parts of titanium tetra-n-propoxide. The propanol formed was evaporated off to obtain an aromatic carboxylic acid titanium compound, Exemplary Compound 24.

Production Example 1 of Aromatic Diol Titanium Compound

In a four-liter four-necked flask made of glass, to which a thermometer, a stirring rod, a condenser and a nitrogen feed pipe were attached and which was placed in a mantle heater, 70.0 parts of a bisphenol-A ethylene oxide 2 mol addition product and 20 parts of ethylene glycol were mixed, and these were dissolved at a temperature of 100° C., followed by dehydration under reduced pressure. Thereafter, after cooling to 50° C., 17.2 parts of titanium tetramethoxide was added in an atmosphere of nitrogen. Thereafter, the inside of the flask was evacuated and a reaction product methanol was evaporated off to obtain Aromatic Diol Titanium Compound 1.

Polar-Resin Production Example 1

3.65 mols of polyoxypropylene (2.2)-2,2-bis(4-hydroxyphenyl)propane, 6.21 mols of isophthalic acid and 0.14 mol of trimellitic anhydride were weighed out. Then, 100 parts of a mixture of these acids and alcohol and 0.3 part of the above aromatic carboxylic acid titanium compound Exemplary Compound 1 were put into a four-liter four-necked flask made of glass, and a thermometer, a stirring rod, a condenser and a nitrogen feed pipe were attached thereto. This flask was placed in a mantle heater. In an atmosphere of nitrogen, the reaction was carried out at 220° C. At the time the acid value came to be 12 mgKOH/g, the heating was stopped to allow the reaction mixture to cool gradually to obtain Polar Resin 1 having a polyester unit. This resin had a hydroxyl value of 21 mgKOH/g, an Mw of 13,000, an Mn of 5,300 and a Tg of 65.8° C.

Polar-Resin Production Example 2

As materials for producing a vinyl copolymer, 1.1 mols of styrene, 0.14 mol of 1,2-ethylhexyl acrylate, 0.1 mol of acrylic acid and 0.05 mol of dicumyl peroxide were put into a dropping funnel. Also, 2.3 mols of polyoxypropylene (2.2)-2,2-bis(4-hydroxyphenyl)propane, 2.8 mols of polyoxyethylene (2.2)-2,2-bis(4-hydroxyphenyl)propane, 3.1 mols of terephthalic acid, 1.6 mols of isophthalic acid and 0.2 mol of trimellitic anhydride were weighed out. Then, 100 parts of a mixture of these acids and alcohols and 0.27 part of the above aromatic carboxylic acid titanium compound Exemplary Compound 1 were put into a four-liter four-necked flask made of glass, and a thermometer, a stirring rod, a condenser and a nitrogen feed pipe were attached thereto. This flask was placed in a mantle heater. Next, after the internal space of the flask was displaced with nitrogen gas, the temperature was gradually raised with stirring, where the monomers, cross-linking agent and polymerization initiator for a vinyl resin were dropwise added from the above dropping funnel over a period of 4 hours with stirring at a temperature of 145° C. Then, the temperature inside the flask was raised to 220° C., and the reaction was carried out for 5 hours to obtain Polar Resin 2 having a polyester unit. This resin had an acid value of 12 mgKOH/g, a hydroxyl value of 20 mgKOH/g, an Mw of 71,000, an Mn of 5,500 and a Tg of 66.8° C.

Polar-Resin Production Example 3

2.75 mols of polyoxypropylene (2.2)-2,2-bis(4-hydroxyphenyl)propane, 1.0 mol of polyoxyethylene (2.2)-2,2-bis(4-hydroxyphenyl)propane, 6.1 mols of isophthalic acid and 0.15 mol of trimellitic anhydride were weighed out. Then, 100 parts of a mixture of these acids and alcohols and 0.27 part of the aromatic carboxylic acid titanium compound Exemplary Compound 9 were put into a four-liter four-necked flask made of glass, and a thermometer, a stirring rod, a condenser and a nitrogen feed pipe were attached thereto. This flask was placed in a mantle heater. In an atmosphere of nitrogen, the reaction was carried out at 220° C. At the time the acid value came to be 14 mgKOH/g, the heating was stopped to allow the reaction mixture to cool gradually to obtain Polar Resin 3 having a polyester unit. This resin had a hydroxyl value of 21 mgKOH/g, an Mw of 14,000, an Mn of 5,400 and a Tg of 66.0° C.

Polar-Resin Production Example 4

Polar Resin 4 having a polyester unit was obtained in the same manner as in Polar-Resin Production Example 3 except that, in the above Production Example 3, in place of the aromatic carboxylic acid titanium compound Exemplary Compound 9, the aromatic carboxylic acid titanium compound Exemplary Compound 6 was used. The polyester unit component in the resin was in a content of 100% by weight. This resin had an acid value of 14 mgKOH/g, a hydroxyl value of 19 mgKOH/g, an Mw of 13,000, an Mn of 5,100 and a Tg of 66.6° C.

Polar-Resin Production Example 5

Polar Resin 5 having a polyester unit was obtained in the same manner as in Polar-Resin Production Example 3 except that, in the above Production Example 3, in place of the aromatic carboxylic acid titanium compound Exemplary Compound 9, the aromatic carboxylic acid titanium compound Exemplary Compound 14 was used. The polyester unit component in the resin was in a content of 100% by weight. This resin had an acid value of 14 mgKOH/g, a hydroxyl value of 20 mgKOH/g, an Mw of 14,000, an Mn of 5,200 and a Tg of 66.5° C.

Polar-Resin Production Example 6

Polar Resin 6 having a polyester unit was obtained in the same manner as in Polar-Resin Production Example 3 except that, in the above Production Example 3, in place of the aromatic carboxylic acid titanium compound Exemplary Compound 9, the aromatic carboxylic acid titanium compound Exemplary Compound 18 was used. The polyester unit component in the resin was in a content of 100% by weight. This resin had an acid value of 14 mgKOH/g, a hydroxyl value of 22 mgKOH/g, an Mw of 15,000, an Mn of 5,400 and a Tg of 66.9° C.

Polar-Resin Production Example 7

Polar Resin 7 having a polyester unit was obtained in the same manner as in Polar-Resin Production Example 3 except that, in the above Production Example 3, in place of the aromatic carboxylic acid titanium compound Exemplary Compound 9, the aromatic carboxylic acid titanium compound Exemplary Compound 22 was used. The polyester unit component in the resin was in a content of 100% by weight. This resin had an acid value of 14 mgKOH/g, a hydroxyl value of 23 mgKOH/g, an Mw of 14,000, an Mn of 5,100 and a Tg of 66.2° C.

Polar-Resin Production Example 8

Polar Resin 8 having a polyester unit was obtained in the same manner as in Polar-Resin Production Example 3 except that, in the above Production Example 3, in place of the aromatic carboxylic acid titanium compound Exemplary Compound 9, the aromatic carboxylic acid titanium compound Exemplary Compound 24 was used. The polyester unit component in the resin was in a content of 100% by weight. This resin had an acid value of 14 mgKOH/g, a hydroxyl value of 22 mgKOH/g, an Mw of 13,000, an Mn of 5,300 and a Tg of 65.8° C.

Polar-Resin Production Example 9

2.61 mols of polyoxypropylene (2.2)-2,2-bis(4-hydroxyphenyl)propane, 1.74 mols of polyoxyethylene (2.2)-2,2-bis(4-hydroxyphenyl)propane, 3.91 mols of fumaric acid and 1.74 mols of trimellitic anhydride were weighed out. Then, 100 parts of a mixture of these acids and alcohols, 0.3 part of the aromatic carboxylic acid titanium compound Exemplary Compound 9 and 0.05 part of titanium tetrachloride were put into a four-liter four-necked flask made of glass, and a thermometer, a stirring rod, a condenser and a nitrogen feed pipe were attached thereto. This flask was placed in a mantle heater. In an atmosphere of nitrogen, the reaction was carried out at 235° C. for 5 hours to obtain Polar Resin 9 having a polyester unit. This resin had an acid value of 10 mgKOH/g, a hydroxyl value of 18 mgKOH/g, an Mw of 34,000, an Mn of 3,200 and a Tg of 64.7° C.

Polar-Resin Production Example 10

Polar Resin 10 having a polyester unit was obtained in the same manner as in Polar-Resin Production Example 3 except that, in the above Production Example 3, in place of 0.27 parts of the aromatic carboxylic acid titanium compound Exemplary Compound 9, 0.15 parts of the aromatic carboxylic acid titanium compound Exemplary Compound 9 and 0.15 parts of the aromatic carboxylic acid titanium compound Exemplary Compound 1 were used. The polyester unit component in the resin was in a content of 100% by weight. This resin had an acid value of 14 mgKOH/g, a hydroxyl value of 23 mgKOH/g, an Mw of 11,000, an Mn of 4,900 and a Tg of 65.8° C.

Polar-Resin Production Example 11

Polar Resin 11 having a polyester unit was obtained in the same manner as in Polar-Resin Production Example 1 except that, in the above Production Example 1, the reaction was stopped at the time the acid value came to be 4 mgKOH/g. This resin had a hydroxyl value of 15 mgKOH/g, an Mw of 19,000, an Mn of 6,700 and a Tg of 65.7° C.

Polar-Resin Production Example 12

Polar Resin 12 having a polyester unit component was obtained in the same manner as in Polar-Resin Production Example 1 except that, in the above Production Example 1, the reaction was stopped at the time the acid value came to be 22 mgKOH/g. This resin had a hydroxyl value of 28 mgKOH/g, an Mw of 11,000, an Mn of 3,700 and a Tg of 66.3° C.

Polar-Resin Comparative Production Example 1

Comparative Polar Resin 1 having a polyester unit component was obtained in the same manner as in Polar-Resin Production Example 3 except that, in the above Production Example 3, in place of the aromatic carboxylic acid titanium compound Exemplary Compound 9, tetramethyl titanate was used. The polyester unit component in the resin was in a content of 100% by weight. This resin had an acid value of 14 mgKOH/g, a hydroxyl value of 18 mgKOH/g, an Mw of 13,000, an Mn of 5,200 and a Tg of 65.7° C.

Polar-Resin Comparative Production Example 2

Comparative Polar Resin 2 having a polyester unit component was obtained in the same manner as in Polar-Resin Production Example 3 except that, in the above Production Example 3, in place of the aromatic carboxylic acid titanium compound Exemplary Compound 9, dibutyltin oxide was used. The polyester unit component in the resin was in a content of 100% by weight. This resin had an acid value of 14 mgKOH/g, a hydroxyl value of 19 mgKOH/g, an Mw of 14,000, an Mn of 5,800 and a Tg of 67.6° C.

Polar-Resin Comparative Production Example 3

Comparative Polar Resin 3 having a polyester unit component was obtained in the same manner as in Polar-Resin Production Example 3 except that, in the above Production Example 3, the reaction was stopped at the time the acid value came to be 2 mgKOH/g. This resin had a hydroxyl value of 9 mgKOH/g, an Mw of 21,000, an Mn of 7,700 and a Tg of 66.7° C.

Polar-Resin Comparative Production Example 4

Comparative Polar Resin 4 having a polyester unit component was obtained in the same manner as in Polar-Resin Production Example 3 except that, in the above Production Example 3, the reaction was stopped at the time the acid value came to be 37 mgKOH/g. This resin had a hydroxyl value of 42 mgKOH/g, an Mw of 11,000, an Mn of 3,700 and a Tg of 66.7° C.

Polar-Resin Comparative Production Example 5

Comparative Polar Resin 5 having a polyester unit component was obtained in the same manner as in Polar-Resin Production Example 3 except that, in the above Production Example 3, in place of the aromatic carboxylic acid titanium compound Exemplary Compound 9, Aromatic Diol Titanium Compound 1 was used. This resin had an acid value of 14 mgKOH/g, a hydroxyl value of 19 mgKOH/g, an Mw of 14,000, an Mn of 4,000 and a Tg of 67.6° C.

Toner Production Example 1

Based on 100 parts of a styrene monomer, 15 parts of a cyan colorant copper phthalocyanine (IRGALITE Blue NGA, available from Ciba Speciality Chemicals INc.; C.I. Pigment Blue 15:3) and 2.0 parts of a di-tert-butylsalicylic acid aluminum compound (BONTRON E101, available from Orient Chemical Industries, Ltd.) were made ready for use. These were introduced into an attritor, and, using zirconia beads of 1.25 mm in diameter, agitated at 200 rpm at 25° C. for 180 minutes to prepare Master Batch Dispersion 1.

Meanwhile, into 710 g of ion-exchanged water, 450 parts of an aqueous 0.1M-Na3PO4 solution was introduced, followed by heating to 60° C. Thereafter, 67.7 parts of an aqueous 1.0M-CaCl2 solution was slowly added thereto to obtain an aqueous medium containing a calcium phosphate compound.

Next, the following materials were mixed and then heated to 60° C., followed by stirring to effect uniform dissolution and dispersion. In the mixture obtained, 3 parts of a polymerization initiator 2,2'-azobis(2,4-dimethylvaleronitrile) was dissolved. Thus, a polymerizable monomer composition was prepared.

| | |
|---|---|
| Master Batch Dispersion 1 | 50 parts |
| Styrene monomer | 35 parts |
| Butyl methacrylate monomer | 15 parts |
| Ester wax | 20 parts |
| (total number of carbon atoms: 34; half width: 4° C.; DSC endothermic peak: 72° C.; Mw: 800; Mn: 600; needle penetration: 6 degrees) | |
| Polar Resin 1 | 7 parts |
| (Mw: 13,000; Mn: 5,300; Tg: 65.8° C.; acid value: 12 mgKOH/g; hydroxyl value: 21 mgKOH/g) | |
| Divinylbenzene | 0.075 part |

Then, maintaining the above aqueous medium to pH 6, the polymerizable monomer composition was introduced thereinto, followed by stirring at 60° C. in an atmosphere of N2 for 10 minutes at 10,000 rpm using a homomixer to granulate the polymerizable monomer composition. Thereafter, this was moved to a reaction vessel, where, maintaining the aqueous medium to pH 6, the temperature was raised to 63° C. while stirring with a paddle agitating blade, and the reaction was carried out for 5 hours. With further addition of 1 part of potassium perphosphate, the temperature was raised to 80° C., and the reaction was carried out for 5 hours. After the polymerization reaction was completed, the reaction system was sufficiently vacuum-dried and then cooled. Thereafter, hydrochloric acid was added thereto to dissolve the calcium phosphate compound, followed by filtration, washing with water, drying in vacuo, and then classification by means of a multi-division classifier to obtain cyan toner base particles.

Based on 100 parts of the cyan toner base particles thus obtained, 1.3 parts of silicone-oil-treated hydrophobic fine silica particles having a BET specific surface area of 230 m2/g and 0.2 part of isobutyltrimethoxysilane-treated anatase type fine titanium oxide particles having a BET specific surface area of 110 m2/g were externally added by means of Henschel mixer, followed by removal of coarse particles by means of Turbo screener having a #400 mesh sieve to obtain a cyan non-magnetic toner Toner No. 1. This toner had a weight-average particle diameter of 6.7 μm, a TA value of 42 and a TB value of 61. Composition of Toner No. 1 obtained is shown in Table 2, and physical properties thereof in Table 3.

Toner Production Example 2

A cyan toner Toner No. 2 was obtained in the same manner as in Toner Production Example 1 except that, in the above Production Example 1, the polar resin was changed for Polar Resin 2 and was added in an amount of 10 parts. Composition of Toner No. 2 obtained is shown in Table 2, and physical properties thereof in Table 3.

Toner Production Example 3

A cyan toner Toner No. 3 was obtained in the same manner as in Toner Production Example 1 except that, in the above Production Example 1, the polar resin was changed for Polar Resin 3 and was added in an amount of 10 parts. Composition of Toner No. 3 obtained is shown in Table 2, and physical properties thereof in Table 3.

Toner Production Example 4

A cyan toner Toner No. 4 was obtained in the same manner as in Toner Production Example 1 except that, in the above Production Example 1, the polar resin was changed for Polar Resin 4. Composition of Toner No. 4 obtained is shown in Table 2, and physical properties thereof in Table 3.

Toner Production Example 5

A cyan toner Toner No. 5 was obtained in the same manner as in Toner Production Example 1 except that, in the above Production Example 1, the polar resin was changed for Polar Resin 5 and was added in an amount of 23 parts and a release agent was added in an amount of 20 parts. Composition of Toner No. 5 obtained is shown in Table 2, and physical properties thereof in Table 3.

Toner Production Example 6

A cyan toner Toner No. 6 was obtained in the same manner as in Toner Production Example 1 except that, in the above Production Example 1, the polar resin was changed for Polar Resin 6. Composition of Toner No. 6 obtained is shown in Table 2, and physical properties thereof in Table 3.

Toner Production Example 7

A cyan toner Toner No. 7 was obtained in the same manner as in Toner Production Example 1 except that, in the above Production Example 1, the polar resin was changed for Polar Resin 7. Composition of Toner No. 7 obtained is shown in Table 2, and physical properties thereof in Table 3.

Toner Production Example 8

A cyan toner Toner No. 8 was obtained in the same manner as in Toner Production Example 1 except that, in the above Production Example 1, the polar resin used was changed for Polar Resin 8. Composition of Toner No. 8 obtained is shown in Table 2, and physical properties thereof in Table 3.

Toner Production Example 9

A cyan toner Toner No. 9 was obtained in the same manner as in Toner Production Example 1 except that, in the above Production Example 1, the polar resin was changed for Polar Resin 9. Composition of Toner No. 9 obtained is shown in Table 2, and physical properties thereof in Table 3.

Toner Production Example 10

A cyan toner Toner No. 10 was obtained in the same manner as in Toner Production Example 1 except that, in the above Production Example 1, the polar resin was changed for Polar Resin 10. Composition of Toner No. 10 obtained is shown in Table 2, and physical properties thereof in Table 3.

Toner Production Example 11

A cyan toner Toner No. 11 was obtained in the same manner as in Toner Production Example 1 except that, in the above Production Example 1, the polar resin was changed for Polar Resin 11. Composition of Toner No. 11 obtained is shown in Table 2, and physical properties thereof in Table 3.

Toner Production Example 12

A cyan toner Toner No. 12 was obtained in the same manner as in Toner Production Example 1 except that, in the above Production Example 1, the polar resin was changed for Polar Resin 12. Composition of Toner No. 12 obtained is shown in Table 2, and physical properties thereof in Table 3.

Toner Production Example 13

In Toner Production Example 11, the aqueous 0.1M-Na3PO4 solution in producing the aqueous medium was used in an amount changed to 520 parts. Also, the number of revolutions of the homomixer in producing the toner base particles was changed to 11,500 rpm, and further the classification conditions of the multi-division classifier in carrying out the classification were changed. Also, the hydrophobic silica and the hydrophobic titanium oxide were externally added to the toner base particles in amounts changed to 1.5 parts and 0.3 part, respectively. Except that these production conditions were changed, a cyan toner Toner No. 13 with a weight-average particle diameter of 4.9 μm (content of particles of 4 μm or less: 49.0% by number; content of particles of 12.7 μm or more: 0% by volume) was obtained in the same manner as in the above Production Example 11. Composition of Toner No. 13 obtained is shown in Table 2, and physical properties thereof in Table 3.

Toner Production Example 14

A cyan toner Toner No. 14 with a weight-average particle diameter of 9.2 μm (particles of 4 μm or less: 8.0% by number; content of particles of 12.7 μm or more: 2.1% by volume) was obtained in the same manner as in Toner Production Example 12 except that, in the above Production Example 12, the hydrophobic silica and the hydrophobic titanium oxide were added to the toner base particles in amounts changed to 0.7 part and 0.1 part, respectively. Composition of Toner No. 14 obtained is shown in Table 2, and physical properties thereof in Table 3.

Toner Production Example 15

A cyan toner Toner No. 15 with a weight-average particle diameter of 6.5 μm was obtained in the same manner as in Toner Production Example 11 except that, in the above Production Example 11, the ester wax was added to the toner base particles in an amount of 40 parts and the hydrophobic silica and the hydrophobic titanium oxide were added to the toner base particles in amounts changed to 1.8 parts and 0.5 part, respectively. Composition of Toner No. 15 obtained is shown in Table 2, and physical properties thereof in Table 3.

Toner Production Example 16

A cyan toner Toner No. 16 with a weight-average particle diameter of 6.6 μm was obtained in the same manner as in Toner Production Example 14 except that, in the above Production Example 14, the ester wax was added to the toner base particles in an amount of 3 parts and the hydrophobic silica and the hydrophobic titanium oxide were added to the toner base particles in amounts changed to 1.3 parts and 0.2 part, respectively. Composition of Toner No. 16 obtained is shown in Table 2, and physical properties thereof in Table 3.

Toner Production Example 17

A cyan toner Toner No. 17 with a weight-average particle diameter of 6.5 μm was obtained in the same manner as in Toner Production Example 16 except that, in the above Production Example 16, the hydrophobic silica and the hydrophobic titanium oxide were added to the toner base particles in amounts changed to 1.5 parts and 0.3 part, respectively. Composition of Toner No. 17 obtained is shown in Table 2, and physical properties thereof in Table 3.

Toner Production Example 18

A cyan toner Toner No. 18 with a weight-average particle diameter of 6.6 μm was obtained in the same manner as in Toner Production Example 16 except that, in the above Production Example 16, the hydrophobic silica and the hydrophobic titanium oxide were added to the toner base particles in amounts changed to 1.8 parts and 0.4 part, respectively. Composition of Toner No. 18 obtained is shown in Table 2, and physical properties thereof in Table 3.

Magnetic Material Production Example

In an aqueous ferrous sulfate solution, a sodium hydroxide solution and sodium silicate were mixed in an equivalent weight of from 1.0 to 1.1 based on iron ions to prepare an aqueous solution which contained ferrous hydroxide. Maintaining the pH of the aqueous solution at about 9, air was blown into it to effect oxidation at 80 to 90° C. to prepare a slurry fluid from which seed crystals were to be formed. Subsequently, to this slurry fluid, an aqueous ferrous sulfate solution was so added as to be in an equivalent weight of from 0.9 to 1.2 based on the initial alkali content (the sodium component in the sodium hydroxide). Thereafter, maintaining the pH of the slurry fluid at 8, oxidation reaction was carried on while air was blown into it. Magnetic iron oxide particles thus formed as a result of the oxidation reaction were washed, filtered and then taken out first. Here, a water-containing sample was collected in a small quantity, and its water content was beforehand measured.

Then, this water-containing sample was, without being dried, re-dispersed in another aqueous medium. Thereafter, the pH of the re-dispersion formed was adjusted to about 6, and then a silane coupling agent [n-C10H21Si(OCH3)3] was added thereto with thorough stirring, in an amount of 1.2 parts based on the weight of magnetic iron oxide (the weight of magnetic iron oxide was calculated as a value obtained by subtracting the water content from the water-containing sample) to carry out coupling treatment. Next, fine-particle component was removed by classification carried out by wet-process classification making use of precipitation separation. The hydrophobic iron oxide particles thus obtained were washed, filtered and then dried by conventional methods, followed by disintegration treatment of particles standing a little agglomerate, to obtain Magnetic Material 1.

Toner Production Example 19

Into 710 g of ion-exchanged water, 450 parts of an aqueous 0.1M-Na3PO4 solution was introduced, followed by heating to 60° C. Thereafter, 67.7 parts of an aqueous 1.0M-CaCl2 solution was slowly added thereto to obtain an aqueous medium containing a calcium phosphate compound.

| | |
|---|---|
| Styrene | 77 parts |
| n-Butyl acrylate | 23 parts |
| Ester wax (total number of carbon atoms: 34; half width: 4° C.; DSC endothermic peak: 70° C.; Mw: 800; Mn: 600; needle penetration: 6 degrees) | 17 parts |
| Polar Resin 1 (Mw: 13,000; Mn: 5,300; Tg: 65.7° C.; acid value: 12 mgKOH/g; hydroxyl value: 21 mgKOH/g) | 7 parts |
| Divinylbenzene | 0.075 part |
| Di-tert-butylsalicylic acid aluminum compound (BONTRON E101, available from Orient Chemical Industries, Ltd.) | 1 part |
| Magnetic Material 1 | 100 parts |

The above materials were added to the above aqueous medium, having been heated to 60° C., followed by stirring to effect uniform dissolution and dispersion. In the mixture obtained, 3 parts of a polymerization initiator 2,2'-azobis(2,4-dimethylvaleronitrile) was dissolved. Thus, a polymerizable monomer composition was prepared. Except for this, toner base particles were obtained in the same manner as in Toner Production Example 1. To the toner base particles thus obtained, the same hydrophobic silica and hydrophobic titanium oxide as those used in Toner Production Example 1 were added in amounts of 1.3 parts and 0.05 part, respectively, to obtain Toner No. 19. Composition of Toner No. 19 obtained is shown in Table 2, and physical properties thereof in Table 3.

Toner Production Example 20

Preparation of Dispersion (A):

| | |
|---|---|
| Polar Resin 5 | 50 parts |
| Methylene chloride | 100 parts |

The above materials were mixed and dissolved by means of a ball mill, and the solution obtained was dispersed in 155 parts of pure water containing 10% by weight of polyethylene glycol and 0.7% by weight of a cationic surface-active agent (SANISOL B-50, available from Kao Corporation), which were dispersed applying a shear force strongly by means of a rotor-stator type homogenizer (ULTRA-TURRAX, manufactured by IKA K.K.). The fluid dispersion formed was heated to 62° C., and was kept thereat for 1 hour, to obtain Dispersion (A).

Preparation of Colorant Dispersion (B):

| | |
|---|---|
| Copper phthalocyanine pigment (PV FAST BLUE, available from BASF Corp.) | 90 parts |
| Anionic surface-active agent (NEOGEN SC, available from Dai-ichi Kogyo Seiyaku Co., Ltd.) | 5 parts |
| Ion-exchanged water | 200 parts |
| Di-tert-butylsalicylic acid aluminum compound (BONTRON E101, available from Orient Chemical Industries, Ltd.) | 10 parts |

The above materials were mixed and dissolved, and the solution obtained was subjected to dispersion for 10 minutes by means of a rotor-stator type homogenizer (ULTRA-TURRAX, manufactured by IKA K.K.). The fluid dispersion formed was further subjected to dispersion for 5 minutes by means of an ultrasonic homogenizer to obtain Colorant Dispersion (B).

Preparation of Release Agent Dispersion (C):

| | |
|---|---|
| Polypropylene wax (half width: 22° C.; DSC endothermic peak: 129° C.; Mw: 17,000; Mn: 1,350; needle penetration: 0.5 degree) | 5 parts |
| Cationic surface-active agent (SANISOL B-50, available from Kao Corporation) | 5 parts |
| Ion-exchanged water | 200 parts |

The above materials were heated to 95° C., and were subjected to dispersion by means of a homogenizer (ULTRA-TURRAX T50, manufactured by IKA K.K.), followed by further dispersion by means of a pressure ejection type homogenizer to obtain Release Agent Dispersion (C).

Preparation of Agglomerated Particles:

| | |
|---|---|
| Dispersion (A) | 200 parts |
| Colorant Dispersion (B) | 10 parts |
| Release Agent Dispersion (C) | 30 parts |
| Cationic surface-active agent (SANISOL B50, available from Kao Corporation) | 2 parts |

The above materials were mixed in a round flask made of stainless steel, by means of a homogenizer (ULTRA-TURRAX T50, manufactured by IKA K.K.) to effect dispersion. Thereafter, the fluid dispersion formed was heated to 48° C. using a heating oil bath while the contents in the flask were stirred. This was kept at 48° C. for 30 minutes to obtain agglomerated particles.

Preparation of Adhesion Particles:

To the flask holding the agglomerated particles, 5 parts of Colorant Dispersion (B) was gently added, and further the temperature of the heating oil bath was raised to 50° C., and was kept thereat for 30 minutes. Its temperature was further raised to 52° C., and was kept thereat for 1 hour.

Thereafter, to the interior of the above flask, 2 parts of an anionic surface-active agent (NEOGEN SC, available from Dai-ichi Kogyo Seiyaku Co., Ltd.) was added, and thereafter the flask made of stainless steel was hermetically closed, where stirring was continued using magnetic shielding. Then, the reaction mixture was heated to 110° C., and was kept thereat for 3 hours. After cooling, the reaction product was filtered and then sufficiently washed with ion-exchanged water to obtain toner base particles. To the toner base particles thus obtained, hydrophobic silica and hydrophobic titanium oxide were added in the same manner as in Toner Production Example 1 to obtain Toner No. 20. Composition of Toner No. 20 obtained is shown in Table 2, and physical properties thereof in Table 3.

Toner Production Example 21

Mixing Step:

The following materials were subjected to dispersion for 24 hours by means of a ball mill to obtain 200 parts of a toner composition fluid mixture in which Polar Resin 5 stood dispersed.

| | |
|---|---|
| Polar Resin 5 | 85 parts |
| C.I. Pigment Blue 15:3 | 6.5 parts |
| Polypropylene wax (half width: 22° C.; DSC endothermic peak: 129° C.; Mw: 17,000; Mn: 1,350; needle penetration: 0.5 degree) | 7.5 parts |
| Di-tert-butylsalicylic acid aluminum compound (BONTRON E101, available from Orient Chemical Industries, Ltd.) | 1 part |
| Ethyl acetate (solvent) | 100 parts |

Dispersion Suspension Step:

The following materials were subjected to dispersion for 24 hours by means of a ball mill to dissolve carboxymethyl cellulose to obtain an aqueous medium.

| | |
|---|---|
| Calcium carbonate (coated with an acrylic-acid type copolymer) | 20 parts |
| Carboxymethyl cellulose (trade name: CELLOGEN BS-H, available from Dai-ichi Kogyo Seiyaku Co., Ltd.) | 0.5 part |
| Ion-exchanged water | 99.5 parts |

1,200 parts of the aqueous medium obtained was put into TK homomixer, and was stirred rotating a rotary blade at a peripheral speed of 20 m/sec, during which 1,000 parts of the above toner composition fluid mixture was introduced. These were stirred for 1 minute maintaining the temperature to 25° C. constantly, to obtain a suspension.

Solvent Removal Step:

2,200 parts of the suspension obtained in the dispersion suspension step was stirred by means of a Full-zone blade (manufactured by Shinko Pantec Co., Ltd.) at a peripheral speed of 45 m/min, during which, keeping the temperature at 40° C. constantly, the gaseous phase on the suspension was forcedly renewed using a blower to start to remove the solvent. In that course, after 15 minutes from the start of solvent removal, 75 parts of ammonia water diluted to 1% was added as an ionic substance. Subsequently, after 1 hour from the start of solvent removal, 25 parts of the ammonia water was added. Further, after 2 hours from the start of solvent removal, 25 parts of the ammonia water was added. Finally, after 3 hours from the start of solvent removal, 25 parts of the ammonia water was added; 150 parts of the ammonia water being added in total. Further, keeping the temperature at 40° C., the system was held for 17 hours from the start of solvent removal. Thus, a toner dispersion was obtained in which the solvent (ethyl acetate) was removed form suspended particles.

Washing and Dehydration Step:

To 300 parts of the toner dispersion obtained in the solvent removal step, 80 parts of 10 mol/l hydrochloric acid was added, followed by further addition of an aqueous 0.1 mol/l sodium hydroxide solution to effect neutralization treatment. Thereafter, washing with ion-exchanged water by suction filtration was repeated four times to obtain a toner cake.

Drying and Sifting Step:

The toner cake obtained as described above was dried by means of a vacuum dryer, followed by sifting through a 45-mesh sieve to obtain toner base particles. To the toner base particles thus obtained, hydrophobic silica and hydrophobic titanium oxide were added in the same manner as in Toner Production Example 1 to obtain Toner No. 21. Composition of Toner No. 21 obtained is shown in Table 2, and physical properties thereof in Table 3.

Toner Production Example 22

A yellow toner Toner No. 22 was obtained in the same manner as in Toner Production Example 1 except that, in the above Production Example 1, in place of C.I. Pigment Blue 15:3 C.I. Pigment Yellow 93 (CROMOPHTAL Yellow 3G, available from Ciba Speciality Chemicals INc.) was used in an amount of 15 parts. Composition of Toner No. 22 obtained is shown in Table 2, and physical properties thereof in Table 3.

Toner Production Example 23

A magenta toner Toner No. 23 was obtained in the same manner as in Toner Production Example 1 except that, in the above Production Example 1, in place of C.I. Pigment Blue 15:3 dimethylquinacridone (HOSTAPERM PNK E-WD, available from Clariant (Japan) K.K.) was used in an amount of 15 parts. Composition of Toner No. 23 obtained is shown in Table 2, and physical properties thereof in Table 3.

Toner Production Example 24

A black toner Toner No. 24 was obtained in the same manner as in Toner Production Example 1 except that, in the above Production Example 1, in place of C.I. Pigment Blue 15:3 carbon black (PRINTEX 35, available from Degussa Corp.) was used in an amount of 15 parts. Composition of Toner No. 24 obtained is shown in Table 2, and physical properties thereof in Table 3.

Magnetic-Carrier Production Example 1

| | |
|---|---|
| Phenol (hydroxybenzene) | 50 parts |
| Aqueous 37% by weight formaldehyde solution (formalin) | 80 parts |
| Water | 50 parts |
| Alumina-containing fine magnetite particles surface-treated with a silane coupling agent having an epoxy group, KBM403 (available from Shin-Etsu Chemical Co., Ltd.) (number-average particle diameter: 0.22 μm; resistivity: 4 × 105 Ωcm) | 280 parts |
| Fine α-Fe2O3 particles surface-treated with KBM403 (number-average particle diameter: 0.40 μm; resistivity: 8 × 109 Ωcm) | 120 parts |
| 25% by weight Ammonia water | 15 parts |

The above materials were put into a four-necked flask, and were stirred and mixed, during which the mixture was heated to 85° C. over a period of 60 minutes and was held at that temperature, where the reaction was carried out for 120 minutes, followed by curing. Thereafter, the reaction mixture was cooled to 30° C., and 500 parts of water was added thereto. Then, the supernatant formed was removed, and the precipitate formed was washed with water, followed by air drying. Subsequently, this was vacuum-dried for 24 hours to obtain Magnetic Carrier Cores (A), having a phenolic resin as a binder resin. On Magnetic Carrier Cores (A), 0.4% by weight of adsorbed water was present after their leaving for 24 hours in an environment of 30° C./80% RH (relative humidity).

Magnetic Carrier Cores (A) obtained were surface-coated with a toluene solution of 5% by weight of γ-aminopropyltrimethoxysilane, represented by the following formula:

NH2-CH2CH2CH2-Si—(OCH3)3

As the result, Magnetic Carrier Cores (A) stood surface-treated with 0.3% by weight of γ-aminopropyltrimethoxysilane. During the coating, the toluene was evaporated applying a shear force continuously to Magnetic Carrier Cores (A).

The γ-aminopropyltrimethoxysilane was also added to a silicone resin KR-221 (available from Shin-Etsu Chemical Co., Ltd.) in an amount of 4% by weight based on the silicone resin solid content, and the mixture obtained was diluted with toluene so as to be in a concentration of 25% as the silicone resin solid content. The above Magnetic Carrier Cores (A) having been treated with the silane coupling agent in the treating machine were stirred at 70° C., during which the dilute solution of silicone resin and γ-aminopropyltrimethoxysilane thus obtained was added under reduced pressure to coat the carrier cores with the resin. Thereafter, the coated carrier cores were agitated for 2 hours, and then heat-treated at 140° C. for 2 hours in an atmosphere of nitrogen gas. After agglomerates were loosened, coarse particles of 200 meshes or more were removed to obtain Magnetic Carrier 1.

Magnetic Carrier 1 thus obtained had an average particle diameter of 35 μm, a resistivity of 1×1013 Ωcm, an intensity of magnetization at 1 kOe (σ1000) of 40 Am2/kg, an apparent density of 1.9 g/cm3 and an SF-1 of 107.

Magnetic-Carrier Production Example 2

14.0 mol % of Li2O3, 77.0 mol % of Fe2O3, 6.8 mol % of Mg(OH)2 and 2.2 mol % of CaCO3 were pulverized and mixed by means of a wet-process ball mill, followed by drying. After dried, this was held at 900° C. for 1 hour to effect calcination. The resultant calcined product was pulverized for 7 hours into particles of 3 μm or less in diameter by means of the wet-process ball mill. To the resultant slurry of the calcined product, a dispersant and a binder were added in appropriate quantities, followed by granulation and drying by means of a spray dryer. The granulated product obtained was held at 1,240° C. for 4 hours in an electric furnace to carry out main firing. Thereafter, the fired product was disintegrated, and was further classified to obtain Magnetic Carrier 2, formed of ferrite particles of 40 μm in average particle diameter.

Toner & Developer Production Example 25

A cyan toner Toner No. 25 with a weight-average particle diameter of 6.7 μm was obtained in the same manner as in Toner Production Example 1 except that, in the above Production Example 1, the hydrophobic silica and the hydrophobic titanium oxide were added in amounts changed to 1.0 part and 0.4 part, respectively. Composition of Toner No. 25 obtained is shown in Table 2, and physical properties thereof in Table 3. This toner was also blended with Magnetic Carrier 1 so as to be in a toner concentration of 8% by weight to make up Developer 25.

Toner & Developer Production Example 26

A yellow toner Toner No. 26 with a weight-average particle diameter of 6.6 μm was obtained in the same manner as in Toner Production Example 22 except that, in the above Production Example 22, the hydrophobic silica and the hydrophobic titanium oxide were added in amounts changed to 1.0 part and 0.4 part, respectively. Composition of Toner No. 26 obtained is shown in Table 2, and physical properties thereof in Table 3. This toner was also blended with Magnetic Carrier 1 so as to be in a toner concentration of 8% by weight to make up Developer 26.

Toner & Developer Production Example 27

A magenta toner Toner No. 27 with a weight-average particle diameter of 6.8 μm was obtained in the same manner as in Toner Production Example 23 except that, in the above Production Example 23, the hydrophobic silica and the hydrophobic titanium oxide were added in amounts changed to 1.0 part and 0.4 part, respectively. Composition of Toner No. 27 obtained is shown in Table 2, and physical properties thereof in Table 3. This toner was also blended with Magnetic Carrier 1 so as to be in a toner concentration of 8% by weight to make up Developer 27.

Toner & Developer Production Example 28

A black toner Toner No. 28 with a weight-average particle diameter of 6.8 μm was obtained in the same manner as in Toner Production Example 24 except that, in the above Production Example 24, the hydrophobic silica and the hydrophobic titanium oxide were added in amounts changed to 1.0 part and 0.4 part, respectively. Composition of Toner No. 28 obtained is shown in Table 2, and physical properties thereof in Table 3. This toner was also blended with Magnetic Carrier 1 so as to be in a toner concentration of 8% by weight to make up Developer 28.

Toner Production Example 29

Toner No. 29 was obtained in the same manner as in Toner Production Example 3 except that, in the above Production Example 3, the release agent was changed for an ester wax having an endothermic peak temperature of 48° C. Composition of Toner No. 29 obtained is shown in Table 4, and physical properties thereof in Table 5.

Toner Production Example 30

Toner No. 30 was obtained in the same manner as in Toner Production Example 3 except that, in the above Production Example 3, the release agent was changed for a polyethylene wax having an endothermic peak temperature of 124° C. Composition of Toner No. 30 obtained is shown in Table 4, and physical properties thereof in Table 5.

Toner Production Example 31

Toner No. 31 was obtained in the same manner as in Toner Production Example 1 except that, in the above Production Example 1, the di-tert-butylsalicylic acid aluminum compound was not used. Composition of Toner No. 31 obtained is shown in Table 4, and physical properties thereof in Table 5.

Toner Production Example 32

Toner No. 32 was obtained in the same manner as in Toner Production Example 1 except that, in the above Production Example 1, in place of the di-tert-butylsalicylic acid aluminum compound a di-tert-butylsalicylic acid zirconium compound (TN105, available from Hodogaya Chemical Co., Ltd.) was used. Composition of Toner No. 32 obtained is shown in Table 4, and physical properties thereof in Table 5.

Toner Production Example 33

Toner No. 33 was obtained in the same manner as in Toner Production Example 1 except that, in the above Production Example 1, in place of the di-tert-butylsalicylic acid aluminum compound a di-tert-butylsalicylic acid zinc compound (BONTRON E84, available from Orient Chemical Industries, Ltd.) was used. Composition of Toner No. 33 obtained is shown in Table 4, and physical properties thereof in Table 5.

Toner Production Example 34

Toner No. 34 was obtained in the same manner as in Toner Production Example 21 except that, in the above Production Example 21, the composition of the toner composition fluid mixture was changed as shown below. Composition of Toner No. 34 obtained is shown in Table 4, and physical properties thereof in Table 5.

| | |
|---|---|
| Polar Resin 5 | 47 parts |
| Magnetic Material 1 | 47 parts |
| Polypropylene wax (half width: 22° C.; DSC endothermic peak: 129° C.; Mw: 17,000; Mn: 1,350; needle penetration: 0.5 degree) | 5 parts |
| Di-tert-butylsalicylic acid aluminum compound (BONTRON E101, available from Orient Chemical Industries, Ltd.) | 1 part |
| Ethyl acetate (solvent) | 100 parts |

Toner Comparative Production Example 1

Toner base particles were obtained in the same manner as in Toner Production Example 1 except that, in the above Production Example 1, in place of Polar Resin 1 Comparative Polar Resin 1 was used, and the ester wax as a release agent was changed for polypropylene wax (half width: 22° C.; DSC endothermic peak: 129° C.; Mw: 17,000; Mn: 1,350; needle penetration: 0.5 degree) added in an amount of 2.5 parts. To the toner base particles obtained, only the hydrophobic silica as used in Toner Production Example 1 was added in an amount of 0.9 part to obtain Comparative Toner No. 1. Composition of Comparative Toner No. 1 obtained is shown in Table 4, and physical properties thereof in Table 3.

Toner Comparative Production Examples 2 to 5

Comparative Toners No. 2 to No. 5 were obtained in the same manner as in Toner Comparative Production Example 1 except that, in the above Comparative Production Example 1, in place of Comparative Polar Resins 1 Comparative Polar Resins 2 to 5, respectively, were used. Composition of each of Comparative Toners No. 2 to No. 5 obtained is shown in Table 4, and physical properties thereof in Table 5.

Toner Comparative Production Example 6

In Toner Production Example 1, the aqueous 0.1M-Na3PO4 solution in producing the aqueous medium was used in an amount changed to 600 parts. Also, the polar resin of the toner was changed for Polar Resin 11, the number of revolutions of the homomixer in producing the toner base particles was changed to 13,000 rpm, and further the classification conditions of the multi-division classifier in carrying out the classification were changed. Also, the hydrophobic silica was externally added to the toner base particles in an amount changed to 1.1 parts. Except that these production conditions were changed, a cyan toner Comparative Toner No. 6 with a weight-average particle diameter of 3.2 μm (content of particles of 4 μm or less: 63.0% by number; content of particles of 12.7 μm or more: 0% by volume) was obtained in the same manner as in the above Production Example 1. Composition of Comparative Toner No. 6 obtained is shown in Table 4, and physical properties thereof in Table 5.

Toner Comparative Production Example 7

In Toner Comparative Production Example 1, the aqueous 0.1M-Na3PO4 solution in producing the aqueous medium was used in an amount changed to 190 parts. Also, the polar resin of the toner was changed for Polar Resin 12, the number of revolutions of the homomixer in producing the toner base particles was changed to 4,300 rpm, and further the classification conditions of the multi-division classifier in carrying out the classification were changed. Also, the hydrophobic silica was externally added to the toner base particles in an amount changed to 0.7 part. Except that these production conditions were changed, a cyan toner Comparative Toner No. 7 with a weight-average particle diameter of 10.7 μm (content of particles of 4 μm or less: 2.7% by number; content of particles of 12.7 μm or more: 3.4% by volume) was obtained in the same manner as in the above Production Example 1. Composition of Comparative Toner No. 7 obtained is shown in Table 4, and physical properties thereof in Table 5.

Toner Comparative Production Example 8

A cyan toner Comparative Toner No. 8 was obtained in the same manner as in Toner Production Example 20 except that, in the above Production Example 20, the polar resin was not used and, to the toner base particles obtained, only the hydrophobic silica was added in an amount of 0.9 part. Composition of Comparative Toner No. 8 obtained is shown in Table 4, and physical properties thereof in Table 5.

TABLE 2

| Developer Composition | | | | | | | | | | | | | |
|---|---|---|---|---|---|---|---|---|---|---|---|---|---|
| | | | Toner particles | | | | | | | | | | |
| | | | Release agent | | | | | | | | | | |
| | | | Polar resin | | | Content in | | Charge control | | Inorganic fine particles | | | |
| Developer No. | Toner No. | Carrier No. | No. | Acid val. | Type | toner (wt. %) | Colorant Type | agent Type | Produced by: | Type 1 | Amt. (pbw) | Type 2 | Amt. (pbw) |
| 1 | 1 | — | 1 | 12 | Est.Wx | 15.7 | Cu Pc. | Sal.Al | Sus.P. | Hpho.Si | 1.3 | Hpho.Ti | 0.2 |
| 2 | 2 | — | 2 | 12 | Est.Wx | 15.4 | Cu Pc. | Sal.Al | Sus.P. | Hpho.Si | 1.3 | Hpho.Ti | 0.2 |
| 3 | 3 | — | 3 | 14 | Est.Wx | 15.4 | Cu Pc. | Sal.Al | Sus.P. | Hpho.Si | 1.3 | Hpho.Ti | 0.2 |
| 4 | 4 | — | 4 | 14 | Est.Wx | 15.7 | Cu Pc. | Sal.Al | Sus.P. | Hpho.Si | 1.3 | Hpho.Ti | 0.2 |
| 5 | 5 | — | 5 | 14 | Est.Wx | 14.0 | Cu Pc. | Sal.Al | Sus.P. | Hpho.Si | 1.3 | Hpho.Ti | 0.2 |
| 6 | 6 | — | 6 | 14 | Est.Wx | 15.7 | Cu Pc. | Sal.Al | Sus.P. | Hpho.Si | 1.3 | Hpho.Ti | 0.2 |
| 7 | 7 | — | 7 | 14 | Est.Wx | 15.7 | Cu Pc. | Sal.Al | Sus.P. | Hpho.Si | 1.3 | Hpho.Ti | 0.2 |
| 8 | 8 | — | 8 | 14 | Est.Wx | 15.7 | Cu Pc. | Sal.Al | Sus.P. | Hpho.Si | 1.3 | Hpho.Ti | 0.2 |
| 9 | 9 | — | 9 | 10 | Est.Wx | 15.7 | Cu Pc. | Sal.Al | Sus.P. | Hpho.Si | 1.3 | Hpho.Ti | 0.2 |
| 10 | 10 | — | 10 | 14 | Est.Wx | 15.7 | Cu Pc. | Sal.Al | Sus.P. | Hpho.Si | 1.3 | Hpho.Ti | 0.2 |
| 11 | 11 | — | 11 | 4 | Est.Wx | 15.7 | Cu Pc. | Sal.Al | Sus.P. | Hpho.Si | 1.3 | Hpho.Ti | 0.2 |
| 12 | 12 | — | 12 | 22 | Est.Wx | 15.7 | Cu Pc. | Sal.Al | Sus.P. | Hpho.Si | 1.3 | Hpho.Ti | 0.2 |
| 13 | 13 | — | 11 | 4 | Est.Wx | 15.7 | Cu Pc. | Sal.Al | Sus.P. | Hpho.Si | 1.5 | Hpho.Ti | 0.3 |
| 14 | 14 | — | 12 | 22 | Est.Wx | 15.7 | Cu Pc. | Sal.Al | Sus.P. | Hpho.Si | 0.7 | Hpho.Ti | 0.1 |
| 15 | 15 | — | 11 | 4 | Est.Wx | 27.2 | Cu Pc. | Sal.Al | Sus.P. | Hpho.Si | 1.8 | Hpho.Ti | 0.5 |
| 16 | 16 | — | 12 | 22 | Est.Wx | 2.7 | Cu Pc. | Sal.Al | Sus.P. | Hpho.Si | 1.3 | Hpho.Ti | 0.2 |
| 17 | 17 | — | 12 | 22 | Est.Wx | 2.7 | Cu Pc. | Sal.Al | Sus.P. | Hpho.Si | 1.5 | Hpho.Ti | 0.3 |
| 18 | 18 | — | 12 | 22 | Est.Wx | 2.7 | Cu Pc. | Sal.Al | Sus.P. | Hpho.Si | 1.8 | Hpho.Ti | 0.4 |
| 19 | 19 | — | 1 | 12 | Est.Wx | 7.6 | Magnt. | Sal.Al | Sus.P. | Hpho.Si | 1.3 | Hpho.Ti | 0.05 |
| 20 | 20 | — | 5 | 22 | PP Wx | 6.7 | Cu Pc. | Sal.Al | Eml.P. | Hpho.Si | 1.3 | Hpho.Ti | 0.2 |
| 21 | 21 | — | 5 | 14 | PP Wx | 7.5 | Cu Pc. | Sal.Al | Sus.G. | Hpho.Si | 1.3 | Hpho.Ti | 0.2 |
| 22 | 22 | — | 1 | 12 | Est.Wx | 15.7 | PY93 | Sal.Al | Sus.P. | Hpho.Si | 1.3 | Hpho.Ti | 0.2 |

TABLE 2-continued

| Developer No. | Toner No. | Carrier No. | Developer Composition: Toner particles: Polar resin: No. | Polar resin: Acid val. | Polar resin: Type | Release agent: Content in toner (wt. %) | Release agent: Type | Charge control agent Type | Charge control agent Produced by: | Inorganic fine particles: Type 1 | Inorganic fine particles: Amt. (pbw) | Inorganic fine particles: Type 2 | Inorganic fine particles: Amt. (pbw) |
|---|---|---|---|---|---|---|---|---|---|---|---|---|---|
| 23 | 23 | — | 1 | 12 | Est.Wx | 15.7 | Quinc. | Sal.Al | Sus.P. | Hpho.Si | 1.3 | Hpho.Ti | 0.2 |
| 24 | 24 | — | 1 | 12 | Est.Wx | 15.7 | Carbk. | Sal.Al | Sus.P. | Hpho.Si | 1.3 | Hpho.Ti | 0.2 |
| 25 | 25 | 1 | 1 | 12 | Est.Wx | 15.7 | Cu Pc. | Sal.Al | Sus.P. | Hpho.Si | 1.0 | Hpho.Ti | 0.4 |
| 26 | 26 | 1 | 1 | 12 | Est.Wx | 15.7 | PY93 | Sal.Al | Sus.P. | Hpho.Si | 1.0 | Hpho.Ti | 0.4 |
| 27 | 27 | 1 | 1 | 12 | Est.Wx | 15.7 | Quinc. | Sal.Al | Sus.P. | Hpho.Si | 1.0 | Hpho.Ti | 0.4 |
| 28 | 28 | 1 | 1 | 12 | Est.Wx | 15.7 | Carbk. | Sal.Al | Sus.P. | Hpho.Si | 1.0 | Hpho.Ti | 0.4 |

Est.Wx: ester wax;
PE Wx: polyethylene wax;
PP Wx: polypropylene wax;
PY: C.I. Pigment Yellow
Cu Pc.: copper phthalocyanine;
Magnt.: magnetite;
Quinc.: quinacridone;
Carbk.: carbon black
Sal.Al: salicylic acid aluminum compound;
Sal.Zn: salicylic acid zinc compound
Sus.P.: suspension polymerization;
Eml.P.: emulsion polymerization
Sus.G.: suspension granulation
Hpho.Si: hydrophobic silica;
Hpho.Ti: hydrophobic titanium oxide

TABLE 3

| Developer No. | Toner No. | Carrier No. | Toner (Physical Properties): Toner physical properties: Wt.Av. particle diam. (μm) | Water/methanol wettability test: TA | Water/methanol wettability test: TB | TB − TA | Endothermic peak temp. (° C.) | Endothermic peak half width | Mn (×104) | Mw (×104) | MI | Tg (° C.) | SF-1 | SF-2 |
|---|---|---|---|---|---|---|---|---|---|---|---|---|---|---|
| 1 | 1 | — | 6.7 | 42 | 61 | 19 | 72 | 4 | 1.8 | 11.1 | 12 | 61.7 | 110 | 105 |
| 2 | 2 | — | 6.6 | 43 | 60 | 17 | 72 | 4 | 2.6 | 13.3 | 7 | 61.4 | 111 | 106 |
| 3 | 3 | — | 6.7 | 42 | 62 | 20 | 72 | 4 | 1.9 | 11.7 | 11 | 62.3 | 108 | 105 |
| 4 | 4 | — | 6.6 | 42 | 63 | 21 | 72 | 4 | 1.8 | 11.4 | 12 | 61.6 | 111 | 106 |
| 5 | 5 | — | 6.7 | 44 | 62 | 18 | 72 | 4 | 2.3 | 12.5 | 9 | 61.4 | 111 | 106 |
| 6 | 6 | — | 6.6 | 48 | 68 | 20 | 72 | 4 | 2.1 | 12.1 | 10 | 60.9 | 113 | 106 |
| 7 | 7 | — | 6.5 | 38 | 57 | 19 | 72 | 4 | 1.4 | 9.8 | 14 | 61.3 | 111 | 107 |
| 8 | 8 | — | 6.7 | 42 | 62 | 20 | 72 | 4 | 1.9 | 11.7 | 11 | 62.3 | 108 | 105 |
| 9 | 9 | — | 6.6 | 42 | 63 | 21 | 72 | 4 | 1.8 | 11.4 | 12 | 61.6 | 111 | 106 |
| 10 | 10 | — | 6.7 | 44 | 62 | 18 | 72 | 4 | 2.3 | 12.5 | 9 | 61.4 | 111 | 106 |
| 11 | 11 | — | 6.8 | 48 | 68 | 20 | 72 | 4 | 2.0 | 12.0 | 10 | 58.9 | 113 | 106 |
| 12 | 12 | — | 6.7 | 38 | 57 | 19 | 72 | 4 | 1.3 | 9.7 | 14 | 59.3 | 111 | 107 |
| 13 | 13 | — | 4.9 | 41 | 63 | 22 | 72 | 4 | 1.5 | 10.2 | 15 | 60.9 | 113 | 106 |
| 14 | 14 | — | 9.2 | 38 | 56 | 18 | 72 | 4 | 1.7 | 11.6 | 14 | 61.3 | 111 | 107 |
| 15 | 15 | — | 6.5 | 70 | 91 | 21 | 72 | 4 | 1.3 | 9.3 | 18 | 60.1 | 114 | 109 |
| 16 | 16 | — | 6.6 | 7 | 38 | 31 | 72 | 4 | 1.9 | 11.9 | 12 | 61.7 | 110 | 106 |
| 17 | 17 | — | 6.5 | 7 | 55 | 48 | 72 | 4 | 1.9 | 11.9 | 12 | 61.7 | 110 | 106 |
| 18 | 18 | — | 6.6 | 7 | 69 | 62 | 72 | 4 | 1.9 | 11.9 | 12 | 61.7 | 110 | 106 |
| 19 | 19 | — | 6.3 | 28 | 42 | 14 | 72 | 4 | 2.1 | 15.7 | 23 | 62.6 | 110 | 108 |
| 20 | 20 | — | 5.6 | 41 | 54 | 13 | 72 | 4 | 2.3 | 12.6 | 15 | 62.2 | 130 | 137 |
| 21 | 21 | — | 6.6 | 37 | 59 | 22 | 72 | 4 | 2.3 | 12.5 | 14 | 62.2 | 105 | 107 |
| 22 | 22 | — | 6.6 | 43 | 60 | 17 | 72 | 4 | 1.7 | 11.4 | 12 | 62.2 | 111 | 107 |
| 23 | 23 | — | 6.6 | 42 | 63 | 21 | 72 | 4 | 1.7 | 11.3 | 12 | 61.8 | 109 | 107 |
| 24 | 24 | — | 6.6 | 37 | 54 | 17 | 72 | 4 | 1.9 | 11.5 | 12 | 62.1 | 111 | 108 |
| 25 | 25 | 1 | 6.7 | 42 | 61 | 19 | 72 | 4 | 1.8 | 11.1 | 12 | 61.7 | 110 | 105 |
| 26 | 26 | 1 | 6.6 | 42 | 59 | 17 | 72 | 4 | 1.7 | 11.4 | 12 | 62.2 | 111 | 107 |
| 27 | 27 | 1 | 6.6 | 47 | 62 | 15 | 72 | 4 | 1.7 | 11.3 | 12 | 61.8 | 109 | 105 |
| 28 | 28 | 1 | 6.5 | 37 | 54 | 17 | 72 | 4 | 1.9 | 11.5 | 12 | 62.1 | 111 | 108 |

TABLE 4

| Developer No. | Toner No. | Carrier No. | Polar resin No. | Polar resin Acid val. | Polar resin Type | Content in toner (wt. %) | Colorant Type | Charge control agent Type | Produced by: | Inorganic fine particles Type 1 | Inorganic fine particles Amt. (pbw) | Inorganic fine particles Type 2 | Inorganic fine particles Amt. (pbw) |
|---|---|---|---|---|---|---|---|---|---|---|---|---|---|
| | | | Developer Composition | | | | | | | | | | |
| | | | Toner particles | | | | | | | | | | |
| | | | | | Release agent | | | | | | | | |
| 29 | 29 | — | 3 | 14 | Est.Wx | 15.7 | Cu Pc. | Sal.Al | Sus.P. | Hpho.Si | 1.3 | Hpho.Ti | 0.2 |
| 30 | 30 | — | 3 | 14 | PE Wx | 15.7 | Cu Pc. | Sal.Al | Sus.P. | Hpho.Si | 1.3 | Hpho.Ti | 0.2 |
| 31 | 31 | — | 1 | 12 | Est.Wx | 15.7 | Cu Pc. | — | Sus.P. | Hpho.Si | 1.3 | Hpho.Ti | 0.2 |
| 32 | 32 | — | 1 | 12 | Est.Wx | 15.7 | Cu Pc. | Sal.Zr | Sus.P. | Hpho.Si | 1.3 | Hpho.Ti | 0.2 |
| 33 | 33 | — | 1 | 12 | Est.Wx | 15.7 | Cu Pc. | Sal.Zn | Sus.P. | Hpho.Si | 1.3 | Hpho.Ti | 0.2 |
| 34 | 25 | 2 | 1 | 12 | Est.Wx | 15.7 | Cu Pc. | Sal.Al | Sus.P. | Hpho.Si | 1.0 | Hpho.Ti | 0.4 |
| 35 | 34 | — | 5 | 14 | PP Wx | 5.0 | Magnt. | Sal.Al | Sus.G. | Hpho.Si | 1.3 | Hpho.Ti | 0.2 |
| Comparative: | | | | | | | | | | | | | |
| Cp1 | Cp1 | — | Cp1 | 14 | PP Wx | 2.3 | Cu Pc. | Sal.Al | Sus.P. | Hpho.Si | 0.9 | Hpho.Ti | 0 |
| Cp2 | Cp2 | — | Cp2 | 14 | PP Wx | 2.3 | Cu Pc. | Sal.Al | Sus.P. | Hpho.Si | 0.9 | Hpho.Ti | 0 |
| Cp3 | Cp3 | — | Cp3 | 2 | PP Wx | 2.3 | Cu Pc. | Sal.Al | Sus.P. | Hpho.Si | 0.9 | Hpho.Ti | 0 |
| Cp4 | Cp4 | — | Cp4 | 37 | PP Wx | 2.3 | Cu Pc. | Sal.Al | Sus.P. | Hpho.Si | 0.9 | Hpho.Ti | 0 |
| Cp5 | Cp5 | — | Cp5 | 14 | PP Wx | 2.3 | Cu Pc. | Sal.Al | Sus.P. | Hpho.Si | 0.9 | Hpho.Ti | 0 |
| Cp6 | Cp6 | — | 11 | 4 | PP Wx | 2.3 | Cu Pc. | Sal.Al | Sus.P. | Hpho.Si | 1.1 | Hpho.Ti | 0 |
| Cp7 | Cp7 | — | 12 | 22 | PP Wx | 2.3 | Cu Pc. | Sal.Al | Sus.P. | Hpho.Si | 0.7 | Hpho.Ti | 0 |
| Cp8 | Cp8 | — | — | — | PP Wx | 6.6 | Cu Pc. | Sal.Al | Eml.P. | Hpho.Si | 0.9 | Hpho.Ti | 0 |

Est.Wx: ester wax;
PE Wx: polyethylene wax;
PP Wx: polypropylene wax;
Cu Pc.: copper phthalocyanine;
Magnt.: magnetite;
Quinc.: quinacridone;
Carbk.: carbon black
Sal.Al: salicylic acid aluminum compound;
Sal.Zn: salicylic acid zinc compound
Sus.P.: suspension polymerization;
Eml.P.: emulsion polymerization;
Sus.G.: suspension granulation
Hpho.Si: hydrophobic silica;
Hpho.Ti: hydrophobic titanium oxide

TABLE 5

| Developer No. | Toner No. | Carrier No. | Wt.Av. particle diam. (μm) | Water/methanol wettability test TA | Water/methanol wettability test TB | TB − TA | Endothermic peak temp. (° C.) | Endothermic peak half width | Mn (×104) | Mw (×104) | MI | Tg (° C.) | SF-1 | SF-2 |
|---|---|---|---|---|---|---|---|---|---|---|---|---|---|---|
| | | | Toner Physical Properties | | | | | | | | | | | |
| | | | Toner physical properties | | | | | | | | | | | |
| 29 | 29 | — | 6.7 | 42 | 62 | 20 | 48 | 4 | 1.3 | 8.8 | 21 | 59.6 | 113 | 108 |
| 30 | 30 | — | 6.7 | 42 | 62 | 20 | 122 | 17 | 2.1 | 13.5 | 10 | 61.8 | 111 | 107 |
| 31 | 31 | — | 6.6 | 41 | 60 | 19 | 72 | 4 | 1.8 | 11.1 | 12 | 61.7 | 110 | 105 |
| 32 | 32 | — | 6.7 | 40 | 60 | 20 | 72 | 4 | 1.7 | 11.0 | 12 | 61.7 | 111 | 104 |
| 33 | 33 | — | 6.6 | 40 | 59 | 19 | 72 | 4 | 1.7 | 11.0 | 12 | 61.7 | 109 | 104 |
| 34 | 25 | 2 | 6.7 | 42 | 61 | 19 | 72 | 4 | 1.8 | 11.1 | 12 | 61.7 | 110 | 105 |
| 35 | 34 | — | 6.5 | 29 | 42 | 13 | 72 | 4 | 2.1 | 12.2 | 15 | 62.6 | 110 | 108 |
| Comparative: | | | | | | | | | | | | | | |
| Cp1 | Cp1 | — | 6.7 | 32 | 37 | 5 | 129 | 22 | 2.0 | 12.9 | 10 | 61.8 | 110 | 107 |
| Cp2 | Cp2 | — | 6.7 | 32 | 35 | 3 | 129 | 22 | 1.9 | 12.8 | 11 | 61.7 | 111 | 107 |
| Cp3 | Cp3 | — | 6.7 | 34 | 37 | 3 | 129 | 22 | 2.2 | 13.3 | 10 | 61.8 | 110 | 107 |
| Cp4 | Cp4 | — | 6.7 | 29 | 34 | 5 | 129 | 22 | 1.4 | 9.9 | 16 | 59.9 | 113 | 108 |
| Cp5 | Cp5 | — | 6.7 | 32 | 35 | 3 | 129 | 22 | 1.9 | 12.8 | 11 | 61.7 | 111 | 107 |
| Cp6 | Cp6 | — | 3.2 | 21 | 36 | 15 | 129 | 22 | 1.5 | 10.2 | 15 | 60.9 | 114 | 107 |
| Cp7 | Cp7 | — | 10.7 | 41 | 46 | 5 | 129 | 22 | 1.7 | 11.6 | 14 | 61.2 | 108 | 105 |
| Cp8 | Cp8 | — | 6.6 | 41 | 48 | 7 | 129 | 22 | 1.3 | 11.2 | 15 | 60.1 | 130 | 137 |

Example 1

As an image-forming apparatus, used was a commercially available color laser printer CP2810 (manufactured by CANON INC.) which was altered to a printer having a fixing speed of 150 mm/s and being able to reproduce images on 20 sheets/minute.

Using Developer No. 1 composed of Toner No. 1, a 10,000-sheet paper feed running test was conducted in each of environments of 23° C./5% RH(N/L) and 32.5° C./92% RH (H/H). As an image pattern used here in the paper feed running test, an image pattern with a print percentage of 10% was used in which circles of 20 mm in diameter, having an image density of 1.5 as measured with a Model 504 reflection densitometer manufactured by X-Rite Co., were provided at five spots. After the paper feed running test was finished, evaluation was made according to the evaluation methods shown below. The results of evaluation are shown in Tables 6 and 7. As can be seen from Tables 6 and 7, substantially good results were obtained in all evaluation items.

(1) Low-temperature Fixing Performance:

Evaluated using Xx4024 (64 g paper) in an environment of L/L (15° C./10% RH). Solid images of 5 cm square each in size were reproduced on a A4 sheet of paper at nine spots. Here, unfixed images were each so formed as to be in a toner laid-on quantity of 0.6 mg/cm2. Their fixed images were rubbed five times with Silbon paper under application of a load of 4.9 kPa, and the temperature at which image density decreased by 20% or more as a result of rubbing was regarded as fixing lower-limit temperature to make evaluation.

(2) OHT Transparency Evaluation:

Using transparency sheets (OHT) for exclusive use in CP2810, solid images (on transfer sheet: 0.6 mg/cm2) were reproduced thereon in an environment of N/N (23.5° C./60% RH). The images formed were transmitted through a transmission type OHT projector, and projected images were evaluated in five ranks according to the following criteria.

(Evaluation Criteria)

A: Transparency is very high and good.

B: Transparency is good.

C: Dullness is somewhat seen, but of no problem in practical use.

D: Dullness is fairly seen, and on a level that is somewhat of problem.

E: Untolerable in practical use.

(3) High-temperature Anti-offset Properties:

Evaluated using Xx 64 g paper in an environment of N/N (23.5° C./60% RH). A solid white image was reproduced on 50 sheets fed in A4-lenghthwise feed. Thereafter, in A4-breadthwise feed, an image in which the whole area of 5 cm from the leading end was in halftone with an image density of 0.5 and the other area was in solid white was copied on double sides. The level of offset appearing here on the white background area was visually observed to make evaluation according to the following criteria.

(Evaluation Criteria)

A: No offset appears at all.

B: Offset appears slightly at end areas other than the area corresponding to A4-lenghthwise feed, but is not on a level that is of problem in practical use.

C: Offset a little appears at end areas other than the area corresponding to A4-lenghthwise feed. It is on a level barely tolerable in practical use, but of no problem in usual copying.

D: Offset appears in the whole area in the lengthwise direction of th sheet, and on a level that is of problem in practical use.

E: Offset appears starting from the fist side, in the whole area in the lengthwise direction, and is untolerable in practical use.

(4) Fog:

Fog was measured at the initial stage (at the time of image reproduction on 3rd sheet and 30th sheet) and after the running test was finished in the 10,000-sheet running tests in the environments of N/L and H/H. As a method therefor, the average reflectance Dr (%) on plain paper before image reproduction was measured with a reflectometer (REFLECTOMETER MODEL TC-6DS, manufactured by Tokyo Denshoku K.K.) having a filter of complementary color to the color on measurement. Meanwhile, a solid white image was reproduced on plain paper, and then the reflectance Ds (%) of the solid white image was measured. Fog (%) was calculated from the following equation:

$$\text{Fog}(\%)=Dr(\%)-Ds(\%).$$

(5) Image Density:

At the initial stage (at the time of image reproduction on 3rd sheet and 30th sheet) and after the running test was finished in the 10,000-sheet running tests in the environments of N/L and H/H, image density was measured with a Model 504 reflection densitometer manufactured by X-Rite Co. A chart in which circles of 5 mm in diameter were made present at 9 spots (3 spots in the vertical direction×3 spots in the horizontal direction) in an A4 sheet was copied, and an average value of image densities measured here at 9 spots was regarded as the image density.

(6) Melt Adhesion to Drum:

After the 10,000-sheet running test in the environment of N/L, whether or not any melt-adhesion matter appeared on the photosensitive drum was observed visually and with a loupe to make evaluation in six ranks according to the following evaluation criteria.

(Evaluation Criteria)

A: No melt-adhesion matter is present at all.

AB: Melt-adhesion matter of 0.1 mm or less in diameter is present at several spots on the drum, but of no problem on images at all.

B: Melt-adhesion matter of 0.1 mm to 0.4 mm in diameter is present at several spots on the drum and stands appeared slightly on images, but is not on a level that is of problem in practical use.

BC: Melt-adhesion matter of more than 0.4 mm in diameter is present at ten spots or more on the drum, standing also appeared on images, and is on a level that is of problem.

C: Melt-adhesion matter of 0.4 mm to 1 mm in diameter is present at ten to twenty spots on the drum, standing also appeared on images, and is on a level that is of problem.

CC: Melt-adhesion matter of more than 1 mm in diameter is present on the drum over its whole surface, standing also appeared on images in a large number, and is on a level that is of problem and untolerable in practical use.

(7) Evaluation on Photosensitive Member Faulty Cleaning:

After the 10,000-sheet running test in the environment of N/L, whether or not any faulty cleaning of the photosensitive member (drum) came about was visually observed to make evaluation in six ranks according to the following evaluation criteria.

(Evaluation Criteria)

A: No faulty cleaning is seen at all.

B: Faulty cleaning is seen in a length of 1 mm or less at several spots on the drum, but of no problem on images at all.

C: Faulty cleaning is seen in a length of 1 mm to 4 mm at several spots on the drum, and stains stand appeared slightly on images, but are not on a level that is of problem in practical use.

D: Faulty cleaning is seen in a length of 4 mm or more at ten spots or more on the drum, and stains also stand appeared on images, which are on a level that is of problem.

E: Faulty cleaning is seen in a diameter of 4 mm to 10 mm at ten to twenty spots on the drum, and stains also stand appeared on images, which are on a level that is of problem.

F: Faulty cleaning is seen in a diameter of more than 10 mm on the drum over its whole surface, and stains also stand appeared on images in a large number, which are on a level that is of problem and untolerable in practical use.

(8) Image Quality Evaluation:

In the 10,000-sheet running test in the environment of H/H, image quality was evaluated (overall evaluation on 5-point characters, line images and solid images) visually and with a loupe. Evaluation was made according to the following criteria.

(Evaluation Criteria)

A: No spot around line images is seen, line images and character images are sharp, and solid images are also uniform and good.

B: Spots around line images are somewhat seen on the observation with a loupe, but of no problem at all on visual observation, and solid images are also uniform and good.

C: Some spots around line images and character images are seen on visual observation, but are not on a level that is of problem in practical use.

D: Many spots around line images and character images are seen on visual observation, but are not on a level that is barely of no problem in ordinary use.

E: Many spots around line images and character images are seen on visual observation, and are on a level that is of problem.

F: Many spots around line images and character images are seen on visual observation, and are untolerable in practical use.

G: Not only line images and character images but also solid images have no uniformity with poor quality, and are untolerable in practical use.

(9) Evaluation on Toner Scattering:

After the 10,000-sheet running test in the environment of H/H, evaluation on toner scattering was made by the quantity of toner accumulating beneath the developing sleeve and inside the machine and according to the following criteria.

(Evaluation Criteria)

A: No toner accumulates at all beneath the developing sleeve and inside the machine, showing good results.

B: A toner layer is slightly seen beneath the developing sleeve, but no toner is seen to have scattered inside the machine, showing good results.

C: Toner stands somewhat scattered beneath the developing sleeve and inside the machine, but not on a level that is of problem.

D: Toner stands scattered beneath the developing sleeve and inside the machine, and on a level that is of problem.

E: Toner stands scattered beneath the developing sleeve and inside the machine at many places, being untolerable in practical use.

F: The machine inside stands contaminated in toner color, also causing image defects frequently, which are untolerable in practical use.

(10) Fixing Roller Wind-around Test:

The winding of paper around the fixing roller was tested at the initial stage (1st to 30th sheets) of the running test in the environment of H/H to make evaluation. On EN100 (64 g paper) perfectly moisture-conditioned paper (transfer sheet), a solid toner image was placed in a toner laid-on quantity of 1.1 mg/cm2 from the position of 1 mm from the leading end of the transfer sheet to form an unfixed toner image. This was fixed using the fixing assembly of iRC3200. Here, fixing temperature was dropped 5° C. by 5° C. to perform fixing, where the temperature at which the transfer sheet wound around the fixing roller was regarded as fixing roller wind-around temperature.

Incidentally, in Table 6, "fixing wind-around temp." means a fixing temperature at which a transfer medium winds around a fixing member.

(11) Blocking Test:

10 g of the toner was put into a 50 cc plastic cup. This was left for 3 days (72 hours) in a 53° C. thermostatic chamber, and then how the toner stood was visually observed to make evaluation according to the following criteria.

(Evaluation Criteria)

A: No blocking at all, and the toner stands substantially alike to the one at the initial stage.

B: The toner somewhat tends to agglomerate, but in such a state that agglomerates break down when the plastic cup is turned, and is especially of no problem.

C: The toner tends to agglomerate, but in such a state that agglomerates come loose by breaking down them manually, and is barely tolerable in practical use.

D: The toner agglomerates so seriously as to be of problem in practical use.

E: The toner stands solidified, and is not usable.

(12) Measurement of Transfer Efficiency:

The transfer efficiency of toner was evaluated at the last stage of the 10,000-sheet running test in the environment of H/H. A solid toner image with a toner image laid-on quantity of 0.65 mg/cm2 was formed by development on the drum, and thereafter transferred to EN100 (64 g paper) to form an unfixed toner image. The transfer efficiency of toner was found from a difference in weight here between the weight of toner on drum and the weight of toner on transfer sheet (the transfer efficiency is regarded as 100% when the toner on drum is all transferred to the transfer sheet).

(Evaluation Criteria)

A: Transfer efficiency is 95% or more.

B: Transfer efficiency is from 90% or more to less than 95%.

C: Transfer efficiency is from 80% or more to less than 90%.

D: Transfer efficiency is from 70% or more to less than 80%.

E: Transfer efficiency is less than 70%.

(13) Tinge Variation (Changing) Test:

Prints of a photographic image having yellow, magenta and cyan primary colors and R (red), G (green) and B (blue) secondary colors were sampled on 10 sheets at the initial stage (1st to 30th sheets) and after 10,000-sheet running each. Here, tinges of the printed images at the initial stage and after the running were visually observed to make evaluation according to the following criteria.

(Evaluation Criteria)

A: No tinge variation is seen at all.

B: Tinge variation is little seen.

C: Tinge variation is somewhat seen, and is on such a level that it is noticed by sever users.

D: Tinge variation is seen, and is on a level that it is noticed by users.

E: Tinges differ so greatly as to bring about a great problem in practical use.

Examples 2 to 29

Developers Nos. 2 to 35 were produced using toners, or toners in combination with carriers, as shown in Tables 2 and 4. Using these respective developers, evaluation was made in the same manner as in Example 1. The results obtained are shown in Tables 6 and 7. Incidentally, in respect of Examples 22, 23 and 26, evaluation was made on cyan colors in the case of full-color image reproduction.

Figure 2:
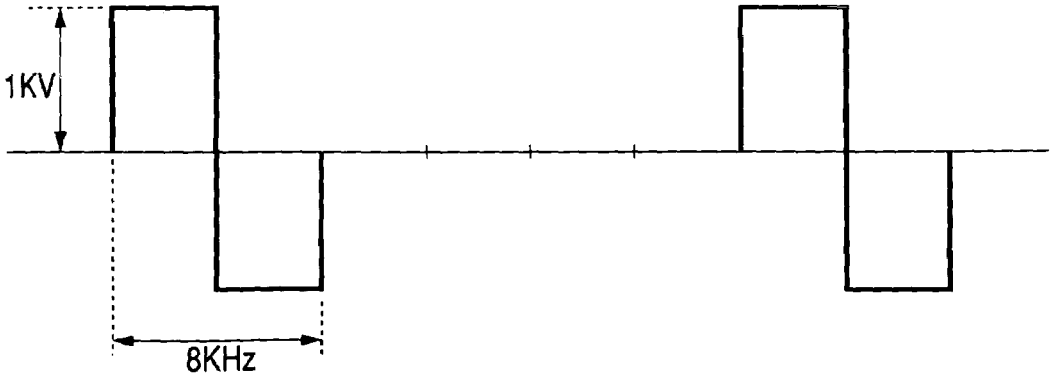
FIG. 2 a graph showing an alternating electric field used in Examples.

In the case when two-component developers are used, developers and an image-forming apparatus which were prepared and altered, respectively, in the following way. First, 92 parts of each magnetic carrier and 8 parts of each toner were blended by means of a V-type mixer to make up each two-component developer. To make evaluation using the two-component developers, as an image-forming apparatus, a commercially available digital copying machine CP2150 (manufactured by CANON INC.) was altered to a copying machine having a fixing speed of 150 mm/s and being able to reproduce images on 35 sheets/minute. The copying machine was further so altered that the developing assembly and charging assembly as shown in FIG. 1 were able to be set in. As development bias, the bias as shown in FIG. 2 was used. In the fixing assembly, both the heating roller and the pressure roller were changed for rollers the surface layers of which were coated with PFA in a thickness of 1.2 μm. The copying machine was also altered in such a form that all contact members other than the pressure rollers were removed.

Comparative Examples 1 to 8

Using Comparative Toners No. 1 to No. 8 shown in Table 4 and 5, tests and evaluation were conducted in the same manner as in Example 1. The results are shown in Tables 6 and 7.

TABLE 6

| | | | Evaluation Results (1) | | | | | | | | |
|---|---|---|---|---|---|---|---|---|---|---|---|
| | | | Fixing | Low-temp. fixing performance Initial | High-temp. anti-offset properties | Fog | | | | | |
| | | | wind = around | stage | Initial | Initial stage | | | | After 10,000 | |
| | Developer | OHT | temp. | 15° C./ | stage | (3rd sh.) | | (30th sh.) | | sheets | |
| | No. | transparency | (° C.) | 10% RH | N/N | N/L | H/H | N/L | H/H | N/L | H/H |
| Example: | | | | | | | | | | | |
| 1 | 1 | B | 160 | 155 | B | 0.7 | 1.0 | 0.5 | 0.8 | 0.9 | 1.2 |
| 2 | 2 | C | 165 | 165 | A | 0.5 | 0.8 | 0.4 | 0.7 | 0.8 | 0.9 |
| 3 | 3 | B | 160 | 155 | B | 0.7 | 0.8 | 0.5 | 0.6 | 0.9 | 1.0 |
| 4 | 4 | B | 160 | 155 | B | 0.9 | 0.7 | 0.7 | 0.5 | 1.1 | 0.9 |
| 5 | 5 | B | 165 | 160 | A | 0.5 | 0.7 | 0.5 | 0.8 | 0.7 | 0.9 |
| 6 | 6 | B | 160 | 155 | B | 1.1 | 1.3 | 1.1 | 1.2 | 1.3 | 1.5 |
| 7 | 7 | B | 155 | 150 | B | 1.1 | 0.6 | 1.1 | 0.6 | 1.3 | 0.6 |
| 8 | 8 | B | 160 | 155 | B | 0.7 | 0.8 | 0.5 | 0.6 | 0.9 | 1.0 |
| 9 | 9 | B | 160 | 155 | B | 0.9 | 0.7 | 0.7 | 0.5 | 1.1 | 0.9 |
| 10 | 10 | B | 160 | 155 | B | 1.1 | 1.3 | 1.1 | 1.2 | 1.3 | 1.5 |
| 11 | 11 | B | 160 | 155 | B | 1.6 | 1.7 | 1.3 | 1.2 | 1.1 | 1.0 |
| 12 | 12 | B | 155 | 150 | B | 0.7 | 0.6 | 0.8 | 0.6 | 1.6 | 0.6 |
| 13 | 13 | B | 160 | 155 | B | 1.2 | 1.3 | 1.2 | 1.2 | 1.5 | 1.5 |
| 14 | 14 | B | 160 | 150 | B | 0.7 | 0.6 | 0.9 | 0.6 | 1.1 | 1.0 |
| 15 | 15 | B | 150 | 150 | A | 0.9 | 1.3 | 0.7 | 1.1 | 1.4 | 1.7 |
| 16 | 16 | A | 170 | 165 | C | 1.0 | 1.8 | 0.8 | 1.1 | 1.2 | 1.8 |
| 17 | 17 | A | 170 | 165 | C | 0.6 | 1.1 | 0.4 | 1.1 | 1.4 | 1.9 |
| 18 | 18 | A | 170 | 165 | C | 0.7 | 2.0 | 0.5 | 1.2 | 1.5 | 1.9 |
| 19 | 19 | — | 170 | 170 | B | 1.0 | 1.1 | 0.8 | 0.9 | 1.2 | 1.3 |
| 20 | 20 | A | 170 | 160 | C | 1.4 | 1.6 | 1.2 | 1.4 | 1.6 | 1.8 |
| 21 | 21 | A | 170 | 160 | C | 1.2 | 1.3 | 0.9 | 0.9 | 1.3 | 1.3 |
| 22 | 1, 22 23, 24 | B | 160 | 155 | B | 0.8 | 1.1 | 0.6 | 0.9 | 1.0 | 1.3 |
| 23 | 25, 26 27, 28 | B | 160 | 155 | B | 0.6 | 0.7 | 0.4 | 0.5 | 0.8 | 0.9 |
| 24 | 29 | B | 160 | 160 | B | 1.2 | 1.4 | 1.5 | 1.6 | 2.3 | 2.4 |
| 25 | 30 | B | 175 | 170 | A | 0.7 | 0.8 | 0.5 | 0.6 | 0.9 | 1.0 |
| 26 | 34, 26 27, 28 | B | 160 | 155 | B | 0.6 | 0.7 | 1.3 | 1.4 | 2.8 | 2.6 |
| 27 | 31 | B | 160 | 155 | B | 1.4 | 1.6 | 1.5 | 1.8 | 1.4 | 1.6 |
| 28 | 32 | B | 160 | 155 | B | 0.7 | 1.0 | 0.6 | 0.8 | 1.0 | 1.2 |
| 29 | 33 | B | 160 | 155 | B | 1.2 | 1.2 | 1.1 | 1.2 | 1.0 | 1.2 |
| 30 | 35 | — | 170 | 160 | 0 | 1.1 | 1.2 | 0.9 | 1.0 | 1.3 | 1.4 |

TABLE 6-continued

| | | | Evaluation Results (1) | | | | | | | | |
|---|---|---|---|---|---|---|---|---|---|---|---|
| | | | Fixing | Low-temp. fixing performance Initial | High-temp. anti-offset properties | Fog | | | | | |
| | | | wind = around | stage | Initial | Initial stage | | | | After 10,000 | |
| | Developer | OHT | temp. | 15° C./ | stage | (3rd sh.) | | (30th sh.) | | sheets | |
| | No. | transparency | (° C.) | 10% RH | N/N | N/L | H/H | N/L | H/H | N/L | H/H |
| Comparative Example: | | | | | | | | | | | |
| 1 | Cp1 | C | 185 | 175 | D | 1.8 | 2.9 | 1.0 | 2.1 | 1.2 | 1.1 |
| 2 | Cp2 | C | 185 | 175 | D | 1.7 | 2.8 | 0.9 | 2.0 | 1.2 | 1.0 |
| 3 | Cp3 | C | 185 | 175 | D | 3.1 | 3.7 | 3.1 | 3.3 | 3.4 | 3.9 |
| 4 | Cp4 | C | 185 | 175 | D | 1.7 | 1.9 | 0.9 | 1.1 | 4.4 | 1.6 |
| 5 | Cp5 | C | 185 | 175 | D | 1.7 | 2.8 | 0.9 | 2.0 | 1.2 | 1.0 |
| 6 | Cp6 | C | 185 | 175 | D | 4.6 | 4.2 | 3.8 | 3.4 | 2.8 | 2.4 |
| 7 | Cp7 | C | 185 | 175 | D | 2.0 | 2.6 | 1.2 | 1.8 | 0.9 | 1.5 |
| 8 | Cp8 | E | 195 | 190 | E | 3.6 | 3.4 | 2.8 | 2.6 | 1.8 | 1.6 |

TABLE 7

Evaluation Results (2)

1): Blocking

| | | Image density | | | | | | | | Faulty cleaning | Toner scatter in H/H | Transfer efficiency in H/H | | Melt adhesion in N/L |
|---|---|---|---|---|---|---|---|---|---|---|---|---|---|---|
| | | Initial stage | | | | After | | | | in N/L | after | after | | after |
| | Developer | (3rd sh.) | | (30th sh.) | | 10,000 sh. | | Tinge | Image | 10,000 | 10,000 | 10,000 | | 10,000 |
| Example: | No. | N/L | H/H | N/L | H/H | N/L | H/H | changing | quality | sheets | sheets | sheets | (1) | sheets |
| 1 | 1 | 1.5 | 1.48 | 1.49 | 1.5 | 1.52 | 1.5 | A | B | A | A | A | A | A |
| 2 | 2 | 1.5 | 1.49 | 1.49 | 1.51 | 1.52 | 1.51 | A | B | A | A | A | A | A |
| 3 | 3 | 1.48 | 1.5 | 1.47 | 1.52 | 1.5 | 1.52 | A | B | A | A | A | A | A |
| 4 | 4 | 1.5 | 1.49 | 1.49 | 1.51 | 1.52 | 1.51 | A | B | A | A | A | A | A |
| 5 | 5 | 1.51 | 1.5 | 1.5 | 1.52 | 1.53 | 1.52 | A | B | A | A | A | A | A |
| 6 | 6 | 1.48 | 1.45 | 1.47 | 1.47 | 1.51 | 1.5 | A | B | A | B | A | A | A |
| 7 | 7 | 1.49 | 1.5 | 1.48 | 1.52 | 1.46 | 1.52 | A | B | A | B | A | A | A |
| 8 | 8 | 1.48 | 1.5 | 1.47 | 1.52 | 1.5 | 1.52 | A | B | A | A | A | A | A |
| 9 | 9 | 1.5 | 1.49 | 1.49 | 1.51 | 1.52 | 1.51 | A | B | A | A | A | A | A |
| 10 | 10 | 1.46 | 1.49 | 1.48 | 1.51 | 1.51 | 1.5 | A | B | A | B | A | A | A |
| 11 | 11 | 1.44 | 1.43 | 1.47 | 1.49 | 1.51 | 1.5 | A | B | A | C | A | A | A |
| 12 | 12 | 1.49 | 1.5 | 1.48 | 1.52 | 1.42 | 1.52 | A | C | A | B | A | A | A |
| 13 | 13 | 1.45 | 1.45 | 1.48 | 1.49 | 1.44 | 1.47 | A | B | C | C | A | A | AB |
| 14 | 14 | 1.48 | 1.51 | 1.47 | 1.53 | 1.47 | 1.53 | A | C | A | A | A | A | A |
| 15 | 15 | 1.48 | 1.46 | 1.46 | 1.52 | 1.44 | 1.52 | B | B | B | B | B | B | AB |
| 16 | 16 | 1.5 | 1.5 | 1.49 | 1.56 | 1.52 | 1.56 | A | C | A | A | B | A | A |
| 17 | 17 | 1.51 | 1.48 | 1.5 | 1.5 | 1.53 | 1.54 | B | B | A | B | A | A | A |
| 18 | 18 | 1.5 | 1.5 | 1.49 | 1.52 | 1.52 | 1.56 | C | B | A | B | A | A | A |
| 19 | 19 | 1.44 | 1.46 | 1.43 | 1.47 | 1.46 | 1.47 | — | B | A | A | B | A | A |
| 20 | 20 | 1.44 | 1.46 | 1.43 | 1.48 | 1.46 | 1.48 | A | B | A | A | C | B | A |
| 21 | 21 | 1.48 | 1.5 | 1.47 | 1.52 | 1.5 | 1.52 | A | B | A | A | A | B | A |
| 22 | 1, 22 23, 24 | 1.48 | 1.51 | 1.47 | 1.53 | 1.5 | 1.53 | A | B | A | A | A | A | A |
| 23 | 25, 26 27, 28 | 1.5 | 1.5 | 1.49 | 1.52 | 1.52 | 1.52 | A | B | A | A | A | A | A |
| 24 | 29 | 1.48 | 1.5 | 1.47 | 1.52 | 1.5 | 1.52 | A | B | A | C | B | C | A |
| 25 | 30 | 1.48 | 1.5 | 1.47 | 1.52 | 1.5 | 1.52 | A | B | A | A | A | A | A |
| 26 | 34, 26 27, 28 | 1.5 | 1.5 | 1.57 | 1.54 | 1.64 | 1.64 | C | C | A | B | C | A | AB |
| 27 | 31 | 1.4 | 1.4 | 1.45 | 1.45 | 1.53 | 1.51 | C | B | A | C | A | A | A |
| 28 | 32 | 1.5 | 1.48 | 1.5 | 1.51 | 1.53 | 1.51 | A | B | A | A | A | A | A |
| 29 | 33 | 1.44 | 1.44 | 1.5 | 1.51 | 1.53 | 1.51 | B | C | A | B | A | A | A |
| 30 | 35 | 1.45 | 1.45 | 1.44 | 1.47 | 1.47 | 1.47 | — | B | A | A | A | B | A |

TABLE 7-continued

Evaluation Results (2)

1): Blocking

| Comparative Example: | | | | | | | | | | | | | | |
|---|---|---|---|---|---|---|---|---|---|---|---|---|---|---|
| 1 | Cp1 | 1.33 | 1.32 | 1.45 | 1.39 | 1.49 | 1.45 | B | C | A | C | B | A | A |
| 2 | Cp2 | 1.35 | 1.33 | 1.46 | 1.41 | 1.48 | 1.46 | B | C | A | C | B | A | A |
| 3 | Cp3 | 1.3 | 1.2 | 1.35 | 1.36 | 1.48 | 1.46 | B | C | A | E | C | A | A |
| 4 | Cp4 | 1.4 | 1.36 | 1.48 | 1.47 | 1.31 | 1.43 | B | D | A | C | B | A | A |
| 5 | Cp5 | 1.35 | 1.33 | 1.46 | 1.41 | 1.48 | 1.46 | B | C | A | C | B | A | A |
| 6 | Cp6 | 1.34 | 1.27 | 1.48 | 1.41 | 1.49 | 1.45 | C | C | E | E | D | A | BC |
| 7 | Cp7 | 1.33 | 1.27 | 1.46 | 1.41 | 1.49 | 1.43 | C | E | A | B | B | B | A |
| 8 | Cp8 | 1.34 | 1.25 | 1.43 | 1.42 | 1.49 | 1.45 | D | C | A | D | D | B | A |

This application claims priority from Japanese Patent Application No. 2004-275553 filed on Sep. 22, 2004, which is hereby incorporated by reference herein.

What is claimed is:

1. A toner comprising toner particles which comprise toner base particles containing at least a colorant, a release agent and a polar resin;

said polar resin is a resin having at least a polyester unit, synthesized in the presence of an aromatic carboxylic acid titanium compound used as a catalyst, wherein said aromatic carboxylic acid titanium compound is a compound obtained by the reaction of an aromatic carboxylic acid with a titanium alkoxide, wherein said aromatic carboxylic acid is selected from the group consisting of an isophthalic acid and a terephthalic acid;

said polar resin has an acid value of from 3 mgKOH/g to 35 mgKOH/g;

said toner base particles have been granulated in an aqueous system by suspension polymerization, emulsion polymerization or suspension granulation;

said toner has a weight average particle diameter of from 4.0 μm to 10.0 μm; and said release agent is contained in an amount of from 6 to 18 parts by weight based on 100 parts by weight of the toner base particles.

2. The toner according to claim 1, wherein said titanium alkoxide is a compound represented by the following formula (1):

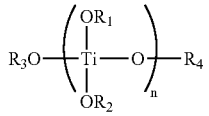

(1)

wherein $R_1$, $R_2$, $R_3$ and $R_4$ each represent an alkyl group having 1 to 20 carbon atoms, which may be identical with or different from each other and may have a substituent; and n represents an integer of 1 to 10.

3. The toner according to claim 1, wherein, in a water/methanol wettability test of said toner base particles and said toner, the methanol concentration (% by weight) of each of them at the time the transmittance shows the value of 50% of the initial value satisfies the following expressions:

$$10 \leqq TA \leqq 70;$$

$$30 \leqq TB \leqq 90; \text{ and}$$

$$0 \leqq TB - TA \leqq 60$$

wherein TA is the methanol concentration (% by weight) at the time the transmittance of said toner base particles shows the value of 50%, and TB is the methanol concentration (% by weight) at the time the transmittance of said toner shows the value of 50%.

4. The toner according to claim 1, wherein the toner has a peak temperature of a maximum endothermic peak of 50° C. to 120° C. in a temperature range of 30° C. to 200° C. in an endothermic curve obtained by differential scanning calorimetry (DSC) measurement.

5. The toner according to claim 1, which further comprises a salicylic acid metal compound as a charge control agent.

6. The toner according to claim 5, wherein said salicylic acid metal compound is a salicylic acid aluminum compound or a salicylic acid zirconium compound.

7. The toner according to claim 1, wherein said polar resin has a hydroxyl value of from 5 mgKOH/g to 40 mgKOH/g.

8. The toner according to claim 1, wherein said toner base particles are toner base particles produced by dispersing and granulating in an aqueous medium a polymerizable monomer composition which contains at least a polymerizable monomer, the colorant, the polar resin, the release agent and a polymerization initiator, and polymerizing the polymerizable monomer.

* * * * *